US012540803B2

(12) United States Patent
Toomey et al.

(10) Patent No.: US 12,540,803 B2
(45) Date of Patent: Feb. 3, 2026

(54) TACTICAL HIGH POWER MICROWAVE ANTENNA PEDESTAL

(71) Applicant: Raytheon Company, Arlington, VA (US)

(72) Inventors: Michael A. Toomey, Marlborough, MA (US); Paul J. Marchetti, Dracut, MA (US); Steven P. Kemp, Boxborough, MA (US); Derek P. Rocca, Stow, MA (US); Earl M. Dressel, Albuquerque, NM (US)

(73) Assignee: Raytheon Company, Arlington, VA (US)

( * ) Notice: Subject to any disclaimer, the term of this patent is extended or adjusted under 35 U.S.C. 154(b) by 353 days.

(21) Appl. No.: 18/357,422

(22) Filed: Jul. 24, 2023

(65) Prior Publication Data

US 2025/0035410 A1 Jan. 30, 2025

(51) Int. Cl.
*F41H 13/00* (2006.01)

(52) U.S. Cl.
CPC ..... *F41H 13/0068* (2013.01)

(58) Field of Classification Search
CPC ..... F41H 13/0068
See application file for complete search history.

(56) References Cited

U.S. PATENT DOCUMENTS 2,514,617 A 7/1950 Albersheim
3,241,142 A 3/1966 Raabe
3,254,692 A 6/1966 Travers
3,267,472 A 8/1966 Fink
3,534,373 A 10/1970 Gustincic et al.
(Continued)

FOREIGN PATENT DOCUMENTS

CA 2213770 A1 10/1996
CN 101438426 A 5/2009
(Continued)

OTHER PUBLICATIONS

"International Application Serial No. PCT US2024 039137, International Search Report mailed Nov. 12, 2024", 4 pgs.
(Continued)

*Primary Examiner* — Nicole M Ippolito
(74) *Attorney, Agent, or Firm* — Schwegman Lundberg & Woessner, P.A.

(57) ABSTRACT

An antenna system comprises a reflector subsystem, a rotatable support structure and a support member. The reflector subsystem receives an input beam and reflects the input beam to produce an output beam steered in elevation by an elevation reflector and in azimuth by an azimuth reflector, towards a target. The rotatable support structure is operably coupled to the azimuth reflector and to the elevation reflector and is configured to rotate them simultaneously. The support member comprises a lengthwise portion coupled to the rotatable support structure and an offset portion coupled to the elevation reflector, the offset portion configured to offset the elevation reflector from the lengthwise portion. The offset portion is configured to enable clearance of the elevation reflector during beam steering of the output beam to extreme ends of a range of motion of the elevation reflector.

20 Claims, 31 Drawing Sheets

(56) References Cited

U.S. PATENT DOCUMENTS

| | | | | |
|---|---|---|---|---|
| 4,293,859 | A | 10/1981 | Sergent | |
| 4,527,166 | A | 7/1985 | Luly | |
| 4,608,571 | A | 8/1986 | Luly | |
| 4,683,475 | A | 7/1987 | Luly | |
| 4,771,293 | A | 9/1988 | Williams et al. | |
| 4,926,181 | A | 5/1990 | Stumm | |
| 5,444,449 | A | 8/1995 | Poskett et al. | |
| 5,963,174 | A | 10/1999 | Larsson et al. | |
| 5,966,104 | A | 10/1999 | Massey et al. | |
| 5,990,835 | A | 11/1999 | Kuntzsch et al. | |
| 6,028,570 | A | 2/2000 | Gilger et al. | |
| 6,160,520 | A | 12/2000 | Muhlhauser et al. | |
| 6,195,061 | B1 | 2/2001 | Hizal et al. | |
| 6,236,834 | B1 | 5/2001 | Poskett et al. | |
| 6,359,588 | B1 | 3/2002 | Kuntzsch | |
| 6,366,234 | B1 | 4/2002 | Katayama | |
| 6,559,807 | B2 | 5/2003 | Koslover | |
| 6,621,461 | B1 | 9/2003 | Ramanujam et al. | |
| 7,133,001 | B2 | 11/2006 | Mrstik et al. | |
| 7,965,235 | B2 | 6/2011 | Quan et al. | |
| 8,453,551 | B2 | 6/2013 | Rosenberg et al. | |
| 8,527,003 | B2 | 9/2013 | Gupta et al. | |
| 9,000,999 | B2 | 4/2015 | Venghaus et al. | |
| 9,112,282 | B2 | 8/2015 | Nurnberger et al. | |
| 9,190,717 | B2 | 11/2015 | Schoeberl et al. | |
| 9,519,995 | B2 | 12/2016 | Narukawa | |
| 9,786,993 | B1 | 10/2017 | Koslover | |
| 10,181,643 | B2 * | 1/2019 | Liu | H01Q 3/08 |
| 10,591,587 | B2 | 3/2020 | Blanchard et al. | |
| 10,868,642 | B1 | 12/2020 | Petrovic et al. | |
| 2002/0011963 | A1 | 1/2002 | Koslover | |
| 2004/0021614 | A1 | 2/2004 | Moheb | |
| 2004/0150550 | A1 | 8/2004 | Shouno et al. | |
| 2005/0062660 | A1 | 3/2005 | Henderson et al. | |
| 2005/0073467 | A1 | 4/2005 | Kawahara et al. | |
| 2006/0038728 | A1 | 2/2006 | McEwan | |
| 2006/0109193 | A1 | 5/2006 | Williams | |
| 2007/0080861 | A1 * | 4/2007 | Norin | H01Q 19/13 342/359 |
| 2007/0247364 | A1 | 10/2007 | Liao et al. | |
| 2007/0285314 | A1 | 12/2007 | Mortazawi et al. | |
| 2011/0043423 | A1 | 2/2011 | Kirino et al. | |
| 2011/0068989 | A1 * | 3/2011 | Bousquet | H01Q 3/02 343/761 |
| 2011/0235465 | A1 | 9/2011 | Bostick et al. | |
| 2015/0349430 | A1 | 12/2015 | Nurnberger et al. | |
| 2016/0352022 | A1 | 12/2016 | Thomson et al. | |
| 2017/0179596 | A1 | 6/2017 | Diaz et al. | |
| 2018/0058826 | A1 | 3/2018 | Podgorski | |
| 2018/0102590 | A1 | 4/2018 | Ebberg et al. | |
| 2018/0254554 | A1 * | 9/2018 | Sorrentino | H01Q 1/1264 |
| 2019/0260124 | A1 | 8/2019 | Davoyan et al. | |
| 2019/0376769 | A1 | 12/2019 | Stark et al. | |
| 2020/0411980 | A1 | 12/2020 | Kim et al. | |
| 2022/0311506 | A1 * | 9/2022 | McGarrahan | H04B 7/195 |
| 2023/0085548 | A1 | 3/2023 | Hopkins | |

FOREIGN PATENT DOCUMENTS

| | | | |
|---|---|---|---|
| CN | 102983902 | | 3/2013 |
| CN | 105206941 | A | 12/2015 |
| CN | 105680181 | A | 6/2016 |
| CN | 106486789 | A | 3/2017 |
| CN | 107016161 | A | 8/2017 |
| CN | 107439002 | A | 12/2017 |
| CN | 107959102 | | 4/2018 |
| CN | 108598676 | A | 9/2018 |
| CN | 108987937 | A | 12/2018 |
| CN | 109066058 | A | 12/2018 |
| CN | 110890633 | | 3/2020 |
| DE | 3237136 | A1 | 4/1984 |
| DE | 3338937 | C2 | 7/1988 |
| EP | 0 865 101 | A1 | 9/1998 |
| GB | 2 167 240 | A | 5/1986 |
| GB | 2 546 309 | A | 7/2017 |
| HU | 9900861 | A2 | 7/1999 |
| JP | S61100005 | | 5/1986 |
| JP | 2010-033573 | A | 2/2010 |
| JP | 7069232 | B2 | 5/2022 |
| NZ | 522236 | A | 1/2005 |
| RU | 2185696 | C1 | 7/2002 |
| TW | 200536172 | A | 11/2005 |
| TW | 200803047 | A | 1/2008 |
| WO | WO 82/00545 | | 2/1982 |
| WO | WO 96/31016 | | 10/1996 |
| WO | WO 99/35515 | | 7/1999 |
| WO | WO 99/54955 | A2 | 10/1999 |
| WO | WO 00/29837 | | 5/2000 |
| WO | WO 01/63696 | A1 | 8/2001 |
| WO | WO 02/07256 | A2 | 1/2002 |
| WO | WO 02/097923 | A1 | 12/2002 |
| WO | WO 2006/053215 | A2 | 5/2006 |
| WO | WO 2009/064011 | A1 | 5/2009 |
| WO | WO 2013/016828 | A1 | 2/2013 |

OTHER PUBLICATIONS

"International Application Serial No. PCT US2024 039137, Written Opinion mailed Nov. 12, 2024", 6 pgs.

Leonardo, "TSM231 B C, X, KU, KA MIL, KA CIV Trailer Mounted Multi-Band Satellite Terminal", (Jan. 1, 2016), 4 pgs.

* cited by examiner

Stowed HPM system FIG. 3 as transported in C-17

1st Antenna Side View

Antenna Rear View

Antenna Auxiliary View

TACTICAL HIGH POWER MICROWAVE ANTENNA PEDESTAL

FIELD

Embodiments of the disclosure generally relate to devices, systems, and methods for transmitting and receiving electromagnetic waves at microwave frequencies. More particularly, the disclosure describes embodiments relating to devices, systems, and methods for implementing a high-power microwave antenna system having shaped reflector optics and optimized mechanisms to provide improved stowing and transportability.

BACKGROUND

In some applications, it is desirable for a high power radiofrequency (RF) transmitter, operating in a microwave frequency band, to provide a high power microwave (HPM) signal. For example, in an HPM system based on a high-power RF source, electromagnetic radiation is extracted from the RF source using a waveguide. At least some HPM systems are RF systems that can include generation of high peak power bursts of narrowband (coherent) electromagnetic radiation, which are configured to span a frequency range of approximately 1 GHz to 100 GHz. A further version of HPM deals with ultra-wideband electromagnetic radiation, where the output frequency of the devices can range over many decades in frequency, from 10's MHz to 10's GHz. One use area that is driving an interest in HPM technology is the military, where there has been an interest in developing non-lethal directed energy weapons (DEW) systems for electronic attack and/or electronic defense, where these systems use HPM technology to generate beams of energy for offensive and/or defensive use. Directed Energy Weapons (DEWs) are electromagnetic systems capable of converting chemical or electrical energy to radiated energy and focusing it on a target, resulting in physical damage that degrades, neutralizes, defeats, or destroys an adversarial capability. An exemplary directed-energy weapon (DEW) system includes a ranged weapon that damages or renders inoperable its target with highly focused energy, instead of using a solid projectile, where the energy can come from sources that may include lasers, microwaves, particle beams, chemical reactions, and/or sound beams. DEW can be used for both destructive and nondestructive purposes, depending on the power of the weapon and for which purpose it is used.

At least some DEW systems seek to implement HPM technology that uses peak power narrowband sources, with peak output powers on the order of 1 GW at frequencies on the order of 1 GHz in pulse durations as long as possible. DEW systems (which also may include high-energy laser (HEL) as well as HPM) are being considered for a variety of military applications with respect to a variety of platforms, e.g., spaceborne, airborne and land-based systems to name a few. Possible applications of DEW technology include, but are not limited to, weapons that target personnel, missiles, vehicles, and optical devices, where a high energy beam (e.g., microwave, laser, or other high energy sources) is used to damage or prosecute a target.

SUMMARY

The following presents a simplified summary in order to provide a basic understanding of one or more aspects of the embodiments described herein. This summary is not an extensive overview of all of the possible embodiments and is neither intended to identify key or critical elements of the embodiments, nor to delineate the scope thereof. Rather, the primary purpose of the summary is to present some concepts of the embodiments described herein in a simplified form as a prelude to the more detailed description that is presented later.

FIG. 1 is an illustrative block diagram of an exemplary prior art HPM system 100 that is usable as part of a DEW system. Pulsed power 102 is used to energize a high power microwave source 104. The pulsed power 102 includes a power supply 116 and a pulse generator 118, where the pulsed power 102, in an example embodiment, is configured to deliver electrical pulses on the order of one MVolt at a pulse duration of less than 1 μs. The high power microwave source 104 is implemented using either an impulsive source 106 (e.g., charging antenna, transmission line, tuned circuit, ultra-wideband source, etc.) or a linear beam source 108 (e.g., magnetron, traveling wave tube (TWT), klystron, cross field amplifier (CFA), gyrotron, etc.), as is understood in the art. One or more microwave components 110 (e.g., horns, feeds, etc.) are used to transduce the microwave radiation into signals that can be coupled to the antenna 112.

The antenna 112, which advantageously is a high gain directional antenna system, is configured to focus and concentrate the microwave energy into a beam 113 of a desired size and radiation pattern, in a desired direction, as will be understood. In a lower frequency system, an exemplary beamwidth for the beam 113 is about 7°. For example, narrow band HPM is configured to radiate all microwave energy within few percent of a center frequency, which can be advantageous on certain types of targets, especially where target characteristics (such as material and RF absorption) are known. Ultra-Wide band HPM, in contrast, is configured to radiate energy over a range of hundreds of MHz to several GHz, which can be more advantageous on a wider range of targets, where less is known about the target, although range may be shorter because of lower radiated power as compared to narrow band HPM.

FIG. 2 is an exemplary prior art tactical HPM system, in this example the Raytheon Phaser HPM system 200, which is configured to be mounted on a wheeled shelter 202. The antenna for this system includes two beam-steering reflectors: an elevation reflector 204 and an azimuth reflector 206, that are coupled to a prior art turret 210 which can rotate the elevation reflector 204 and azimuth reflector. The elevation reflector 204 is coupled to a support arm 208 that supports the elevation reflector 204 during rotation. Within the wheeled shelter 202 (also known as a transportainer), but not visible in FIG. 2, are the basic HPM system components (e.g., as shown in FIG. 1) that provide the signals for radiation by the antennas of the Phaser system.

DEW systems, especially HPM DEW systems, can have a number of advantages. For example, they can provide a quiet and invisible means of immobilizing and/or destroying targets, because radiation is invisible and has no sound. DEW weapons do not release harmful chemicals or particles, which can make them safer to use in certain environments. Because some types of DEW weapons (e.g., laser and HPM) operate at the speed of light, they can perform faster than some other types of weapons. HPM weapons also can be less susceptible to atmospheric or environmental concerns, because atmospheric correction generally is not an issue with microwave RF frequencies, so target tracking does not have to be as precise to provide atmospheric compensation, precise focus and precise engagement.

Also, DEW systems such as HPM systems can provide a magazine depth and magazine cost advantage over convention kinetic types of weapons. Kinetic weapons can have a cost per shot that can be multiple millions for a single munition, but many HPM systems are implemented to have a significantly lower cost-per-shot than kinetic weapons. In addition, as is understood, kinetic weapons have fixed magazine sizes and must be physically reloaded. In contrast, in a physical sense, it is possible for an HPM type of DEW system to have an unlimited magazine, which is more advantageous in tactical situations. Moreover, HPM systems can potentially operate in a less than lethal manner, unlike kinetic weapons, so HPM systems may be able to disable certain types of targets (e.g., aircraft, vehicles) without directly harming the occupants inside.

HPM weapons potentially offer better potential to counter certain types of operational challenges such as drone swarms, or other situations with multiple targets to be engaged, in comparison with other types of DEW systems, such as laser DEW systems. A further advantage is that DEW systems also can be more inexpensive than conventional weapons to build and maintain. Additionally, some DEW systems may be easier to operate in congested environments, such as dense urban environments, where it may be more challenging to have safe and effective use of more conventional (e.g., kinetic, explosive, chemical) weapons systems.

However, HPM DEW systems can present challenges, as well. For example, some DEW systems are implemented using HPM antennas that are made up of multiple reflectors (e.g., the prior art HPM DEW system of FIG. 2). To maximize antenna gain and efficiency (and thus increase range and/or power of the HPM DEW system), the reflectors may have to be to be large and precisely shaped and spaced, which can make transportation and/or setup of the HPM difficult and time consuming. For example, some existing HPM weapon systems may have large reflectors that require dis-assembly for transport and also require re-assembly and complex alignments in the field taking days or weeks which is not desirable for a tactical weapon system. In addition, some existing HPM systems can be inefficient (having significant spillover radiation off target) and are able to operate only at a single frequency, versus having the flexibility to operate at a single frequency. Operating at multiple frequencies, however, may require increased size and complexity in the HPM system, as is understood. Further, accurate beam aiming is very important, but very challenging, in HPM systems, especially with high frequency systems, such as in at least some embodiments discussed herein, where a beamwidth of the beam 113 (FIG. 1) may be less than 1°. However, wielding the large reflectors needed to accomplish accurate aiming can be more challenging with HPM types of DEW systems than with other types of DEW (e.g., rotating a relatively small laser signal).

In addition, at least some existing HPM weapon systems have not been able to take advantage of all optics techniques to improve aperture efficiency. As is known in the art, reflector antennas are antennas that are designed to reflect the incident electromagnetic waves originating from a separate source and are designed to operate at high microwave frequencies. One reflector antenna type that is used in prior art systems such as that of FIG. 2 is a dual-reflector antenna, which consists of two steering reflectors, which in the example of FIG. 2 are both planar (i.e., non-focusing). The system of FIG. 2 has an axisymmetric Cassegrain reflector assembly inside the wheeled shelter 202 (transportainer) that focuses a beam that is statically-aimed vertically upward. In this example system of FIG. 2, the sub-reflector of the Cassegrain reflector assembly is not hyperbolic and the main-reflector of the Cassegrain reflector is not parabolic.

Pairs of reflectors have sometimes been used as part of shaped reflector designs. However, prior use of shaped reflector design for power-density redistribution, in pursuit of high aperture efficiency, has required that there be a fixed aspect between main and sub reflectors forming a shaped reflector pair, which is preferred for optimum performance. Such shaped reflector pairs can present challenges in beam steering, because rotating either reflector in a shaped-reflector pair can catastrophically destroy the phase delay relationship between reflectors. In addition, during actual deployment and use, the setup and breakdown of the shaped reflectors can be extremely time consuming (e.g., on the order of days and weeks) to ensure the appropriate fixed aspect is maintained, which is impractical in at least some tactical environments. These and other sometimes rigid limitations have precluded shaped reflectors from being used with beam steering reflectors that can be readily stowed for ground mobility and air transport.

It would be advantageous to develop and provide an HPM weapons system that includes specific optics, mechanisms, and designs to maximize antenna gain and efficiency while still enabling ready transportability and stowability (advantageously automatic stowability) along with lessening time for setup and deployment. It would be advantageous to develop and provide an HPM weapons system that can leverage the advantages of shaped reflector optics while still providing for assembly, setup, and transport, which works within the size and time constraints of challenging applications, such as military environments. It would be advantageous to be able to provide a high power microwave weapon system capable of being configured for multiple frequencies, because known arrangements are for single frequency systems which do not require the added size and complexity that can be needed for multi-frequency systems.

At least some embodiments herein help to address at least some of these challenges.

In one embodiment, an antenna system, comprising a reflector subsystem, a rotatable support structure, a first support member, and a second support member. The reflector subsystem is configured to receive an input beam and to reflect the input beam to produce an output beam towards at least one target, the reflector subsystem comprising an elevation reflector having a first range of motion and configured for steering the input beam in elevation and an azimuth reflector having a second range of motion and configured for steering the input beam in azimuth, wherein the output beam is steered in elevation and azimuth towards the target. The rotatable support structure is operably coupled to the azimuth reflector and to the elevation reflector and is configured to rotate the elevation reflector and the azimuth reflector simultaneously. The first support member comprises a lengthwise portion coupled to the rotatable support structure and an offset portion coupled to the elevation reflector, the offset portion configured to offset the elevation reflector from the lengthwise portion. The second support member has a first end coupled to the rotatable support structure and a second end coupled to the azimuth reflector. During a beam steering of the output beam, the offset portion is configured to enable clearance of the elevation reflector during beam steering of the output beam to extreme ends of the first range of motion of the elevation reflector.

In some embodiments, the input beam comprises an axisymmetric beam having uniform power density distribution. In some embodiments, the first range of motion comprises a range of angles of approximately −5° to +95°. In some embodiments, the elevation reflector is configured to have a deployed position and a stowed position and wherein, in the stowed position, the offset portion of the first support member is configured to position an elevation reflector steering drive next to the lengthwise portion of the first support member, wherein, in the stowed position, a positioning of the elevation reflector is configured to minimize a stowed height of the elevation reflector.

In some embodiments, the antenna system further comprises a linear actuator configured to raise the elevation reflector to a deployed position and to lower the elevation reflector to a stowed position. In further embodiments, the antenna system further comprises an elevation steering head tilt actuator operably coupled to the elevation reflector and to the rotatable support structure, the elevation steering head tilt actuator configured to cooperate with the linear actuator to produce motion of the elevation reflector that is configured to stow the elevation reflector in a horizontal position.

In some embodiments, the antenna stem of claim further comprises an elevation beam steering drive operably coupled to the elevation reflector and to the rotatable support structure, the elevation beam steering drive configured to rotate the elevation reflector about an elevation rotational axis when the elevation reflector is in a deployed position.

In some embodiments the antenna system further comprises a single degree of freedom canted rotary drive operably coupled to the second support member and configured to rotate the second support member along a first end of the second support member, to position the azimuth reflector coupled to the second end into a stowed position and into a deployed position, wherein the stowed position of the azimuth reflector is configured to minimize a stowed height of the azimuth reflector. In further embodiments, the antenna system further comprises an elevation beam steering drive operably coupled to the elevation reflector and to the rotatable support structure, wherein: the elevation beam steering drive is configured to rotate the elevation reflector about an elevation rotational axis when the elevation reflector is in its deployed position, wherein, when the azimuth reflector is in its deployed position; the rotatable support structure is configured to rotate the azimuth reflector about an azimuth rotational axis; and when the elevation reflector and the azimuth reflector are both deployed and the input beam is received, the elevation beam steering drive and the rotatable support structure are configured to cooperate to enable the antenna system to direct its output beam to any point in a full hemispherical sky dome. In further embodiments, the input beam comprises a high power microwave signal, the elevation reflector is configured to have a first deployed position and a first stowed position; in the first stowed position of the elevation reflector, the offset portion of the first support member is configured to position the elevation reflector next to the lengthwise portion of the first support member; and in the first stowed position of the elevation reflector, a positioning of the elevation reflector is configured to minimize a stowed height of the elevation reflector.

In some embodiments, the input beam comprises a high power microwave (HPM) signal and the output beam that is steered towards the target is configured to direct HPM energy towards the at least one target as part of a directed energy weapon (DEW) system. In some embodiments, the antenna system is in operable communication with a control subsystem that is configured to receive information about the at least one target and that is configured to automatically control, based on the information about the at least one target; at least one of: a characteristic of the input beam; a position of the rotatable support structure; a position of the elevation reflector; and a position of the azimuth reflector.

In some embodiments, the input beam comprises a high power microwave (HPM) input beam, the antenna system is sized for operation with the HPM input beam, and the rotatable support structure is operably coupled to a movable structure, wherein the movable structure is configured with a recessed region sized to receive the elevation reflector and the first support member when the elevation reflector and the first support member are in a first stowed position. In further embodiments, the antenna system has a first height when the elevation reflector is in the first stowed position and the azimuth reflector is in a second stowed position; the movable structure has a second height; and the combination of the first height and the second height corresponds to an overall height that is sized to fit within a C-17 aircraft. In further embodiments, the movable structure comprises a beam generation subsystem configured to generate the HPM input beam for the antenna system.

In another aspect, a method of directing a high power microwave (HPM) beam to a target is provided. A reflector subsystem is configured to receive a high power microwave (HPM) input beam and to reflect the HPM input beam to produce an HPM output beam towards at least one target, the reflector subsystem comprising an elevation reflector having a first range of motion and configured for steering the input beam in elevation and an azimuth reflector having a second range of motion and configured for steering the input beam in azimuth, wherein the HPM output beam is steered in elevation and azimuth towards the target. A rotatable support structure is operably coupled to the azimuth reflector and to the elevation reflector. The rotatable support structure is configured to rotate the elevation reflector and the azimuth reflector simultaneously. The elevation reflector is coupled to the rotatable support structure via a first support member comprising a lengthwise portion coupled to the rotatable support structure and an offset portion coupled to the elevation reflector, the offset portion configured to offset the elevation reflector from the lengthwise portion. A first end of a second support member is coupled to the rotatable support structure and a second end of the second support member to the azimuth reflector, The HPM output beam is steered towards the target, wherein, during the beam steering, the offset portion is configured to enable clearance of the elevation reflector during the beam steering of the HPM output beam to extreme ends of the first range of motion of the elevation reflector.

In some embodiments, the method further includes receiving information about the at least one target and automatically controlling, based on the information about the at least one target, at least one of: a characteristic of the input beam; a position of the rotatable support structure; a position of the elevation reflector; and a position of the azimuth reflector.

In another aspect, a method of stowing a reflector in a high power microwave (HPM) antenna system is provided. A reflector subsystem is configured to receive a high power microwave (HPM) input beam and to reflect the HPM input beam to produce an HPM output beam towards at least one target, the reflector subsystem comprising an elevation reflector having a first range of motion and configured for steering the input beam in elevation and an azimuth reflector having a second range of motion and configured for steering the input beam in azimuth, wherein the HPM output beam is steered in elevation and azimuth towards the target. A rotatable support structure is operably coupled to the azimuth reflector and to the elevation reflector. The rotatable support structure is configured to rotate the elevation reflector and the azimuth reflector simultaneously. The elevation reflector is coupled to the rotatable support structure via a first support member comprising a lengthwise portion coupled to the rotatable support structure and an offset portion coupled to the elevation reflector, the offset portion configured to offset the elevation reflector from the lengthwise portion. A first end of a second support member is coupled to the rotatable support structure and a second end of the second support member to the azimuth reflector. The elevation reflector is configured to have a first deployed position and a first stowed position and wherein, in the first stowed position, the offset portion of the first support member is configured to position the elevation reflector next to the lengthwise portion of the first support member, wherein a positioning of the elevation reflector, in the first stowed position, is configured to minimize a stowed height of the elevation reflector.

In some embodiments, the method further comprises operably coupling a single degree of freedom canted rotary drive operably to the second support member, the single degree of freedom canted rotary drive configured to rotate the second support member along a first end of the second support member to position the azimuth reflector coupled to the second end into a second stowed position and into a second deployed position, wherein the second stowed position of the azimuth reflector is configured to minimize a stowed height of the azimuth reflector. In some embodiments, the method further comprises operably coupling the rotatable support structure to a movable structure, wherein the movable structure is configured with a recessed region sized to receive the elevation reflector and the first support member when the elevation reflector and the first support member are in the first stowed position.

It should be appreciated that individual elements of different embodiments described herein may be combined to form other embodiments not specifically set forth above. Various elements, which are described in the context of a single embodiment, may also be provided separately or in any suitable sub-combination. It should also be appreciated that other embodiments not specifically described herein are also within the scope of the claims included herein.

Details relating to these and other embodiments are described more fully herein.

BRIEF DESCRIPTION OF THE DRAWINGS

The advantages and aspects of the described embodiments, as well as the embodiments themselves, will be more fully understood in conjunction with the following detailed description and accompanying drawings, in which.

The drawings are not to scale, emphasis instead being on illustrating the principles and features of the disclosed embodiments. In addition, in the drawings, like reference numbers indicate like elements.

DETAILED DESCRIPTION

Figure 1:
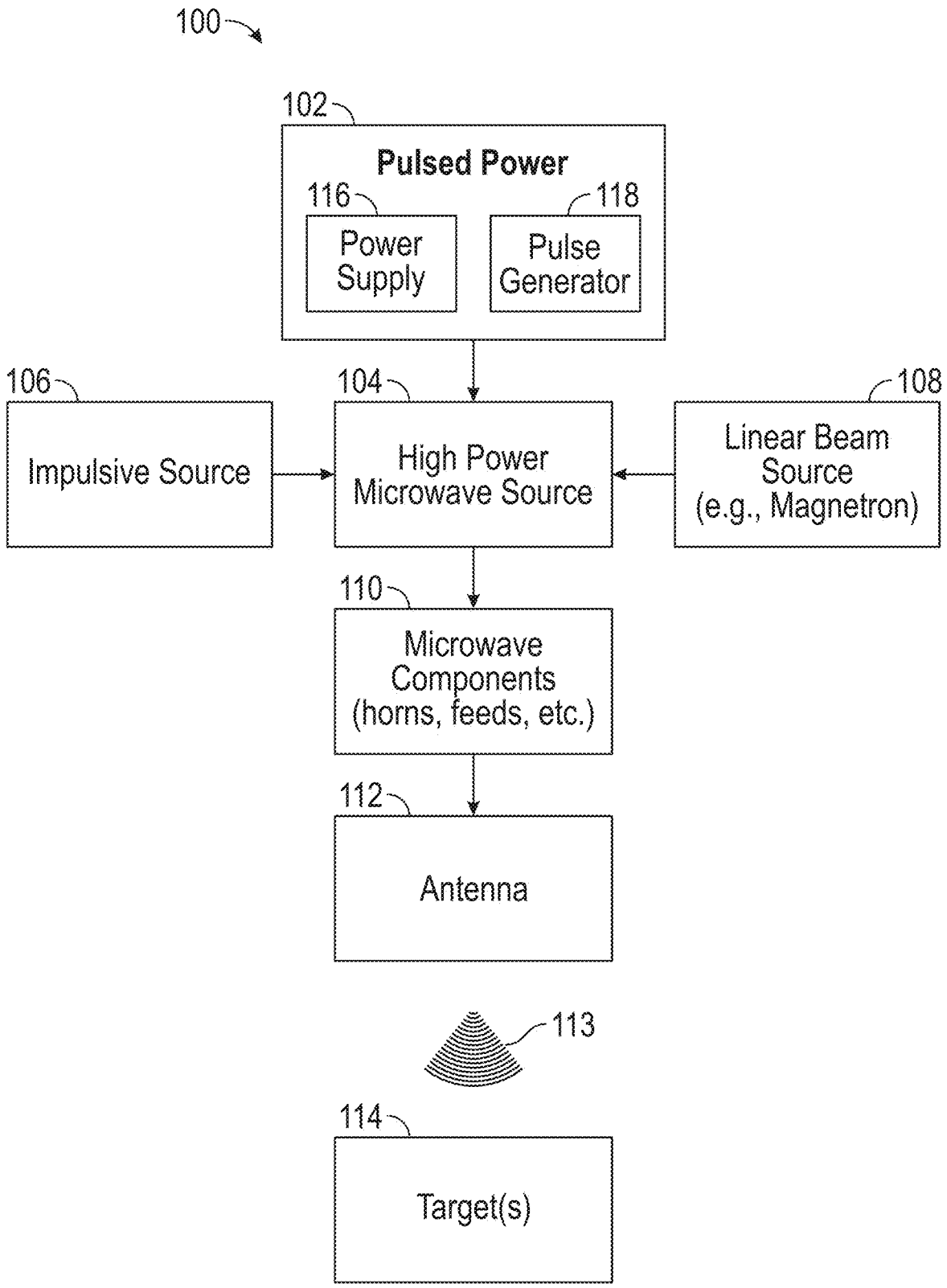
FIG. 1 (Prior Art)
FIG. 1 is a simplified block diagram of a prior high-power microwave (HPM) system.
Figure 2:
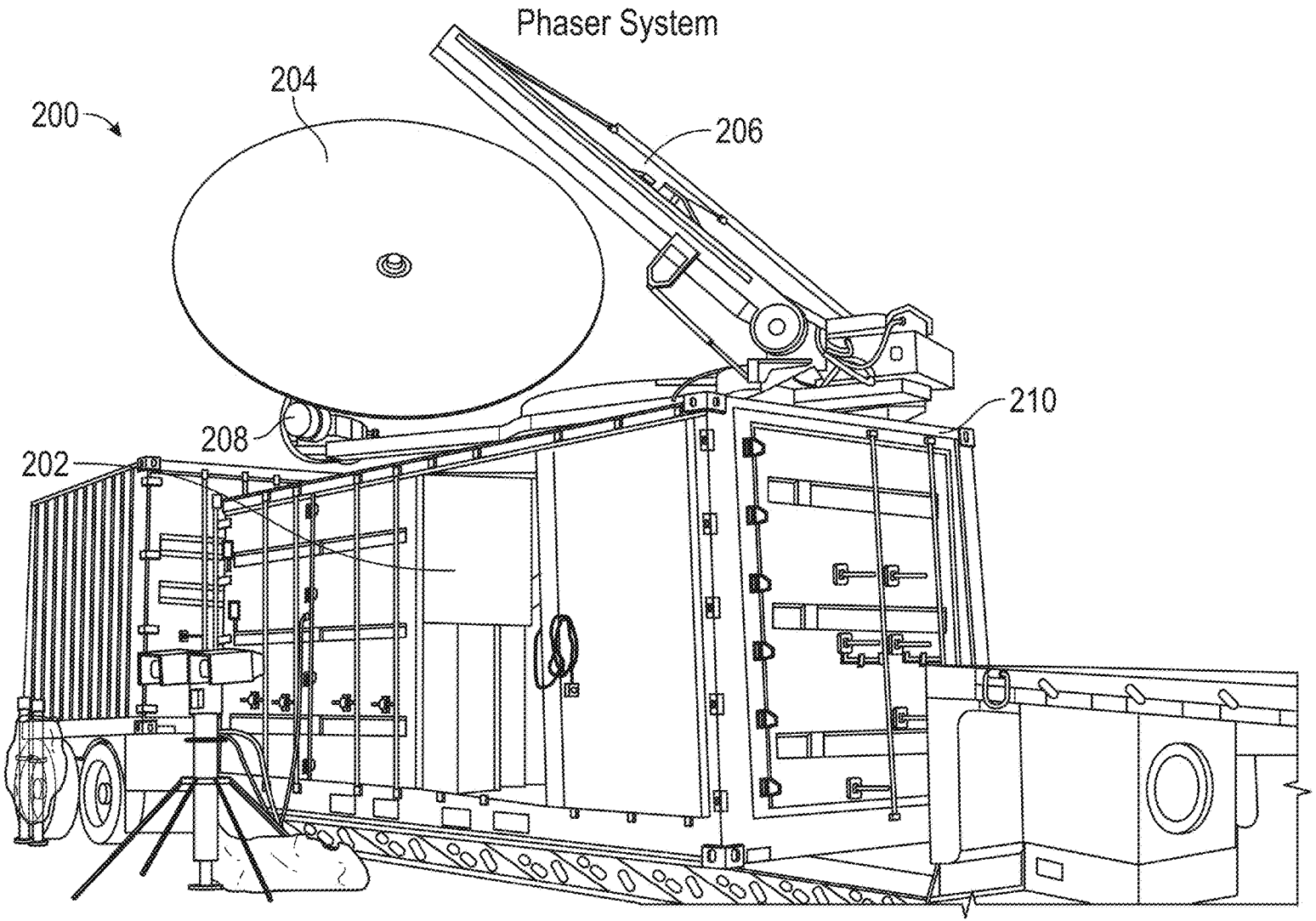
FIG. 2 (Prior Art)
FIG. 2 is an exemplary illustration of a prior art tactical HPM system.

Before describing details of the particular systems, devices, and methods, it should be observed that the concepts disclosed herein include but are not limited to a novel structural combination of components and circuits, and not necessarily to the particular detailed configurations thereof. Accordingly, the structure, methods, functions, control and arrangement of components and circuits have, for the most part, been illustrated in the drawings by readily understandable and simplified block representations and schematic diagrams, in order not to obscure the disclosure with structural details which will be readily apparent to those skilled in the art having the benefit of the description herein.

In addition, the following detailed description is provided, in at least some examples, using the specific context of target detection systems (e.g., radar systems) configured to detect, track, monitor, and/or identify targets, where targets can include (but are not limited to) aircraft (both unmanned and manned), unmanned aerial vehicles, unmanned autonomous vehicles, robots, ships, spacecraft, automotive vehicles, and astronomical bodies, or even birds, insects, and rain. At least some embodiments herein are usable with any systems involved with any radar applications, including but not limited to military radars, air traffic control radars, weather monitoring radars, etc. Those of skill in the art will appreciate that the embodiments described herein are applicable to many types of systems as well, including but not limited to wireless communications of all kinds, satellite systems, optical systems, any high power microwave systems that that require ground and/or air transportation, high gain satellite communications, and any tactical or defense application where infinite magazine size is advantageous.

In addition, it is noted that various connections are set forth between elements in the following description and in the drawings. These connections in general and, unless specified otherwise, may be direct or indirect, and this specification is not intended to be limiting in this respect. In this disclosure, a coupling between entities may refer to either a direct or an indirect connection. It should be understood that throughout the drawings, corresponding reference numerals indicate like or corresponding parts and features. As used herein, the term module, unit and/or element can be formed as processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

Additionally, use of the term "signal" in conjunction with this disclosure is not limited to analog and/or digital signals but rather is meant to denote as well (1) the mathematical description of any measurable phenomena in nature or in human-made systems and (2) the mathematically described function of one or more variable depending on one or more parameters. Examples of types of signals which are encompassed in the embodiments described herein include, but are not limited to, light intensity, voltage, pressure, electromagnetic radiation (including radio waves), magnetic field strength and electric field strength.

Embodiments of this disclosure include configurations of an HPM system that includes specific optics, mechanisms, and designs to maximize antenna gain and efficiency while still enabling ready transportability and stowability along with lessening time for setup and deployment. The shaped reflector optics in at least some embodiments herein is configured to maximize antenna efficiency while minimizing energy spillover. In addition, the embodiments herein help to minimize the stowed volume of an HPM antenna to enable transport on an aircraft, such as a military cargo transport aircraft.

Figure 3:
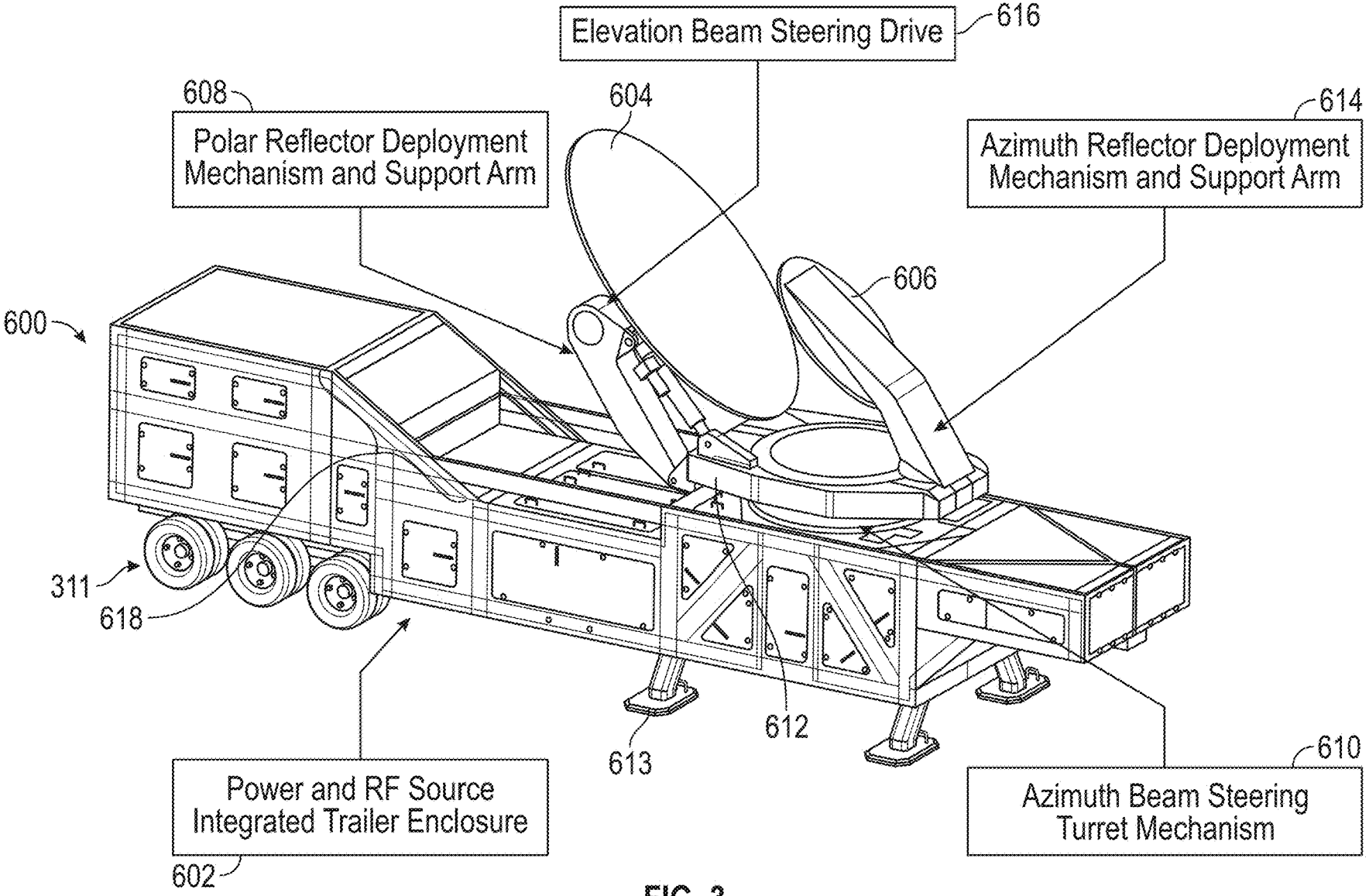
FIG. 3 is an illustration of a first embodiment of tactical HPM system, including supporting pedestal mechanism, in accordance with one embodiment.
Figure 6:
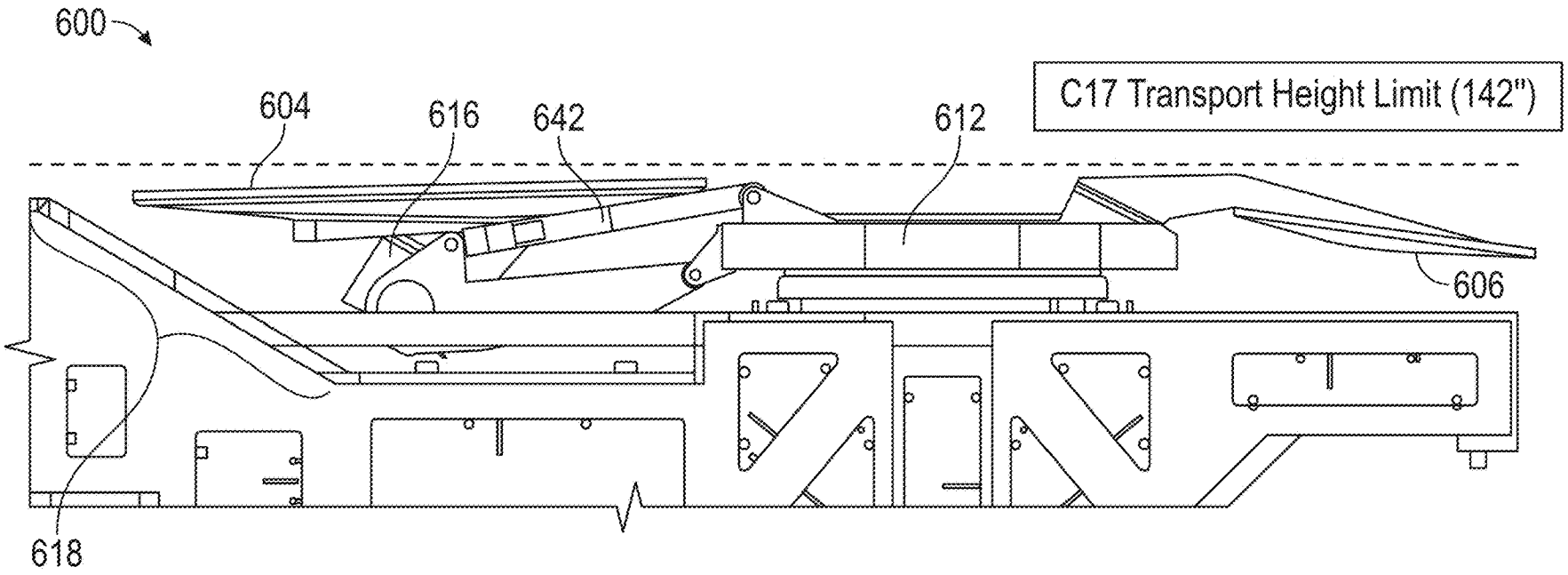
FIG. 6 is a side view of the assembly of FIGS. 3 and 4, in a stowed position, in accordance with one embodiment.

FIG. 3 is an illustration of a first embodiment of a tactical HPM system 600, including a supporting pedestal mechanism, in accordance with one embodiment. The tactical HPM system 600 includes a power and RF source integrated trailer enclosure 602 (hereinafter "trailer enclosure 602"), which houses the internal antenna system components (discussed further herein in connection with FIGS. 7-9). The trailer enclosure 602 is merely exemplary and any movable enclosure is usable in at least some embodiments. The trailer enclosure 602, in the deployed position of FIG. 3, is supported by both the wheels 311 and a plurality of retractable outriggers 613 (which serve as support legs). In addition, the trailer enclosure 602 includes a sloped edge portion 618 which is constructed and arranged to provide an area to receive the elevation/polar reflector 604 and polar reflector deployment mechanism and elevation/polar support arm 608 when they are stowed, as shown further in FIG. 6, which is discussed further herein. In certain embodiments, the sloped edge portion 618 of the trailer enclosure 602 is part of a recessed region 603 (best seen in FIG. 12G) in the top/mounting side of the trailer enclosure 602, where in the recessed region 603 provides space for the elevation/polar reflector 604 and its elevation/polar support arm 608 to "nest" into during times when the elevation/polar reflector 604 is stowed. In certain embodiments, it is not necessary for the recessed region 603 to provide space, as well for the azimuth reflector 606: as FIG. 6 and FIG. 12A through FIG. 12F show, the azimuth support arm 614 of the azimuth reflector 606, in certain embodiments, is able is able to rotate around approximately 180° so that the azimuth reflector 606 is as close as possible to the trailer enclosure 602 (e.g., can be facing "down" as shown in FIG. 6).

The external antenna portion of the system, which is visible in FIG. 3, includes an elevation/polar reflector 604 (also referred to herein simply as either an elevation reflector or a polar reflector) and an azimuth reflector 606 that are each coupled to an azimuth beam steering turret mechanism 610, including being coupled to a rotatable support structure, such as an azimuth turret 612, which itself is operably coupled to the trailer enclosure 602. The elevation/polar reflector 604 is coupled to a polar reflector deployment mechanism and corresponding supporting member, such as an elevation/polar support arm 608, wherein the deployment mechanism (which in certain embodiments is an elevation/polar mechanical subsystem 742, as discussed further herein in connection with FIG. 8) and the elevation/polar support arm 608 together are is configured to elevate the elevation/polar reflector 604 into an active position; this arrangement is discussed further in connection with FIG. 4, herein, as well as FIGS. 12A-13H, also discussed further herein. In certain embodiments, the polar reflector deployment mechanism and elevation/polar support arm 608 also includes an elevation beam steering drive 616.

Figure 4:
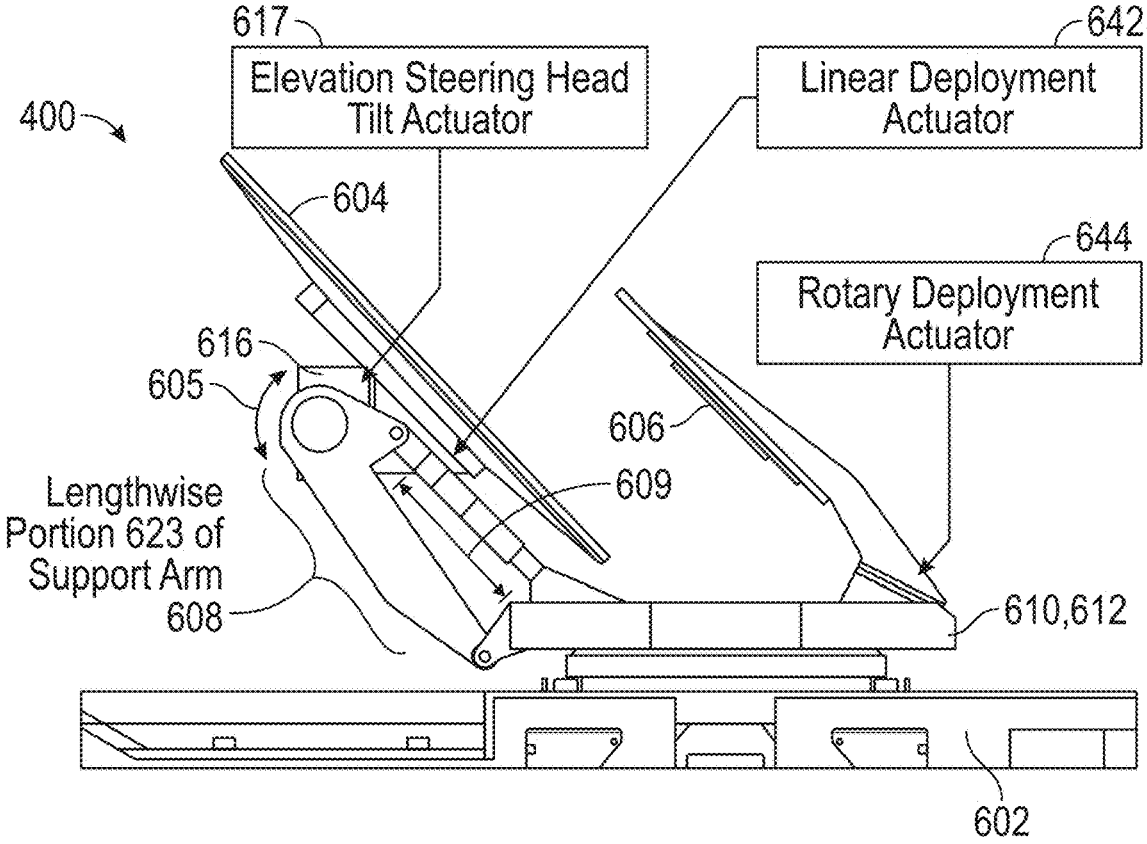
FIG. 4 is a side view of one embodiment of an assembly of the tactical HPM system of FIG. 3, in accordance with one embodiment.

The azimuth reflector 606 is operably coupled to an azimuth reflector deployment mechanism and azimuth support arm 614; this arrangement also is discussed further in connection with FIG. 4, herein. In certain embodiments, the azimuth reflector 606 is coupled to a respective support member, such as azimuth support arm 614, where the support member is further coupled to a rotatable support structure (e.g., the azimuth turret 612). In certain embodiments, the elevation/polar reflector deployment mechanism and elevation/polar support arm 608, and the azimuth reflector deployment mechanism and azimuth support arm 614 are each operably coupled to the azimuth beam steering turret mechanism 610 and/or to the azimuth turret 612.

In certain embodiments, the azimuth turret 612 is operably coupled to and serves as a rotatable support structure for an elevation/polar mechanical control subsystem 742 (discussed further herein in connection with FIG. 8), where the elevation/polar mechanical control subsystem 742 at least includes an elevation/polar support arm 608 that includes a lengthwise portion 623 and an offset portion 621 and is operably coupled to the elevation/polar reflector 604, such that the azimuth turret 612 also serves as at least an indirect rotatable support structure for the elevation/polar reflector 604. As shown and discussed further in connection with FIG. 8, the elevation/polar mechanical control subsystem 742 also, in certain embodiments, includes a drive and several actuators that are configured to more specifically control movement and/or rotation of the elevation/polar reflector 604.

Similarly, the azimuth turret 612, is operably coupled to and serves as a rotatable support structure for an azimuth mechanical control subsystem 744 (discussed further herein in connection with FIG. 8), where the azimuth mechanical control subsystem 744 at least includes an azimuth support member (e.g., azimuth support arm 614) that is operably coupled to both the rotatable support structure and to the azimuth reflector 606, such that the azimuth turret 612 also serves as at least an indirect rotatable support structure for the azimuth reflector 606. As shown and discussed further in connection with FIG. 8, the azimuth mechanical control subsystem 744 also, in certain embodiments, includes a drive and an actuator that are configured to more specifically control movement and/or rotation of the azimuth reflector 606.

In certain embodiments, the azimuth turret 612 also is configured to maintain a desired orientation between the azimuth reflector 606 and the elevation/polar reflector 604 during at least one of operation and stowing. In certain embodiments, the azimuth turret 612 cooperates with the operational functions of one or both of the elevation/polar mechanical control subsystem 742 and the azimuth mechanical control subsystem 744, to help maintain the desired orientation between the elevation/polar reflector 604 and the azimuth reflector 606. In certain embodiments, a support structure for the external antenna system 704 (i.e., the stage of shaped reflector redistribution 704, also referred to herein as shaped reflector redistribution subsystem 704 and/or a reflector subsystem 704) corresponds to the combination of the azimuth turret 612, the polar reflector deployment mechanism and elevation/polar support arm 608, the azimuth reflector deployment mechanism and azimuth support arm 614, and the azimuth beam steering turret mechanism 610.

As will be discussed further herein, mechanical beam steering drives (discussed and illustrated further herein in connection with FIGS. 4, 7, and 8) are configured to simultaneously rotate the azimuth beam steering turret mechanism 610, the azimuth reflector 606, and the elevation/polar reflector 604, to achieve mechanical beam pointing to any point in a full hemispherical sky dome (e.g., to enable the antenna system 704 to direct its output beam 727 to any point in a full hemispherical sky dome). The reflector support arm geometry of the polar reflector deployment mechanism and elevation/polar support arm 608 and the azimuth reflector deployment mechanism and azimuth support arm 614, are configured to provide motion envelope clearance during full range target tracking, while still maintaining required orientation between the azimuth reflector 606 and the elevation/polar reflector 604. As discussed further herein, the elevation/polar reflector 604 support arm geometry and configuration, including an elevation/polar support arm 608 having an offset portion 621, where the offset portion 621 also supports minimizing stowed height of the system 300. In at least some embodiments, as discussed further herein, full elevation beam steering coverage (−5° to +95°) with a large 16'×10' elevation/polar main reflector 604 is achieved by a unique offset portion 621 of the support arm 608 and deployment mechanisms discussed herein (e.g., as shown and discussed in connection with FIG. 15A, FIG. 15B, FIG. 15C, and FIG. 18 herein).

In certain embodiments, the entire structure of the tactical HPM system 600 of FIG. 3 constitutes a tactical HPM antenna system, including a tactical HPM antenna pedestal (which itself at least includes the supporting structures, mechanisms and drives that support the antenna components, such as the trailer enclosure 602, retractable outriggers 613, azimuth turret 612, all support arms (e.g., elevation/polar support arm 608 and azimuth support arm 614) and the drive mechanisms). As can be seen in FIG. 3 and also in FIGS. 6, 11, and 12A herein (which shows the assembly of FIG. 3 in a stowed position) the geometry of the pedestal is optimized to minimize the stowed antenna height and maximize structural rigidity. Maximizing structural rigidity is important and advantageous to enabling the tactical HPM system 600 of FIG. 3 to align the beam extremely rapidly and accurately without vibration, during target tracking motion, as well as provide the requisite stiffness as to maintain beam pointing accuracy in environmental conditions, such as wind.

Figure 11:
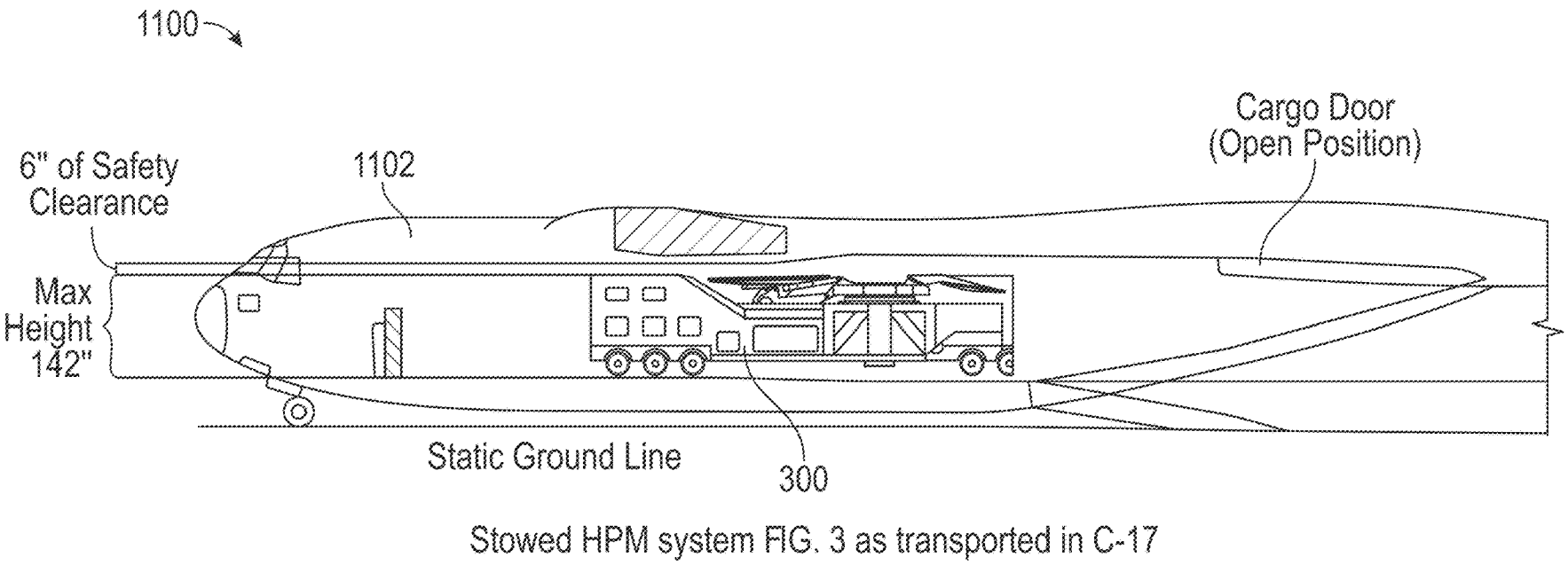
FIG. 11 is an exemplary cross-section view of the tactical HPM system of FIG. 3 in a stowed configuration, coupled to a transportainer vehicle, and stowed in a C-17 cargo aircraft.

In addition, in certain embodiments, a goal for the stowed antenna height is for it to be less than 142 inches for unrestricted C-17 transport (as discussed further herein in connection with FIG. 11). In embodiments where the stowed antenna height exceeded 142 inches, then components (e.g., the elevation/polar reflector 604) would have to be removed for air transport in vehicles such as C-17 aircraft. Those of skill in the art will appreciate that the apparatuses, systems, methods, and designs discussed herein are scalable and applicable to minimize stowed heights of many different types of antennas and/or reflector configurations, as well as many different types of systems.

As illustrated in FIG. 3 and also further shown in FIGS. 6, 11, 12A-14I, 15B, 15C, and 18-20 (discussed further herein), the elevation/polar support arm 608 is, in certain embodiments, configured include a lengthwise portion 623 that is coupled to the azimuth turret 612 and an offset portion 621 that is coupled to both the lengthwise portion 623 and the elevation/polar reflector 604 and is configured the to enable the elevation/polar reflector 604 to be offset from the lengthwise portion 623 of the elevation/polar support arm 608, to allow clearance (e.g., rotation clearance) of the elevation/polar reflector 604 at extreme look angles. The offset portion 621 (see especially, e.g., FIG. 15A, FIG. 15B, FIG. 15C, AND FIG. 18) also helps also to reduce the stowed height, because offsetting the offset portion 621 of the elevation/polar support arm 608 for the elevation/polar reflector 604 enables the elevation steering drive 616 and elevation steering head tilt actuator 617 to be positioned alongside the rest of the elevation/polar support arm 608 (i.e., next to the lengthwise portion 623) during stowing, instead of having to have the elevation/polar reflector 604 be stored on top of the elevation/polar support arm 608, which would increase the stowed height in way that is undesirable if minimizing stowed height is a priority. As will become clear with the discussion herein, the beam steering and deployment mechanisms provided in the tactical HPM system 600 provide a unique combination of rapid (e.g., within minutes versus days) "shoot and move" emplacement capability with large, high gain HPM antenna performance. In addition, as the discussion herein will explain, the shaped reflector optics, of at least some embodiments herein, achieve high efficiency across a predetermined range of beam pointing elevation angles while also controlling RF spillover. In certain embodiments, full elevation beam steering coverage (e.g., predetermined range of beam pointing angles corresponding to −5° to +95°) with a large 16'×10' polar main reflector is achieved by a unique offset support arm and deployment mechanisms (as discussed further herein.).

In addition, the arrangement shown in FIG. 3, including the trailer enclosure 602, the azimuth beam steering turret mechanism 610, the azimuth turret 612, the polar reflector deployment mechanism including the elevation/polar support arm 608, and the azimuth reflector deployment mechanism including the azimuth support arm 614, cooperate to provide a wide structural base for the elevation/polar reflector 604 and/or the azimuth reflector 606 to maintain rigidity in environmental conditions (e.g., wind) and during beam-steering motion (i.e., motion along the azimuth and elevation axes). As will be understood, in at least some embodiments, the trailer enclosure 602 does not move during operation of the external antenna system 704.

Advantageously, the tactical HPM system 600 of FIG. 3, in certain embodiments, provides an HPM Antenna Pedestal arrangement that is configured to minimize stowed volume to allow a very large antenna system to fit inside a cargo aircraft (e.g., C-17) for aircraft transport. Referring briefly to FIG. 6, FIG. 6 is a side view 680 of the assembly of FIGS. 3 and 4, in a stowed position, in accordance with one embodiment. Also referring briefly to FIG. 11, FIG. 11 is an exemplary cross-section view 1100 of the tactical HPM system of FIG. 3 in a stowed configuration, coupled to a transportainer vehicle, and stowed in an exemplary C-17 cargo aircraft 1102. The C-17 cargo aircraft 1102 has an internal height of 148" but requires a minimum of 6" of clearance for safety, meaning that the maximum stowed height to fit in the C-17 cargo aircraft is 142". The unique and advantageous configuration of elevation/polar reflector 604 and azimuth reflector 606, reflectors and their stowing arrangement, including the offset portion 621, along with the custom shaped trailer enclosure 602, help to ensure that the system 300 fits within the 142" limit of the C-17. This is discussed further herein.

Reference is now made briefly to FIG. 6, which is a side view 680 of the assembly of FIG. 3 (and FIG. 4) in a stowed position, in accordance with one embodiment. As FIG. 6 illustrates, the elevation/polar reflector 604 takes advantage of the sloped edge portion 618 of the trailer enclosure 602 for storage, and the azimuth reflector deployment mechanism and azimuth support arm 614 also is configured to position the azimuth reflector 606 downward, so that, in at least some embodiments, the stowed volume meets the C17 transport height limit of 142 inches (11 feet 10 inches), even in embodiments where the deployed height of the elevation/polar reflector 604 and/or the deployed height of the azimuth reflector 606, exceed that 142 inch height limit. For example, in some embodiments, the deployed height of the elevation/polar reflector is 22 feet 7 inches (271 inches), but the advantageous folding arrangement of FIG. 6 still allows the elevation/polar reflector 604 and the azimuth reflector 606, to maintain their required orientation (discussed further herein) yet be folded down enough to meet the height limit. The trailer enclosure 602 itself, along with a transport vehicle (e.g., as shown in FIG. 11 and well understood in the art), are also advantageously sized to fit within a cargo aircraft or other transportation vehicle.

Being able to have this minimized stowed volume is, in certain embodiments, a key feature to enable the tactical HPM system 600 of FIG. 3 to be operable as a true tactical weapon system. As FIG. 6 illustrates, the tactical HPM system 600 of FIG. 3, in its stowed configuration, nests its large external reflectors (i.e., the elevation/polar reflector 604 and the azimuth reflector 606), along with their supporting and deployment mechanisms, into the design of the trailer enclosure 602 for efficient size reduction that supports air, road and sea transport.

Referring now to FIG. 4, FIG. 4 is a side view of one embodiment of an assembly 650 of the tactical HPM system 600 of FIG. 3, in accordance with one embodiment. The side view of FIG. 4 provides more details relating to the mechanisms that are configured to move the elevation/polar reflector 604 and the azimuth reflector 606. As FIG. 4 shows, the deployment mechanisms that cooperate to lift the elevation/polar reflector 604 into an active position include a linear deployment actuator 642, which has motion in the direction 609 as shown and an elevation steering head tilt actuator 617 to rotate the elevation steering head (and elevation/polar reflector 604) in the direction 605. The elevation steering of the beam is accomplished, in certain embodiments, by the elevation beam steering drive 616 that rotates orthogonal to the elevation steering head tilt actuator 617. The linear deployment actuator 642 combined with the elevation steering head tilt actuator 617 (see FIG. 14G), are operable to produce required motion of the elevation/polar reflector 604 to achieve stowed and deployed orientations at the end range of motion of the elevation/polar reflector deployment support arm 608.

Figure 14A:
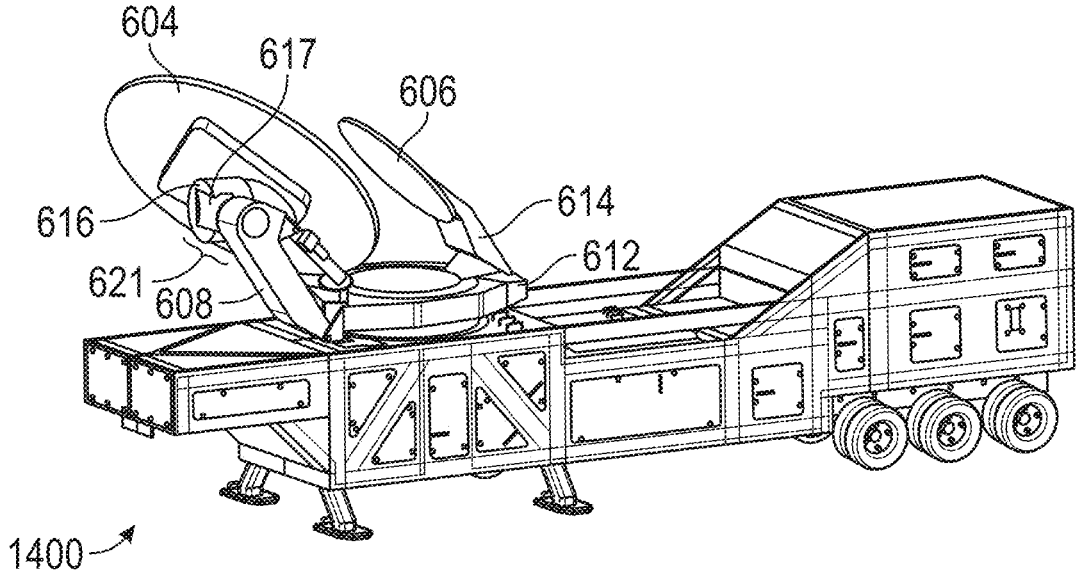
FIG. 14A is an exemplary illustration of the tactical HPM system of FIG. 3 in a ninth deployed position, in accordance with one embodiment.
Figure 14B:
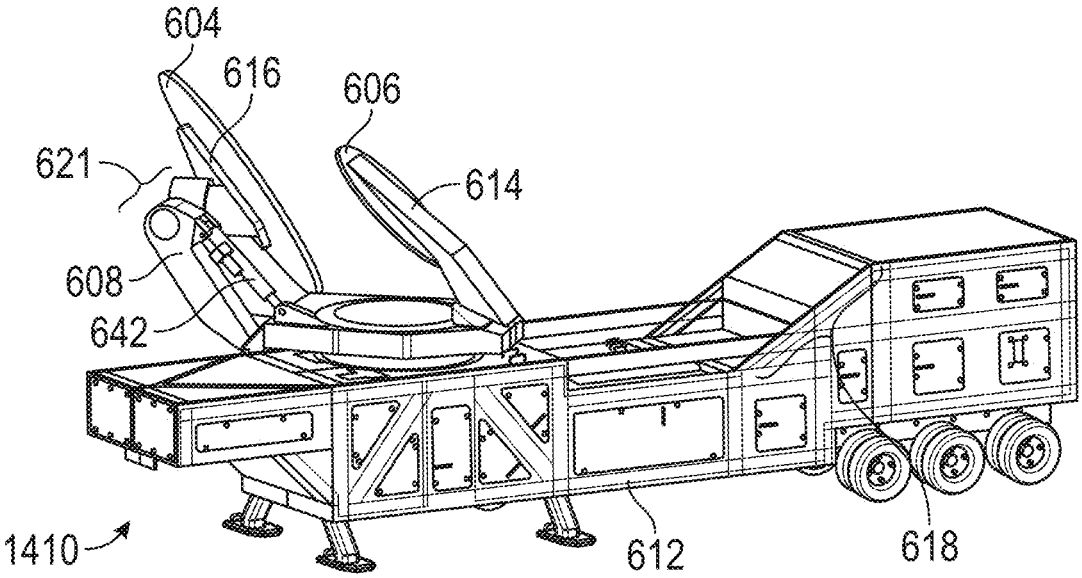
FIG. 14B is an exemplary illustration of the tactical HPM system of FIG. 3 in a tenth deployed position, in accordance with one embodiment.
Figure 14C:
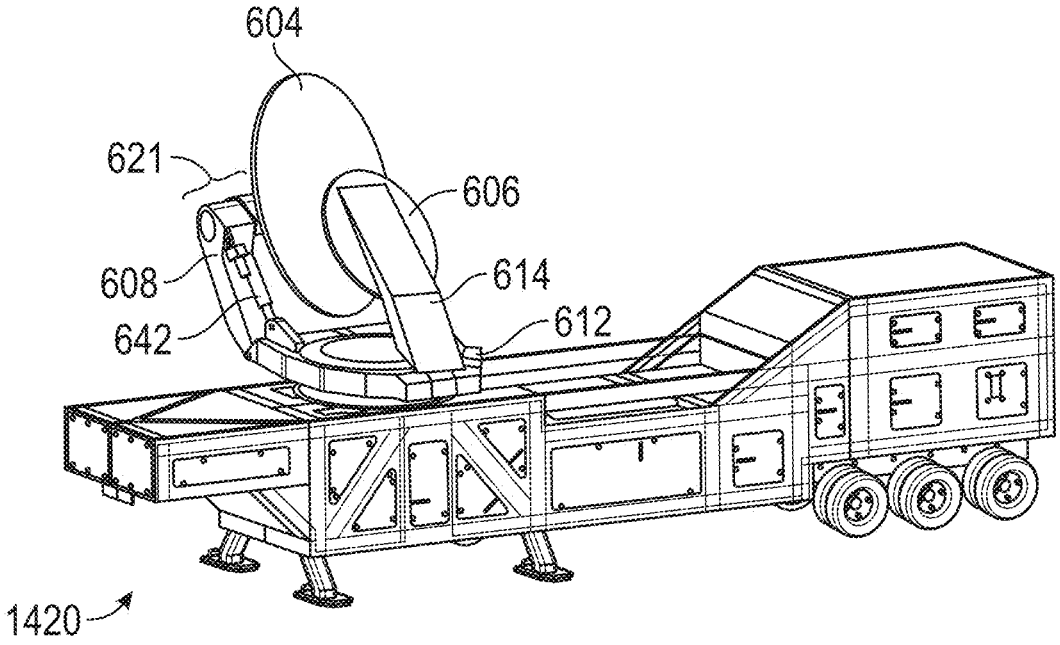
FIG. 14C is an exemplary illustration of the tactical HPM system of FIG. 3 in an eleventh deployed position, in accordance with one embodiment.
Figure 14D:
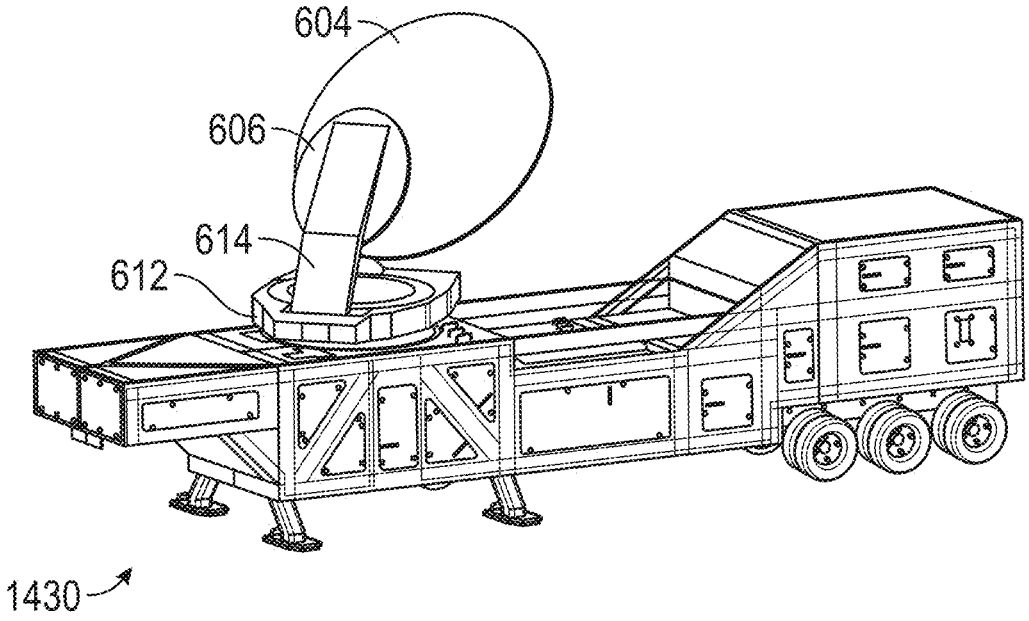
FIG. 14D is an exemplary illustration of the tactical HPM system of FIG. 3 in a twelfth deployed position, in accordance with one embodiment.
Figure 14E:
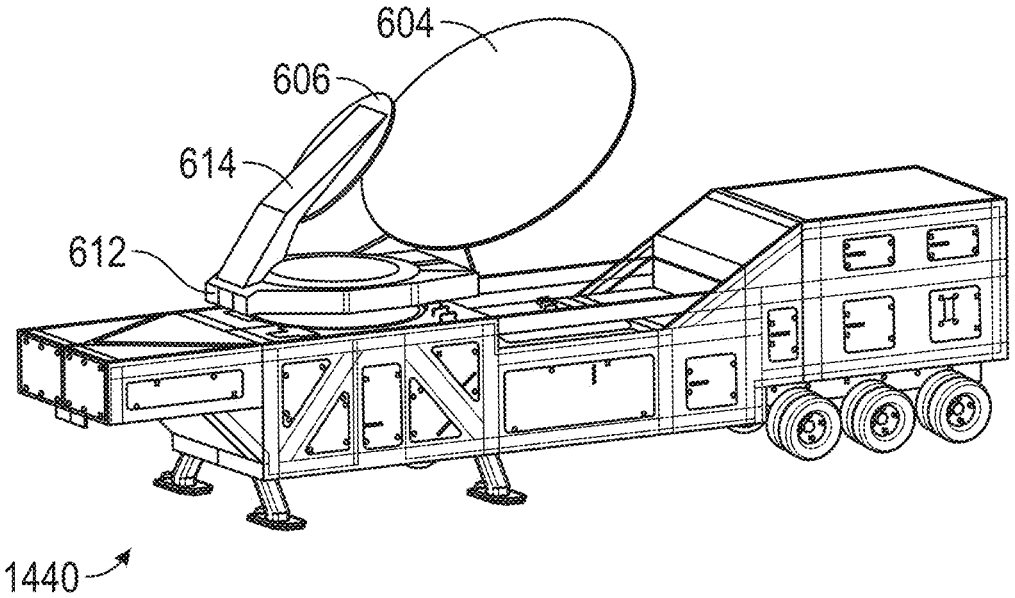
FIG. 14E is an exemplary illustration of the tactical HPM system of FIG. 3 in a thirteenth deployed position, in accordance with one embodiment.
Figure 14F:
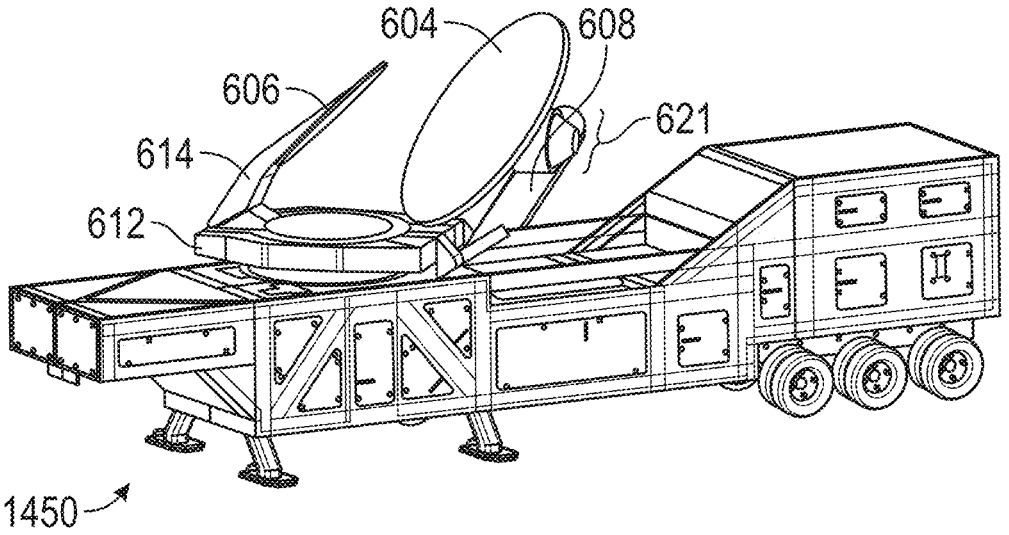
FIG. 14F is an exemplary illustration of the tactical HPM system of FIG. 3 in a fourteenth deployed position, in accordance with one embodiment.
Figure 14G:
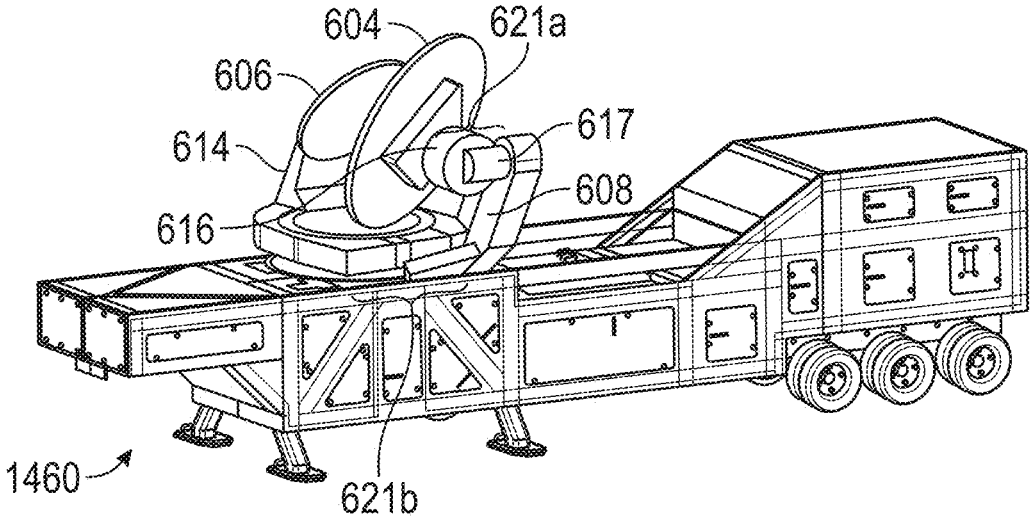
FIG. 14G is an exemplary illustration of the tactical HPM system of FIG. 3 in a fifteenth deployed position, in accordance with one embodiment.
Figure 14H:
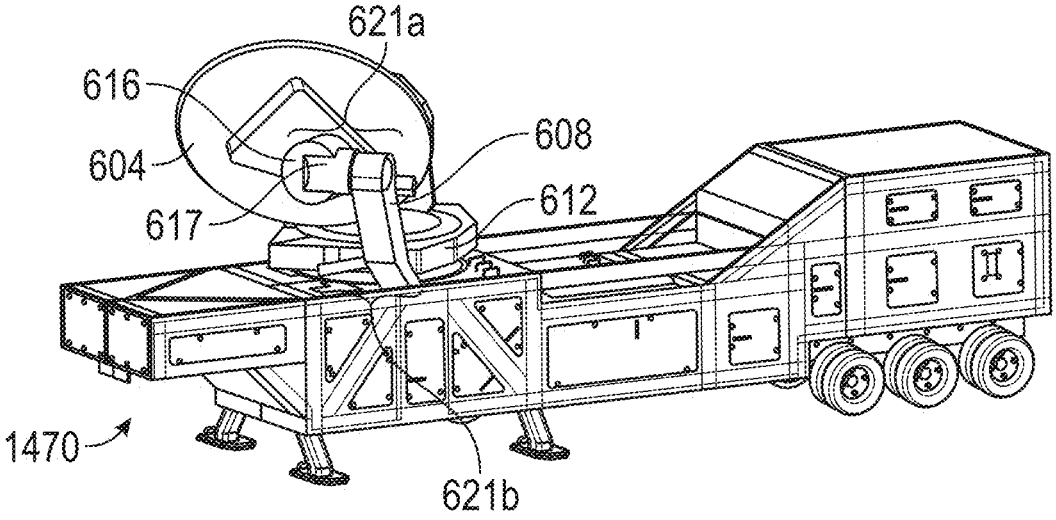
FIG. 14H is an exemplary illustration of the tactical HPM system of FIG. 3 in a sixteenth deployed position, in accordance with one embodiment.
Figure 14I:
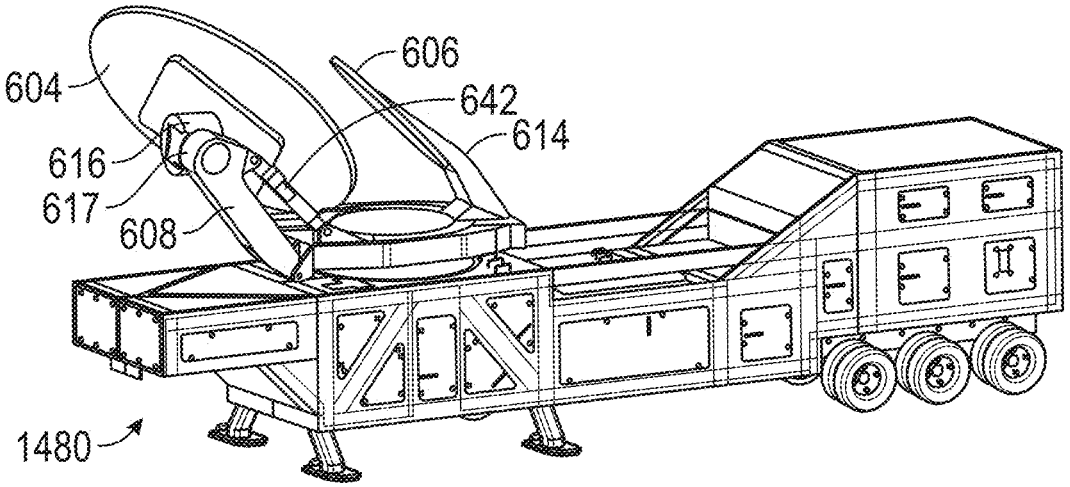
FIG. 14I is an exemplary illustration of the tactical HPM system of FIG. 3 in a seventeenth deployed position, in accordance with one embodiment.

The Elevation Steering Head tilt actuator 617 is not explicitly visible in all figures, but is visible in selected FIGs, such a FIG. 14G, FIG. 14H, and FIG. 14I) is configured, in certain embodiments to provide a specific tilting of the elevation/polar reflector 604 for stowing so the elevation/polar reflector 604 is stowed in a horizontal position at the end of travel. The elevation steering head tilt actuator 617 works in conjunction and simultaneously with the linear deployment actuator 642 of the elevation support arm 608 and in certain embodiments, the Elevation Steering Head tilt actuator 617 is used only to stow and deploy the elevation/polar reflector 604 and its elevation/polar support arm 608. In addition, the combination of linear and rotary actuation provides efficient stiffness characteristics combined with a relatively compact form factor. The deployment mechanism that lifts the azimuth reflector 606 includes the rotary deployment actuator 644, which is discussed further herein in connection with FIG. 8.

The aforementioned mechanical beam steering drives simultaneously rotate the azimuth beam steering turret mechanism 610, azimuth turret 612, azimuth reflector 606, and elevation/polar reflector 604 to achieve mechanical beam pointing to any point in a full hemispherical sky dome. Reference is now made to FIGS. 12A-12L, FIGS. 13A-13F, and FIGS. 14A-14I, discussed further below, which show motion of the elevation/polar reflector 604 and the azimuth reflector 606, via the azimuth turret 612 and azimuth beam steering turret mechanism 610.

Figure 12A:
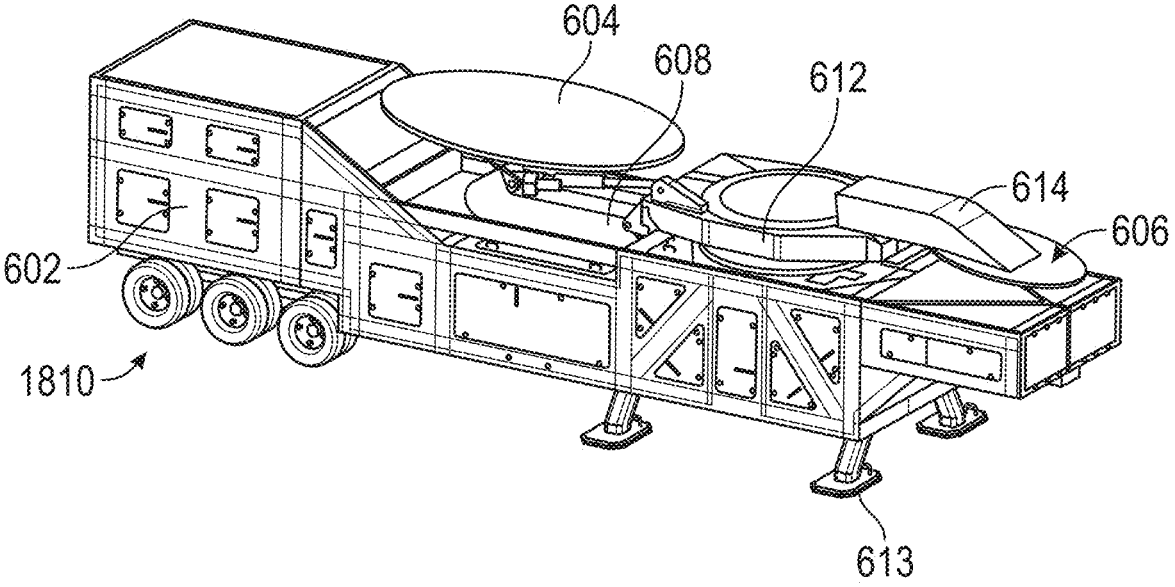
FIG. 12A is an exemplary illustration of the tactical HPM system of FIG. 3 with both reflectors in a stowed position, in accordance with one embodiment.
Figure 12B:
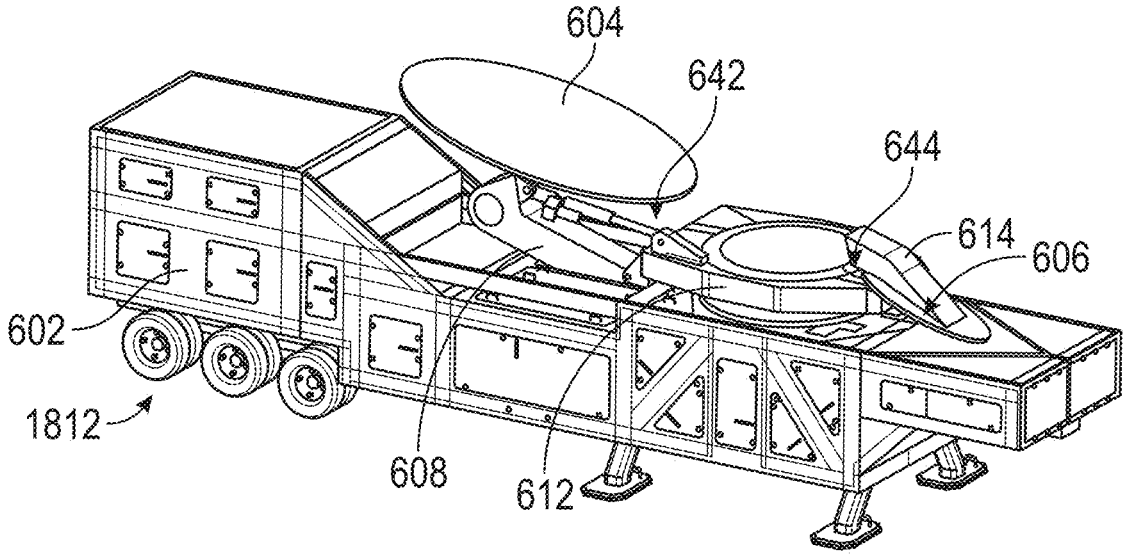
FIG. 12B is an exemplary illustration of the tactical HPM system of FIG. 3 in a first position, in accordance with one embodiment.

For example, FIGS. 12A through 12L which show the tactical system of FIG. 3 with the elevation/polar reflector 604, the azimuth reflector 606, the azimuth turret 612, and the azimuth beam steering turret mechanism 610, in various positions during operation (FIG. 12A, which shows the tactical system of FIG. 3 in a stowed position 1810, with both reflectors stowed, was already discussed above, because it is similar to FIG. 3). FIG. 12B is an exemplary illustration 1812 of the tactical HPM system 600 of FIG. 3 in a first position 1812, with the elevation/polar reflector 604 starting to be elevated, and the azimuth reflector 606 starting to be rotated for its elevation, in accordance with one embodiment. As will be understood, components including but not limited to the linear deployment actuator 642, the elevation/polar support arm 608, and the elevation steering head tilt actuator 617, cooperate to start to raise the elevation/polar reflector 604 and/or to start to rotate it to a desired orientation, and the rotary deployment actuator 644 may come into play to start to rotate the azimuth reflector 606.

Figure 12C:
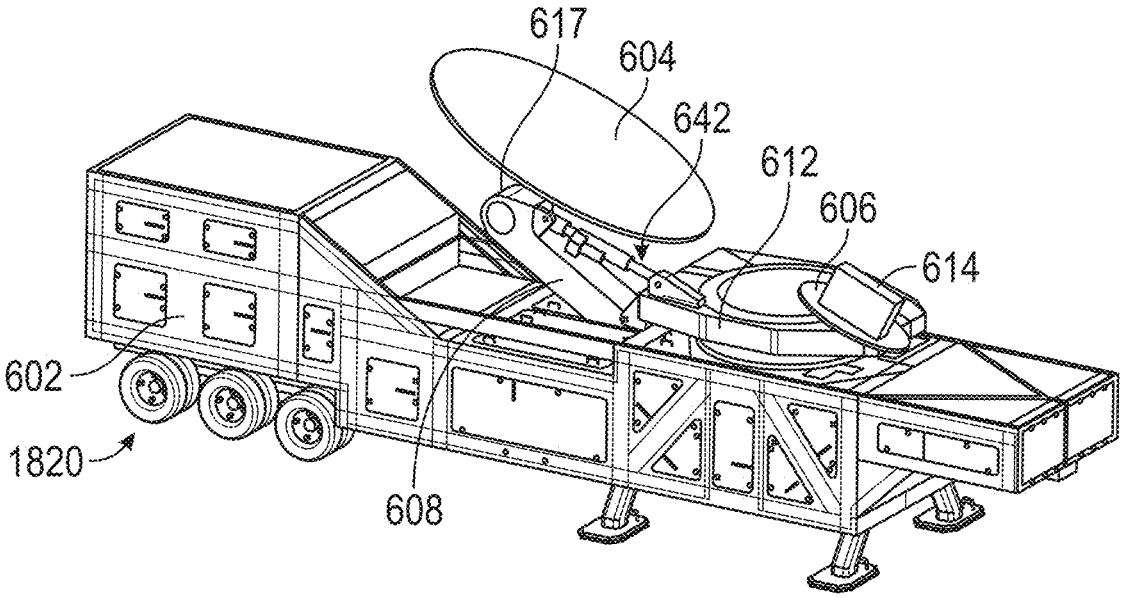
FIG. 12C is an exemplary illustration of the tactical HPM system of FIG. 3 in a second position, in accordance with one embodiment.
Figure 12D:
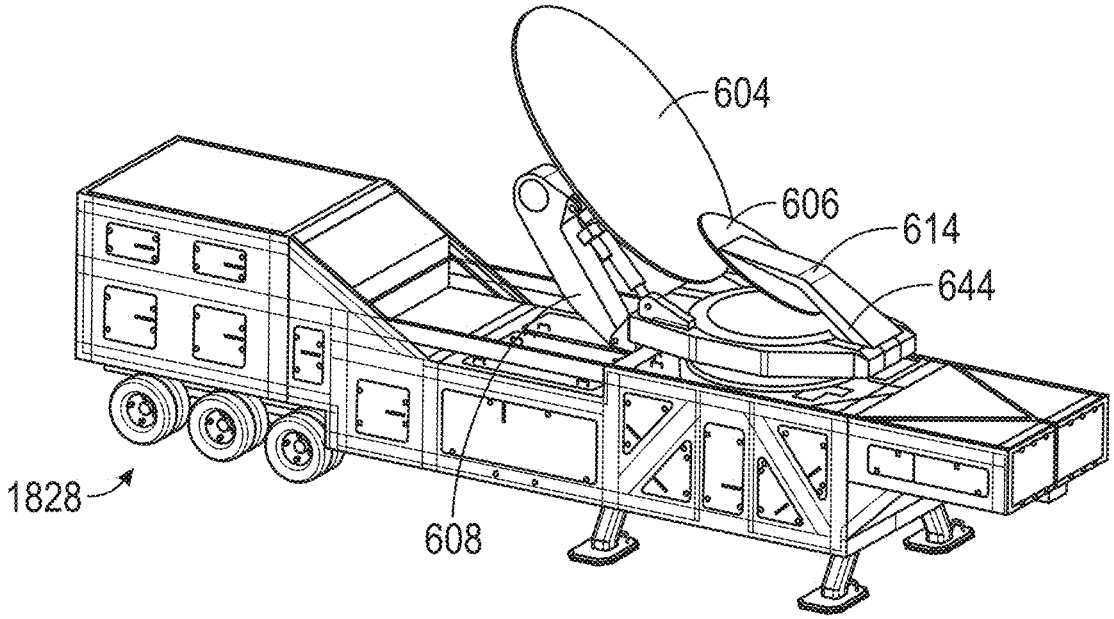
FIG. 12D is an exemplary illustration of the tactical HPM system of FIG. 3 in a third position, in accordance with one embodiment.
Figure 12E:
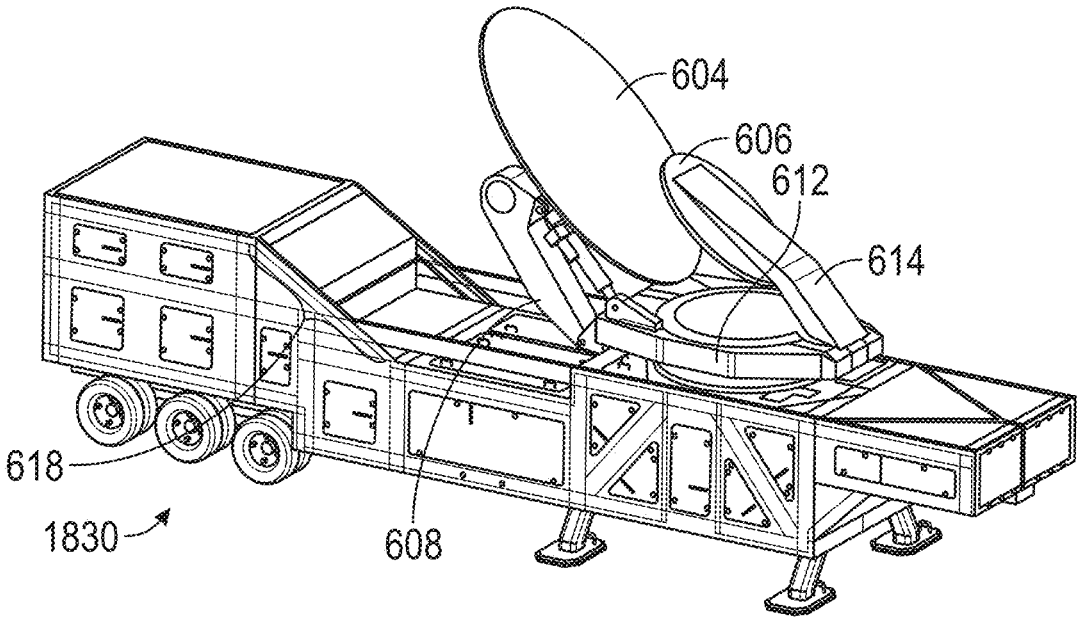
FIG. 12E is an exemplary illustration of the tactical HPM system of FIG. 3 in a fourth position, in accordance with one embodiment.

FIG. 12C is an exemplary illustration of the tactical HPM system 6 of FIG. 3 in a second position 1820, with the elevation/polar reflector 604 further elevated and 00 the azimuth reflector 606 starting to be elevated as it is rotated, in accordance with one embodiment. The azimuth support arm 614 for the azimuth reflector 606 cooperates to start to raise the azimuth reflector 606. FIG. 12D is an exemplary illustration 1828 of the tactical HPM system 600 of FIG. 3 in a third position 1828, with the elevation/polar reflector 604 further elevated and the azimuth reflector 606 further elevated as it is rotated, in accordance with one embodiment. FIG. 12E is an exemplary illustration of the tactical HPM system 600 of FIG. 3 in a fourth position 1830, in accordance with one embodiment, with the elevation/polar reflector 604 further elevated and the azimuth reflector 606 further rotated to be elevated.

Figure 12F:
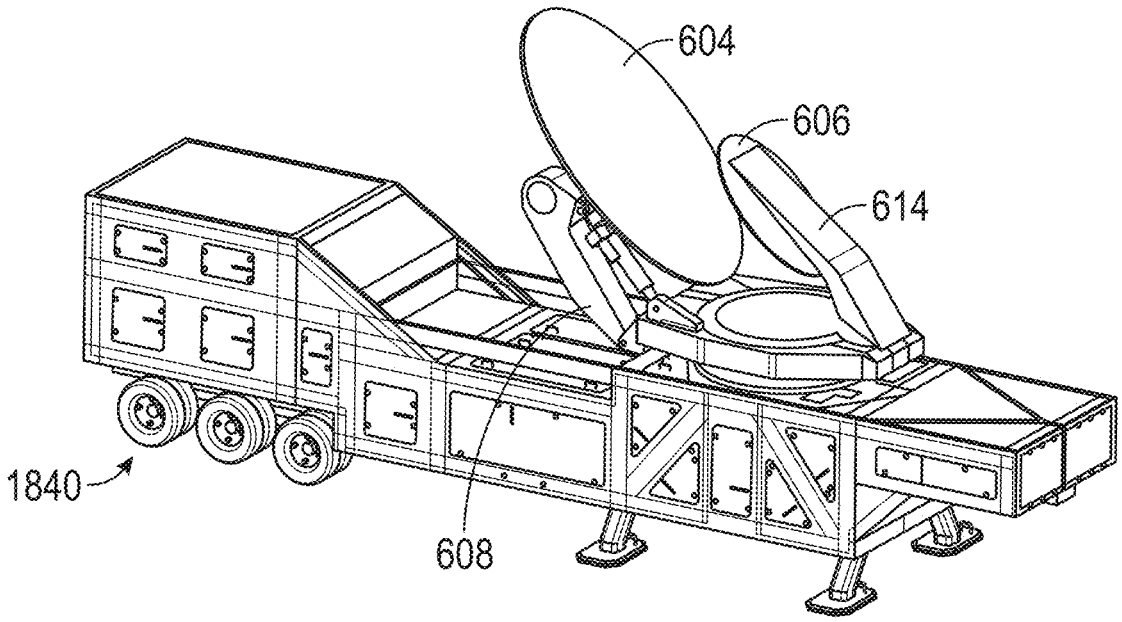
FIG. 12F is an exemplary illustration of the tactical HPM system of FIG. 3 in a fifth position, in accordance with one embodiment.
Figure 12G:
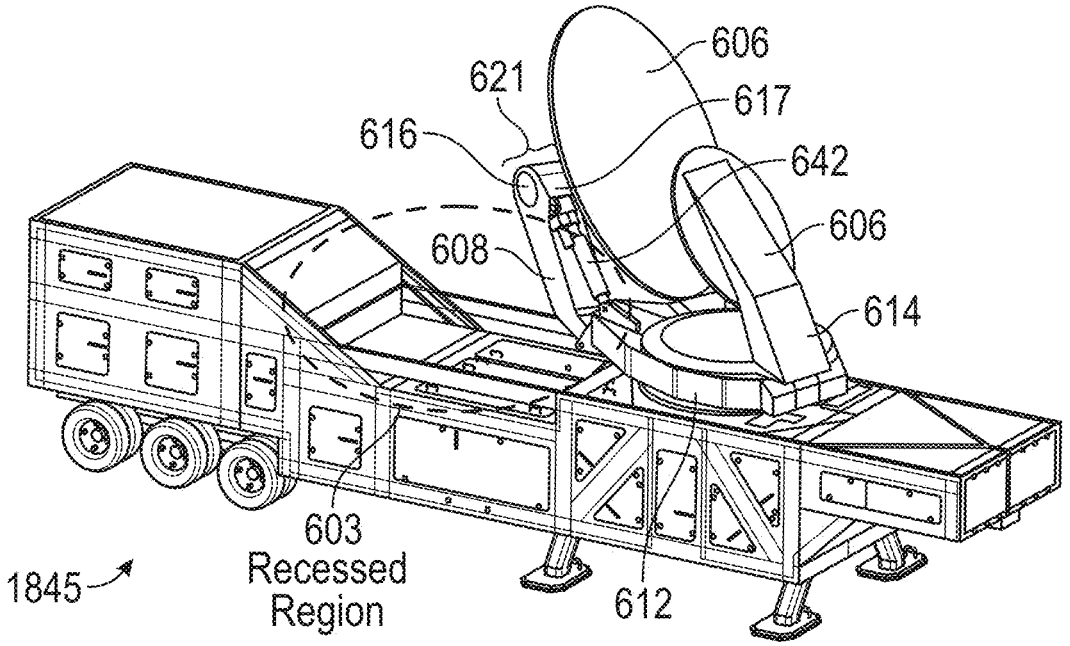
FIG. 12G is an exemplary illustration of the tactical HPM system of FIG. 3 in a sixth position, in accordance with one embodiment.
Figure 12H:
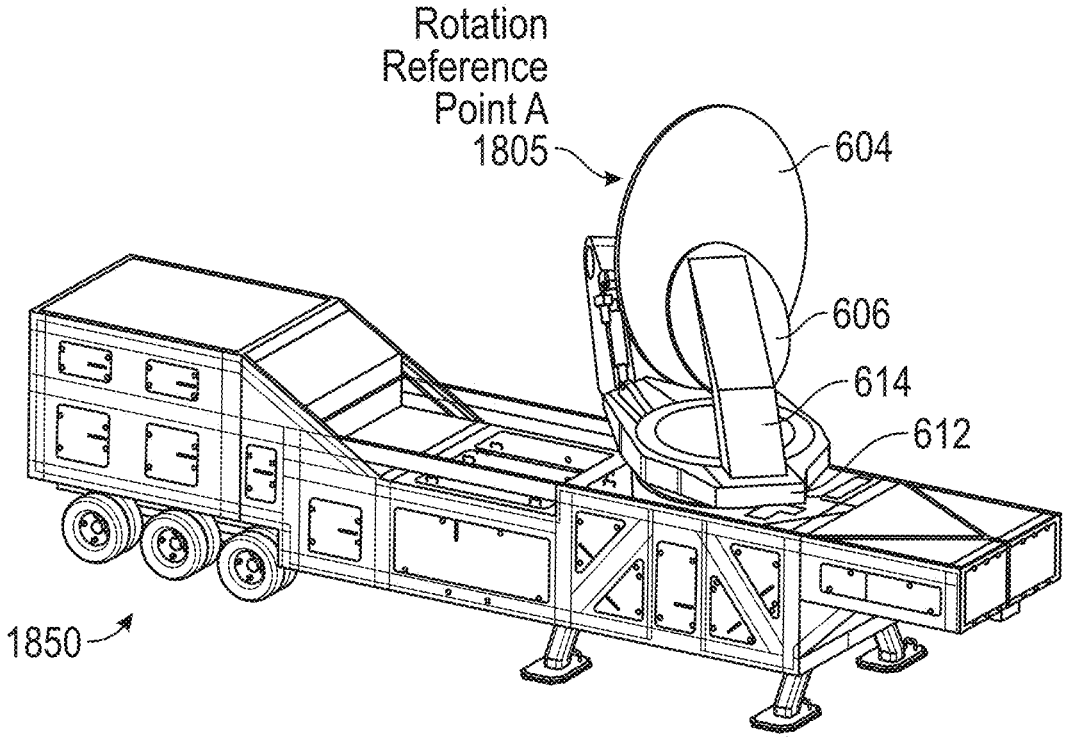
FIG. 12H is an exemplary illustration of the tactical HPM system of FIG. 3 in a seventh position, in accordance with one embodiment.
Figure 12I:
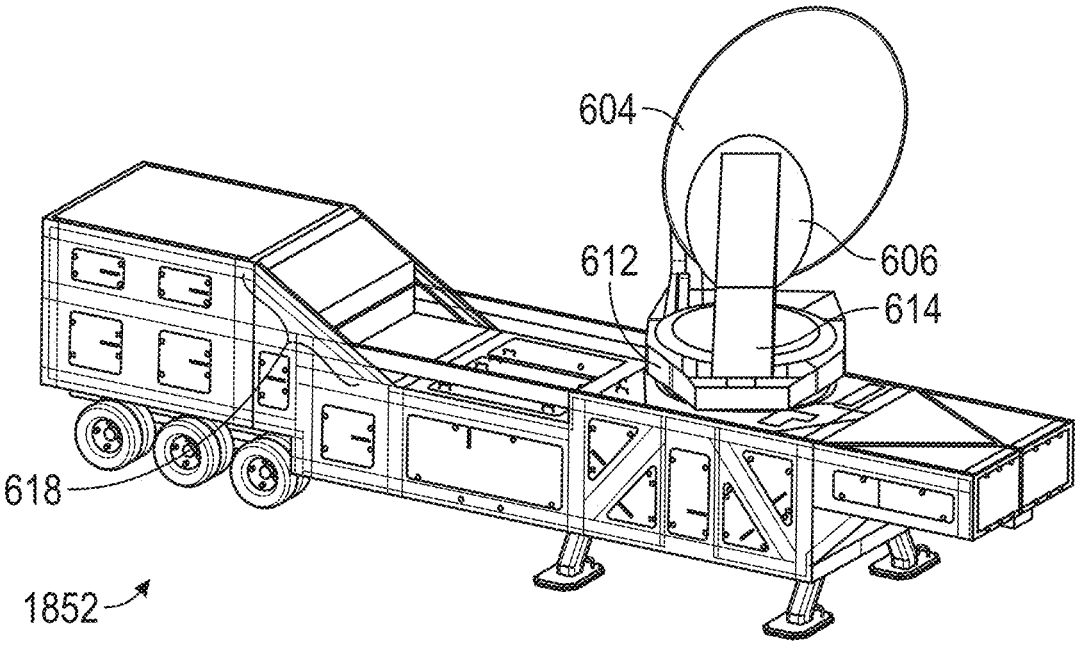
FIG. 12I is an exemplary illustration of the tactical HPM system of FIG. 3 in an eighth position, in accordance with one embodiment.

FIG. 12F is an exemplary illustration of the tactical HPM system 600 of FIG. 3 in a fifth position 1840, with the elevation/polar reflector 604 and the azimuth reflector 606 each nearly fully elevated to an initial deployment position, in accordance with one embodiment. FIG. 12G is an exemplary illustration of the tactical HPM system 600 of FIG. 3 in a sixth position 1845, with the elevation/polar reflector 604 fully elevated and starting to rotate along the elevation/polar axis (which will be discussed further herein) and the azimuth reflector 606 fully elevated, in accordance with one embodiment. FIG. 12H is an exemplary illustration of the tactical HPM system 600 of FIG. 3 in a seventh position, showing rotation of the azimuth beam steering turret mechanism 610, and azimuth turret 612, along the azimuth rotation axis, in accordance with one embodiment. FIG. 12I is an exemplary illustration of the tactical HPM system 600 of FIG. 3 in an eighth position 1852, showing further rotation of the azimuth beam steering turret mechanism 610 and azimuth turret 612 along the azimuth rotation axis, in accordance with one embodiment.

Figure 12J:
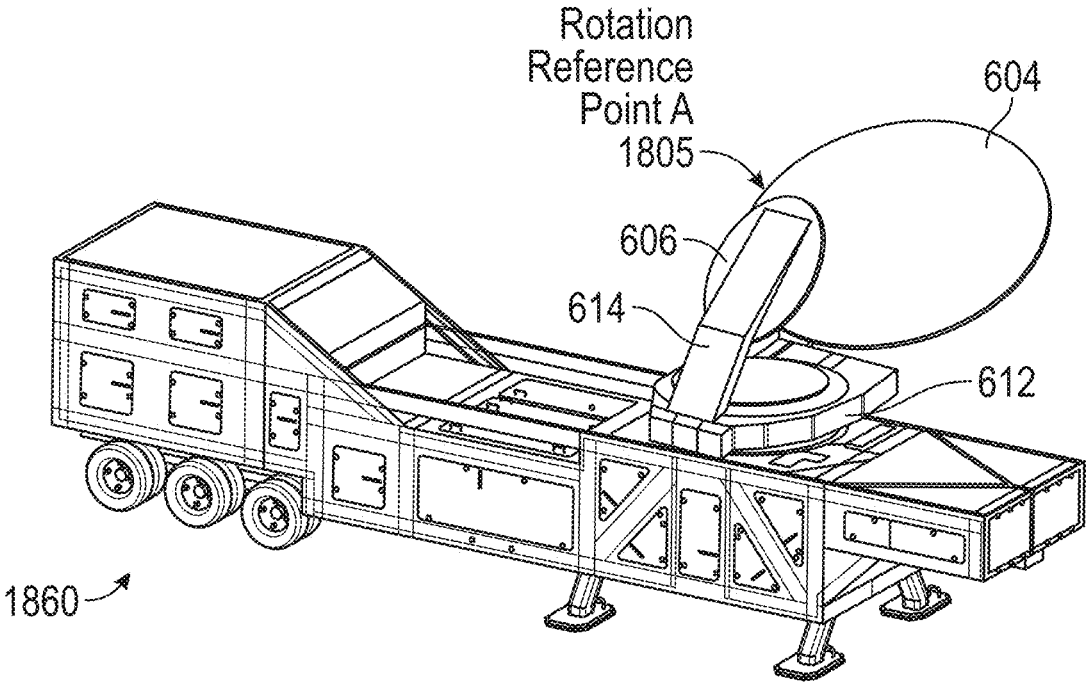
FIG. 12J is an exemplary illustration of the tactical HPM system of FIG. 3 in a ninth position, in accordance with one embodiment.
Figure 12K:
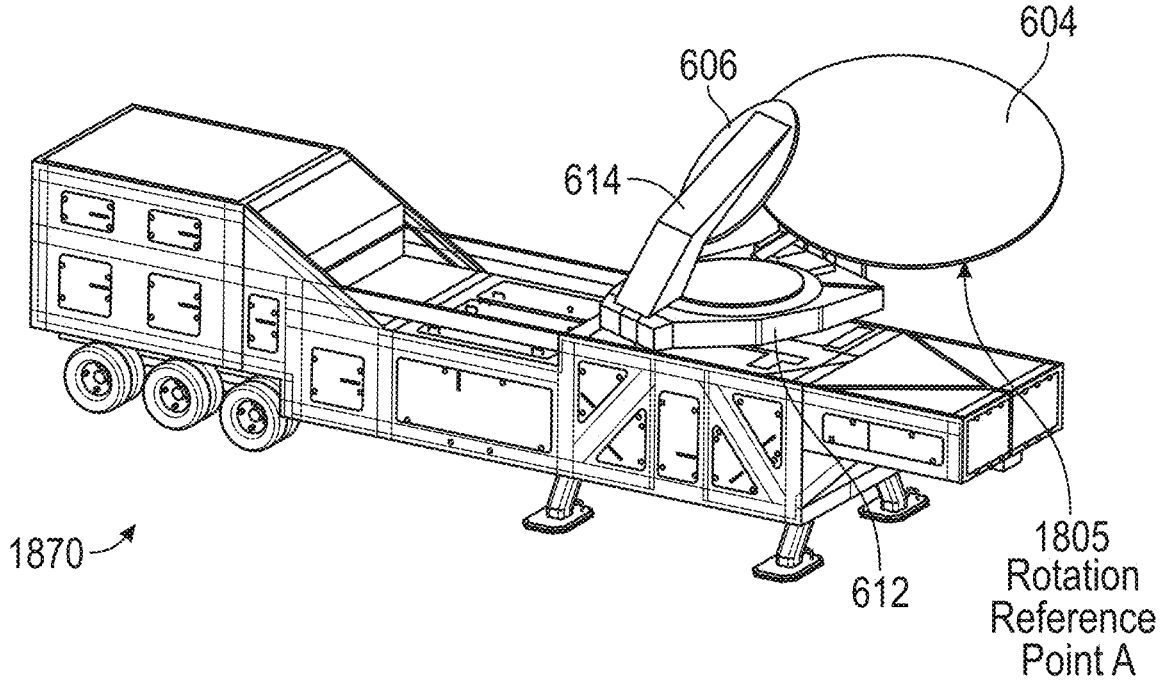
FIG. 12K is an exemplary illustration of the tactical HPM system of FIG. 3 in a tenth position, in accordance with one embodiment.
Figure 12L:
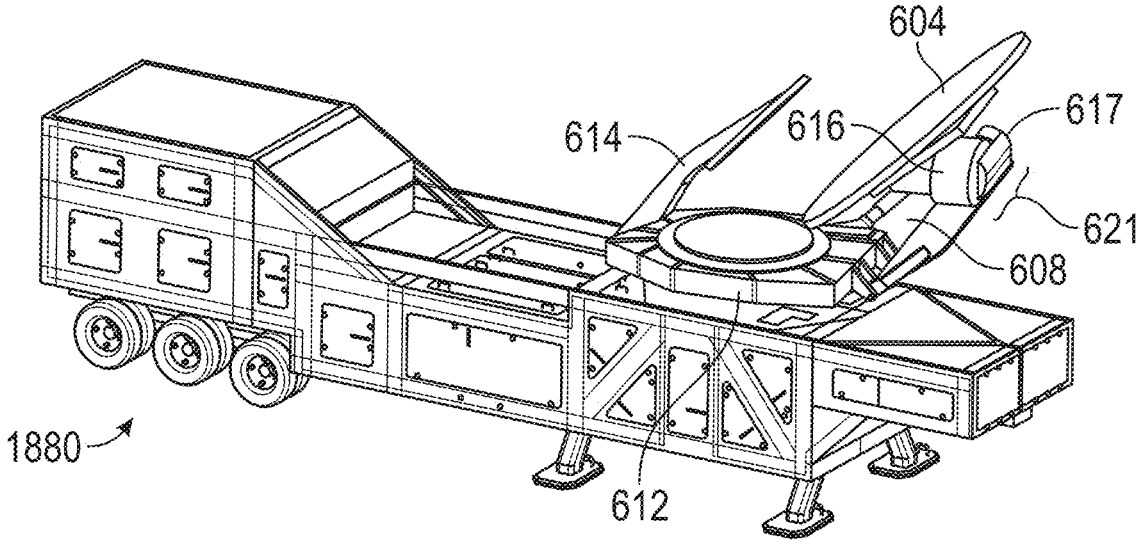
FIG. 12L is an exemplary illustration of the tactical HPM system of FIG. 3 in an eleventh position, in accordance with one embodiment.

FIG. 12J is an exemplary illustration of the tactical HPM system 600 of FIG. 3 in a ninth position 1860, showing the elevation/polar reflector further rotating along the elevation/polar axis and further rotation of the azimuth beam steering turret mechanism along the azimuth rotation axis, in accordance with one embodiment. FIG. 12K is an exemplary illustration of the tactical HPM system 600 of FIG. 3 in a tenth position 1870, showing the elevation/polar reflector further rotating along the elevation/polar axis and further rotation of the azimuth beam steering turret mechanism along the azimuth rotation axis, in accordance with one embodiment. FIG. 12L is an exemplary illustration of the tactical HPM system 600 of FIG. 3 in an eleventh position 1880, in accordance with one embodiment. The eleventh position 1880 shows the elevation/polar reflector 604 and the azimuth reflector 606 rotated about 175 degrees from the initial deployment position of FIG. 12F and also illustrates the offset arrangement of the polar/elevation reflector, including the offset portion 621 that is coupled to the elevation/polar support arm 608. As can be seen in FIG. 12B through FIG. 12L, the spacing and orientation between the elevation/polar reflector 604 and the azimuth reflector 606 is controlled via the way the reflectors are actuated and simultaneously rotated.

As FIGS. 12B-12L illustrate, the arrangement shown in these figures maintains the orientation and/or spacing between the elevation/polar reflector 604 and the azimuth reflector 606 even with the azimuth beam steering turret mechanism 610 and azimuth turret 612 rotated about 185 degrees from the position shown in FIG. 12F to the position shown in FIG. 12L. In certain embodiments, the elevation/polar mechanical control subsystem 742 and the azimuth mechanical control subsystem 744 are constructed and arranged to ensure that the azimuth reflector 606 and elevation/polar reflector 604 can maintain a desired orientation and spacing regardless of the rotation.

Referring still briefly to FIG. 13A through FIG. 14I, the individual motions of the elevation/polar reflector 604 and azimuth reflector 606, are depicted in greater detail.

Figure 13A:
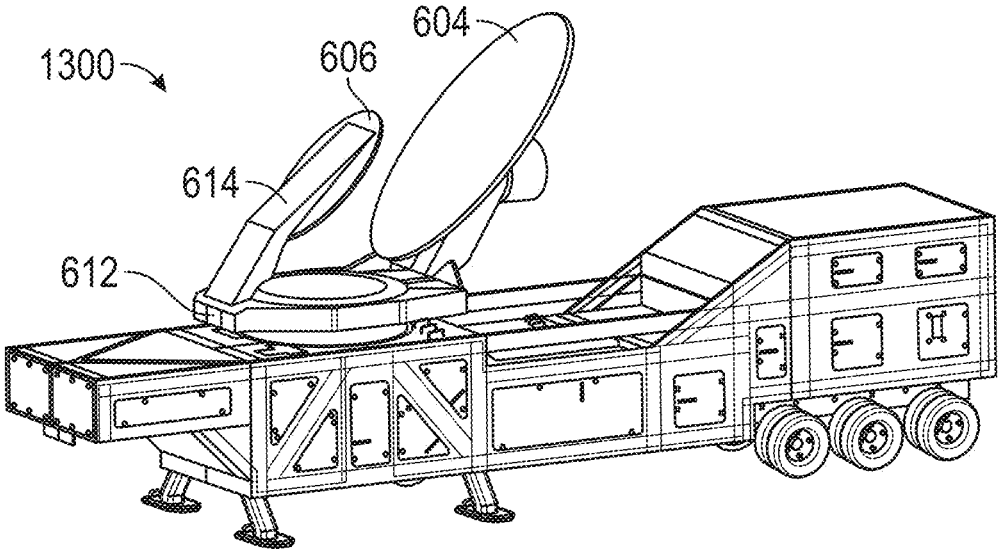
FIG. 13A is an exemplary illustration of the tactical HPM system of FIG. 3 in a first deployed position, in accordance with one embodiment.
Figure 13B:
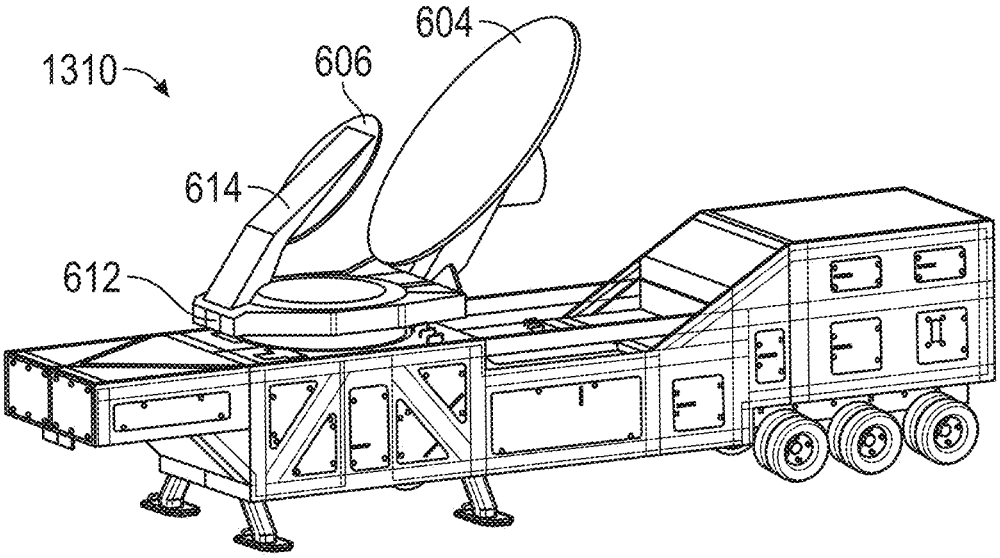
FIG. 13B is an exemplary illustration of the tactical HPM system of FIG. 3 in a second deployed position, in accordance with one embodiment.
Figure 13C:
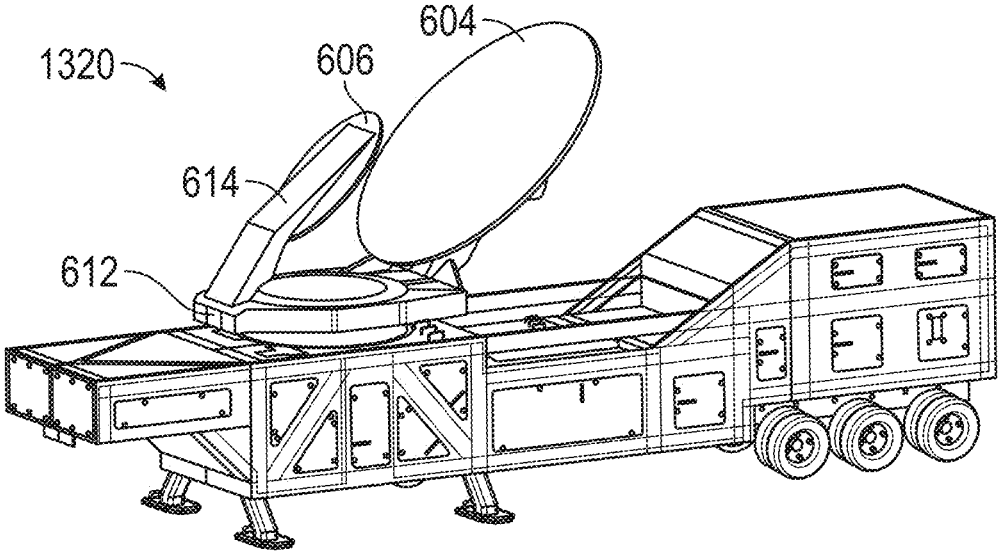
FIG. 13C is an exemplary illustration of the tactical HPM system of FIG. 3 in a third deployed position, in accordance with one embodiment.
Figure 13D:
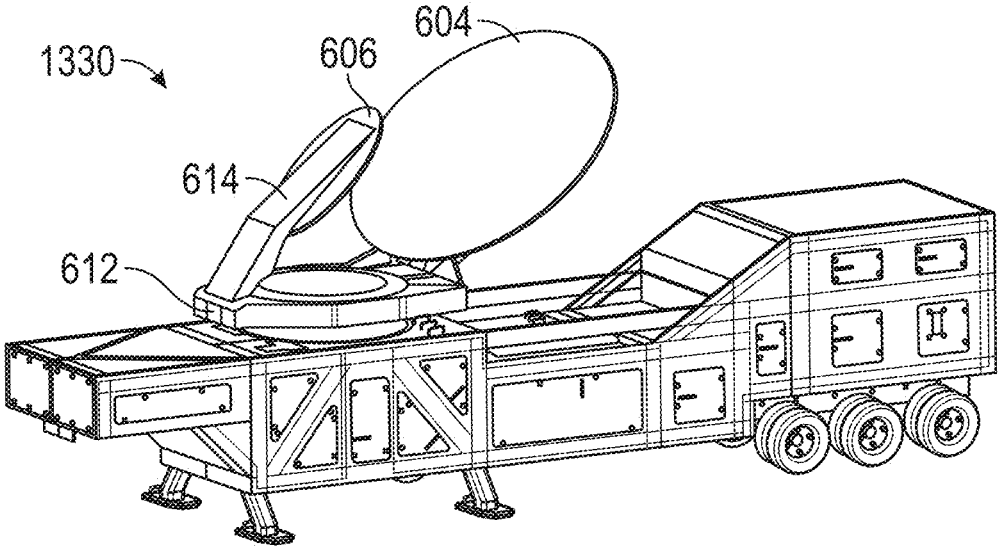
FIG. 13D is an exemplary illustration of the tactical HPM system of FIG. 3 in a fourth deployed position, in accordance with one embodiment.
Figure 13E:
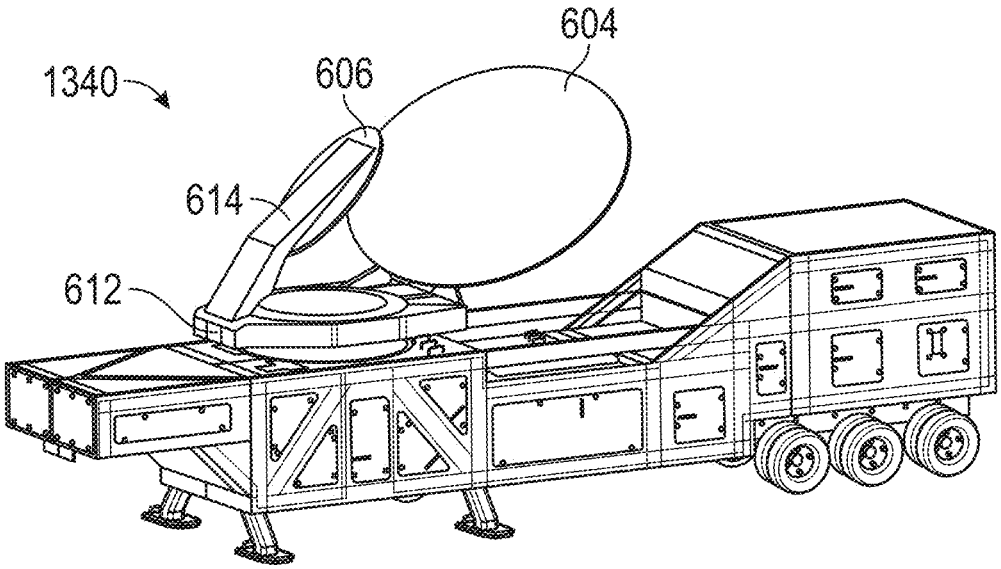
FIG. 13E is an exemplary illustration of the tactical HPM system of FIG. 3 in a fifth deployed position, in accordance with one embodiment.
Figure 13F:
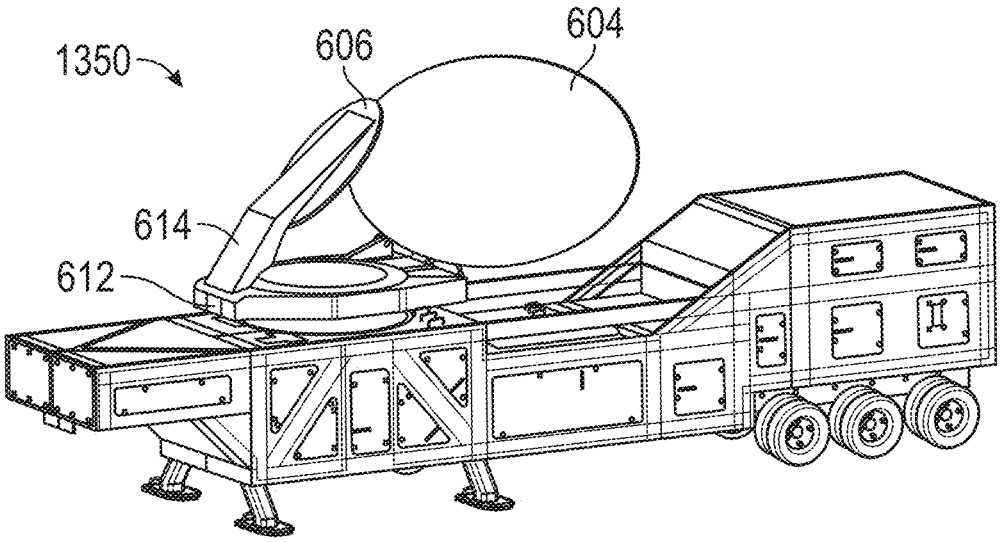
FIG. 13F is an exemplary illustration of the tactical HPM system of FIG. 3 in a sixth deployed position, in accordance with one embodiment.

FIG. 13A is an exemplary illustration of the tactical HPM system 600 of FIG. 3 in a first deployed position 1300, in accordance with one embodiment, with the azimuth reflector 606 held in a constant position, an azimuth angle of 0 degrees, and the elevation/polar reflector 604 rotated to is about −5 degrees from its initial deployment position. FIG. 13B an exemplary illustration of the tactical HPM system 600 of FIG. 3 in a second deployed position 1310, in accordance with one embodiment, with the azimuth reflector 606 held in a constant position, an azimuth angle of 0 degrees, and the elevation/polar reflector 604 rotated to about 0 degrees from its initial deployment position of FIG. 12F. FIG. 13C is an exemplary illustration of the tactical HPM system 600 of FIG. 3 in a third deployed position 1320, with the azimuth reflector 606 held in a constant position, an azimuth angle of 0 degrees, and the elevation/polar reflector 604 rotated to about 15 degrees from its initial deployment position of FIG. 12F;

FIG. 13D is an exemplary illustration of the tactical HPM system 600 of FIG. 3 in a fourth deployed position 1330, in accordance with one embodiment, with the azimuth reflector 606 held in a constant position, an azimuth angle of 0 degrees, and the elevation/polar reflector 604 rotated to about 30 degrees from initial deployment position of FIG. 12F. FIG. 13E is an exemplary illustration of the tactical HPM system 600 of FIG. 3 in a fifth deployed position 1340, in accordance with one embodiment, with the azimuth reflector 606 held in a constant position, an azimuth angle of 0 degrees, and the elevation/polar reflector 604 rotated to about 45 degrees from initial deployment position of FIG. 12F. FIG. 13F is an exemplary illustration of the tactical HPM system 600 of FIG. 3 in a sixth deployed position 1350, in accordance with one embodiment, with the azimuth reflector 606 held in a constant position, an azimuth angle of 0 degrees, and the elevation/polar reflector 604 rotated to about 60 degrees from initial deployment position of FIG. 12F.

Figure 13G:
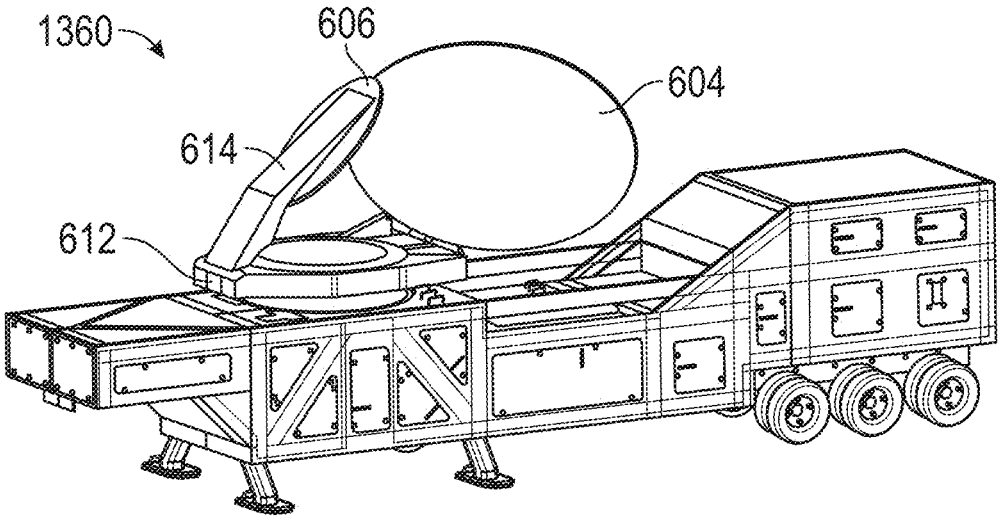
FIG. 13G is an exemplary illustration of the tactical HPM system of FIG. 3 in a seventh deployed position, in accordance with one embodiment.
Figure 13H:
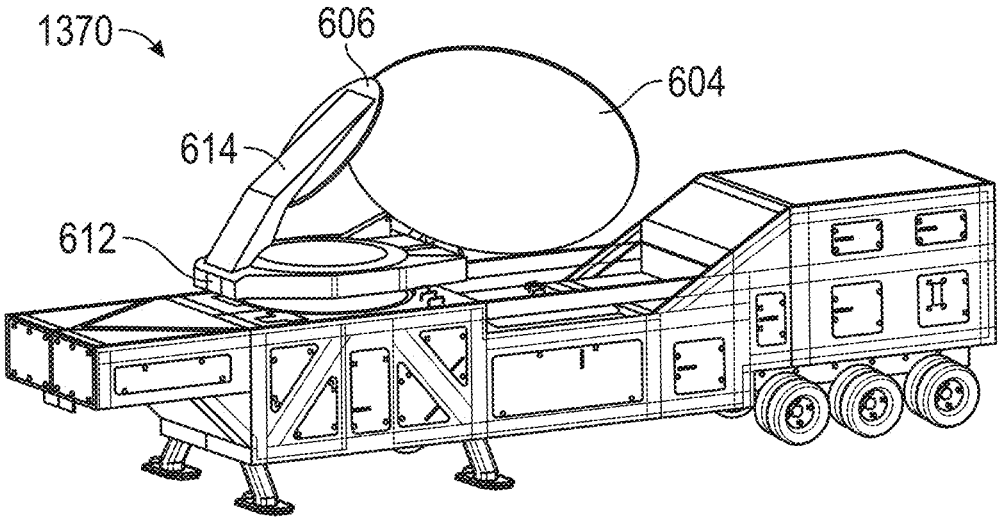
FIG. 13H is an exemplary illustration of the tactical HPM system of FIG. 3 in an eighth deployed position, in accordance with one embodiment.

FIG. 13G is an exemplary illustration of the tactical HPM system 600 of FIG. 3 in a seventh deployed position, in accordance with one embodiment, with the azimuth reflector 606 held in a constant position, an azimuth angle of 0 degrees, and the elevation/polar reflector 604 rotated to about 85 degrees from initial deployment position of FIG. 12F. FIG. 13H is an exemplary illustration of the tactical HPM system 600 of FIG. 3 in an eighth deployed position, in accordance with one embodiment, with the azimuth reflector 606 held in a constant position, an azimuth angle of 0 degrees, and the elevation/polar reflector 604 rotated to about 95 degrees from initial deployment position of FIG. 12F.

FIG. 14A is an exemplary illustration of the tactical HPM system 600 of FIG. 3 in a ninth deployed position 1400, in accordance with one embodiment, with the elevation/polar reflector 604 set to an angle of 45 degrees and the azimuth turret 612 rotated to about −185 degrees from the initial deployment position of FIG. 12F. FIG. 14B is an exemplary illustration of the tactical HPM system 600 of FIG. 3 in a tenth deployed position 1410, in accordance with one embodiment, with the elevation/polar reflector 604 set to an angle of 45 degrees and the azimuth turret 612 rotated to about −135 degrees from the initial deployment position of FIG. 12F. FIG. 14C is an exemplary illustration of the tactical HPM system 600 of FIG. 3 in an eleventh deployed position 1420, in accordance with one embodiment, with the elevation/polar reflector 604 set to an angle of 45 degrees and the azimuth turret 612 rotated to about −90 degrees from the initial deployment position of FIG. 12F.

FIG. 14D is an exemplary illustration of the tactical HPM system 600 of FIG. 3 in a twelfth deployed position 1430, in accordance with one embodiment, with the elevation/polar reflector 604 set to an angle of 45 degrees and the azimuth turret 612 rotated to about −45 degrees from the initial deployment position of FIG. 12F. FIG. 14E is an exemplary illustration of the tactical HPM system 600 of FIG. 3 in a thirteenth deployed position 1440, in accordance with one embodiment, with the elevation/polar reflector 604 set to an angle of 45 degrees and the azimuth turret 612 rotated to about 0 degrees from the initial deployment position of FIG. 12F. FIG. 14F is an exemplary illustration of the tactical HPM system 600 of FIG. 3 in a fourteenth deployed position 1450, in accordance with one embodiment, with the elevation/polar reflector 604 set to an angle of 45 degrees and the azimuth turret 612 rotated to about +45 degrees from the initial deployment position of FIG. 12F.

FIG. 14G is an exemplary illustration of the tactical HPM system 600 of FIG. 3 in a fifteenth deployed position 1460, in accordance with one embodiment, with the elevation/polar reflector 604 set to an angle of 45 degrees and the azimuth turret 612 rotated to about +90 degrees from the initial deployment position of FIG. 12F. FIG. 14H is an exemplary illustration of the tactical HPM system 600 of FIG. 3 in a sixteenth deployed position 1470, in accordance with one embodiment, with the elevation/polar reflector 604 set to an angle of 45 degrees and the azimuth turret 612 rotated to about +135 degrees from the initial deployment position of FIG. 12F. The embodiments of FIG. 14G and FIG. 14H also illustrate that, in certain embodiments, the offset arrangement of the elevation/polar support arm 608 is accomplished using an offset portion 621 having two parts, an upper offset portion 621*a*, which is operably coupled to the elevation steering head tilt actuator 617 and a lower offset portion 621*b*, which is operably coupled to the azimuth turret 612. The upper offset portion 621*a* and the lower offset portion 621*b* are configured to help provide stability and rigidity to the offset arrangement, as will be appreciated.

FIG. 14I is an exemplary illustration of the tactical HPM system 600 of FIG. 3 in a seventeenth deployed position 1480, in accordance with one embodiment, with the elevation/polar reflector 604 set to an angle of 45 degrees and the azimuth turret 612 rotated to about +185 degrees from the initial deployment position of FIG. 12F.

Figure 5:
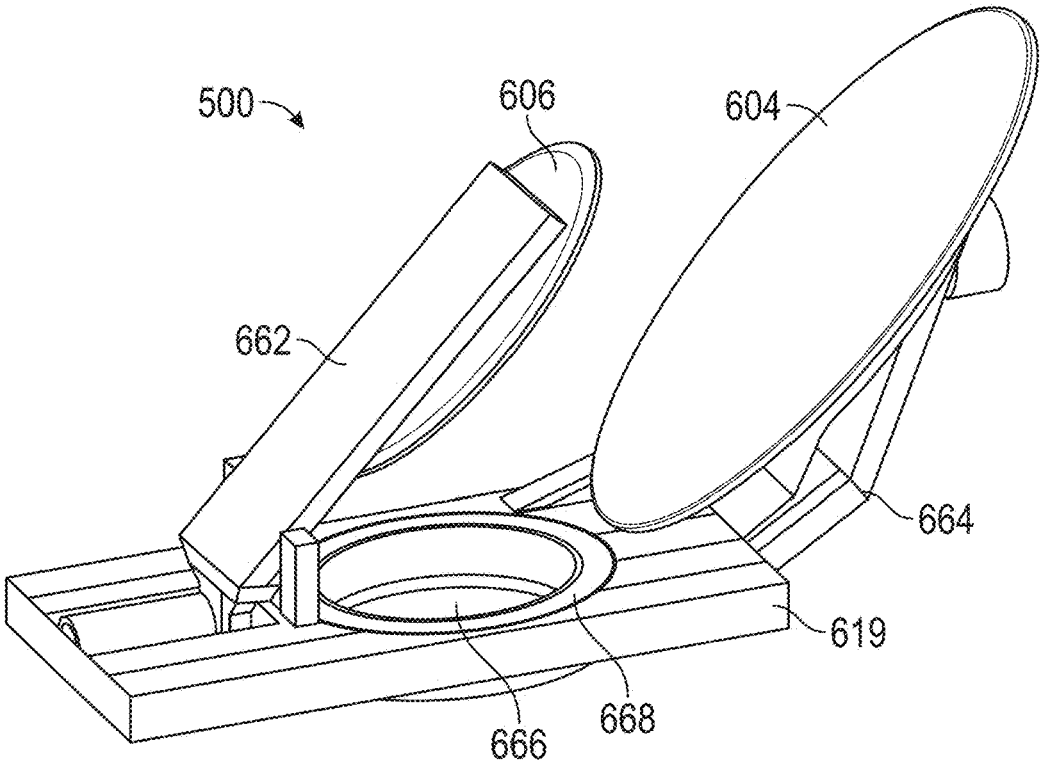
FIG. 5 is a perspective view of another embodiment of the assembly of FIG. 4, in accordance with one embodiment.

Referring again back to FIG. 4, it will be appreciated that there can be various ways, in various embodiments, to keep the reflectors (e.g., the elevation/polar reflector 604 and the azimuth reflector 606) in a fixed aspect (if required), even during rotation. For example, FIG. 5 is a perspective view of showing a side view 680 of another embodiment of the assembly of FIG. 4 in accordance with one embodiment. In this embodiment of FIG. 5, instead of the reflector rotary deployment actuator 644 of FIG. 3, this embodiment uses a type of linear actuator to stow and deploy the azimuth reflector 606 and support structure 662. In comparing the embodiment of FIG. 5 with the embodiment of FIG. 3, the azimuth slewing ring and azimuth turret 612 are similar, but have a slightly different shape; however, one difference in this embodiment is in the azimuth reflector deployment mechanism.

Figure 7:
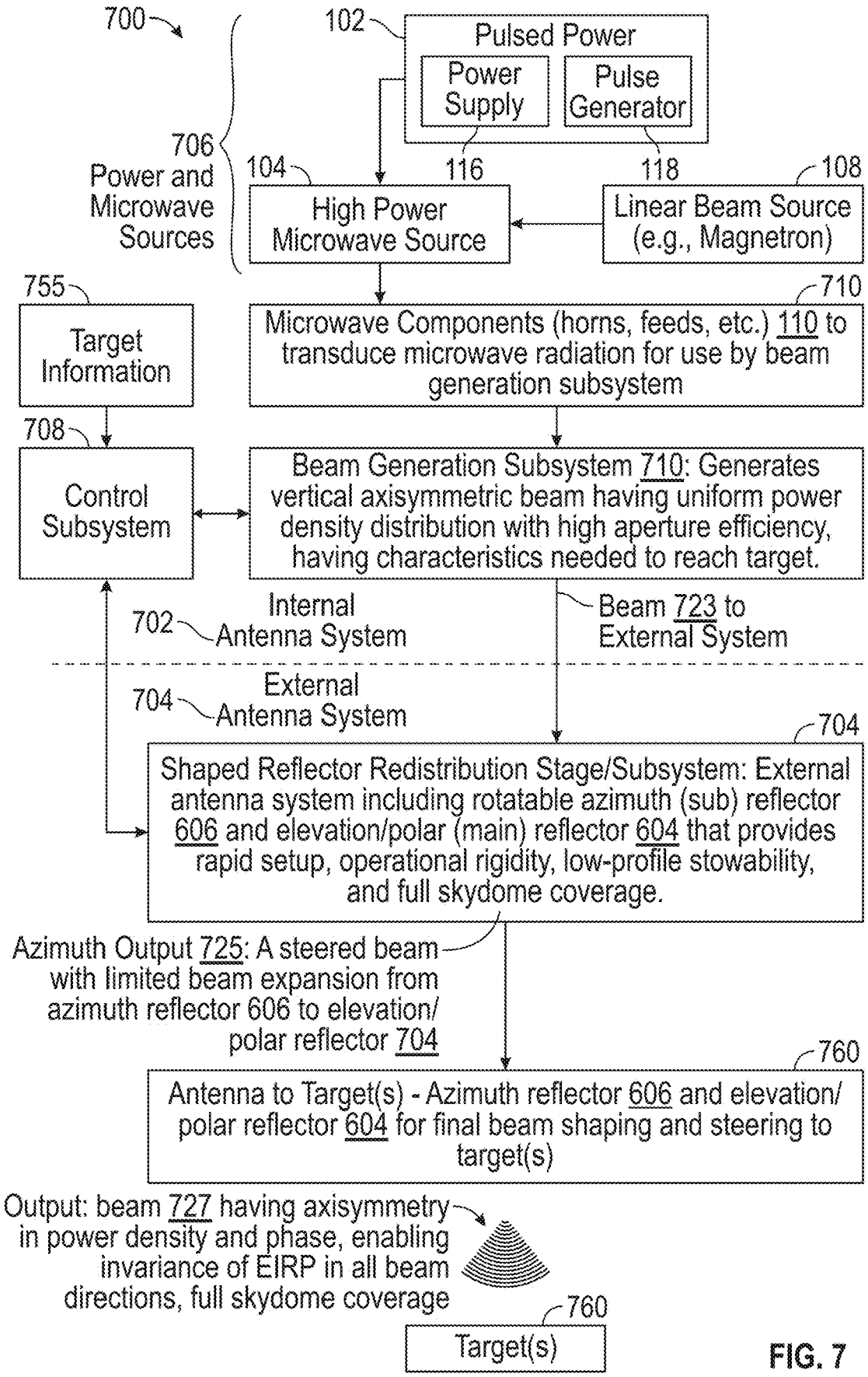
FIG. 7 is a simplified functional block diagram of an HPM system having a stage of shaped reflector redistribution, in accordance with one embodiment.

FIG. 7 is a simplified functional block diagram of an improved HPM system 700 with an added stage/subsystem of shaped reflector redistribution, in accordance with one embodiment. FIG. 7 helps to depict how at least some embodiments of the disclosure herein improve over the exemplary prior art HPM system 100 of FIG. 1. FIG. 7 includes some elements similar to those shown in FIG. 1, but improves on FIG. 1 in several ways, including by providing a beam generation subsystem 710 configured to generate a vertical axissymmetric beam having uniform power density distribution with high aperture efficiency, having the characteristics needed to reach a target, based on target information 755 that is received at a control subsystem 708. This arrangement is configured to improve the optics to improve aperture efficiency and power density on target. In at least some embodiments, the improved HPM system 700 of FIG. 7 also is usable as part of a DEW system.

Referring to FIG. 7, the input power and microwave source functionality is provided in a manner similar to that described for FIG. 1. In the HPM system 700 of FIG. 7, pulsed power 102 is used to energize a high power microwave source 104. The pulsed power 102 includes a power supply 116 and a pulse generator 118, where the pulsed power 102, in an example embodiment, is configured to deliver electrical pulses of at least one MVolt at a pulse duration of less than 1 μs. In the embodiment of FIG. 7A, advantageously, the high power microwave source 104 is provided via a linear beam source 108, such as a Klystron, but this is not limiting.

In certain embodiments (e.g., the tactical HPM system 600 of FIG. 3), the pulsed power 102, high power microwave source 104, beam generation subsystem 710, and control subsystem 708 are constructed and arranged to be located and operated internally, e.g., within the trailer enclosure 602 (FIG. 3), as part of the internal antenna system 702.

The output of the beam generation subsystem 710 (i.e., beam 723) passes from the internal antenna system 702 to the external antenna system 704 (e.g., via an opening in the trailer enclosure 602, such as the environmental window 722 (FIG. 8) which opening optionally may be covered by a material or structure or "window" that is transparent to RF), where the external antenna system 704 effectively comprises and is also referred to herein as a shaped reflector redistribution stage/subsystem 704.

The external antenna system 704 applies shaped-reflector redistribution via the rotating azimuth reflector 606 (FIG. 3, FIG. 8), which serves as a subreflector in a shaped reflector pair that is made of the azimuth reflector 606 and the elevation/polar reflector 604. After the beam 723 having uniform power density beam reaches the azimuth reflector 606, the azimuth reflector 606 is configured to limit the beam expansion before the beam reaches the elevation/polar reflector 604. The azimuth reflector 606 and elevation/polar reflector 604 cooperate to produce an output beam 727 output to target 760 having axisymmetry of power density and phase, which helps to enable invariance in equivalent isotropic radiated power (EIRP) in all beam directions. In certain embodiments, the beam 723 provided to the external antenna system 704 is an HPM input beam that the external antenna system 704 uses to form an output beam 727 that contains HPM energy. In certain embodiments, output beam 727 that is steered towards the target 760 is configured to direct HPM energy towards the target 760 as part of a DEW system.

This stage/subsystem of shaped reflector optics, in the external antenna system 704, in certain embodiments, help to maximize antenna efficiency while minimizing RF energy spillover, especially around the elevation/polar reflector 604, by more precisely limiting beam expansion between the azimuth reflector 606 (which also acts as a steering reflector) and the elevation/polar reflector 604. In certain embodiments, this stage/subsystem of shaped reflector optics help to put 30-40% higher power density on target, with lower spillover radiation, than many known systems. As will be appreciated by those of skill in the art, a higher power density on target is advantageous not only for system such as tactical HPM systems and DEW weapons, but for any system that needs to provide a high power density during tracking of and/or communication with targets or other entities (e.g., in satellite communications systems).

More details on the structural, functional, and optical mechanisms of how this all takes place are discussed further below in connection with FIGS. 8-22.

Figure 8:
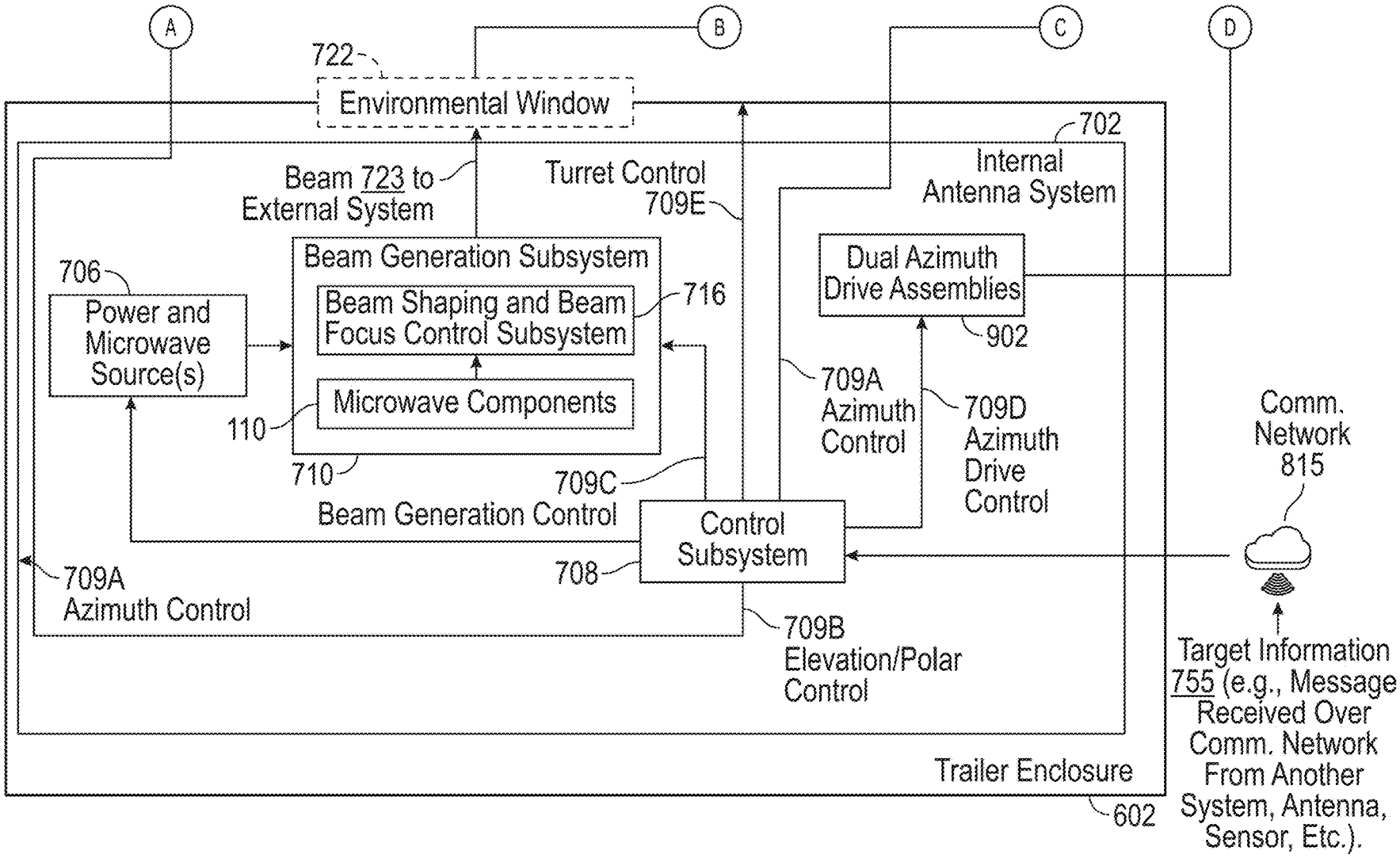
FIG. 8 is a simplified functional block diagram of the tactical HPM system of FIG. 3, in accordance with one embodiment.
Figure 8:
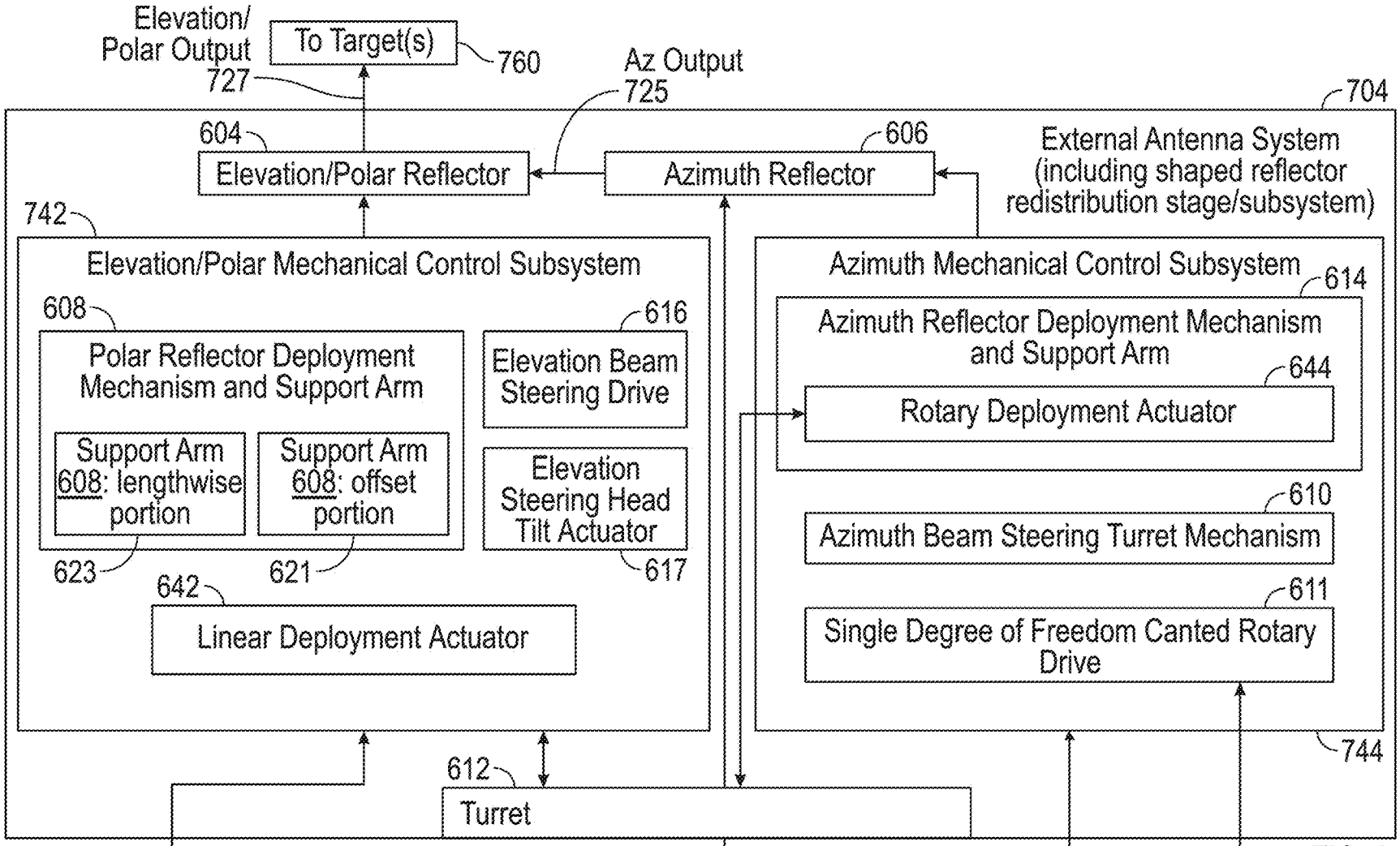

FIG. 8 is a simplified functional block diagram of a system 800 that implements the tactical HPM system 600 of FIG. 3, in accordance with one embodiment. FIG. 8 shows how the functional block diagram of FIG. 7 is implemented in the tactical HPM system 600 of FIG. 3, showing more functional details of its components. The simplified functional block diagram of the system 800 of FIG. 8 includes an internal antenna system 702, which in FIG. 3 is located within the trailer enclosure 602, and an external antenna system 704, which corresponds to the functional features shown external to the trailer enclosure 602, including but not limited to the elevation/polar reflector 604, the azimuth reflector 606, a azimuth turret 612, as well as an elevation/polar mechanical control subsystem 742 and an azimuth mechanical control subsystem 744.

The elevation/polar mechanical control subsystem 742 includes components configured for automatic control of movement of the elevation/polar reflector 604, including components to automatically raise and lower the elevation/polar reflector 604, as well as components to automatically rotate the elevation/polar reflector 604 in response to control signals and/or target information, where in at least some embodiments, the components automatically rotate the azimuth reflector 606 simultaneously with the elevation/polar reflector 604, to help maintain a fixed orientation between the elevation/polar reflector and the azimuth reflector 606. As FIG. 8 illustrates, in certain embodiments, a control subsystem 708 (which, advantageously, may be located within the trailer enclosure 602, but also may be located external to the trailer enclosure 602) is configured to control the elevation/polar mechanical control subsystem 742, e.g., via one or more elevation/polar control signals (e.g., elevation/control 709B). In certain embodiments, the one or more elevation/polar control signals (e.g., elevation/polar control 709B) may, if appropriate, include a command to cause the elevation/polar reflector 604 to move automatically to a stowed position (e.g., as shown in FIGS. 6, 18B herein) and/or to a deployed position (e.g., as shown in FIGS. 12B-14I herein). In the example embodiment of FIG. 3 and FIG. 8, the elevation/polar mechanical control subsystem includes an elevation/polar reflector deployment mechanism and elevation/polar support arm 608, a linear deployment actuator 642, an elevation beam steering drive 616, and an elevation steering head tilt actuator 617. Some of these components were more particularly illustrated and described in connection with FIG. 4 (e.g., the elevation steering head tilt actuator 617, the linear deployment actuator 642, and the rotary deployment actuator 644), and the description is not repeated extensively here.

As those of skill in the art will appreciate, the control subsystem 708, in certain embodiments, is in operable communication with a computer network 815, so that the control subsystem 708 may receive target information 755 and/or other messages that the control subsystem 708 may use and/or process to control either or both of the internal antenna system and the external antenna system 704. Although not specifically shown in FIG. 8, in certain embodiments, the control subsystem 708 is implemented separately and/or remotely from the internal antenna system 702 and is configured to communicate wirelessly with one or more of the components shown in the system 800 (including but not limited to one or more of the power and microwave source(s) 706, the beam generation subsystem 710, the dual azimuth drive assemblies 902, the azimuth mechanical control subsystem 744, and the elevation/polar mechanical control subsystem 742). In certain embodiments, the control subsystem 708 is disposed within the trailer enclosure 602 and is configured to communicate one or more of its control signals 709 (e.g., one or more of the azimuth control 709A, the elevation/polar control 709B, the beam generation control 709C, and the azimuth drive control 709D) wirelessly. In certain embodiments, the control subsystem 708 is operably coupled via one or more wired connections to communicate one or more of the aforementioned control signals 709. The control subsystem 708, in certain embodiments, is configured to communicate via a mixture of wired and wireless communications. Additionally, as will be appreciated, in certain embodiments, there may be a plurality of control subsystems 708, whether located within the trailer enclosure 602 or remote to the trailer enclosure, each control subsystem 708 providing certain of the control signals 709.

In certain embodiments, the control subsystem 708 is configured to automatically control, based on the target information 755, the beam generation subsystem 710 (e.g., via beam generation control 709C), where the beam generation control 709C is configured to control one or more characteristics of the beam 723 that is provided to the external antenna system 704. In certain embodiments, the control subsystem 608 is configured to automatically control a position of the azimuth turret 612 (or the position of any rotatable support structure used in the system 800), such as via turret control 709E. In certain embodiments, the control subsystem is configured to automatically control a position of at least one of the elevation reflector 604 (e.g., via elevation/polar control 709B) and a position of the azimuth reflector 606 (e.g., via azimuth control 709A and/or azimuth drive control 709D).

Figure 9:
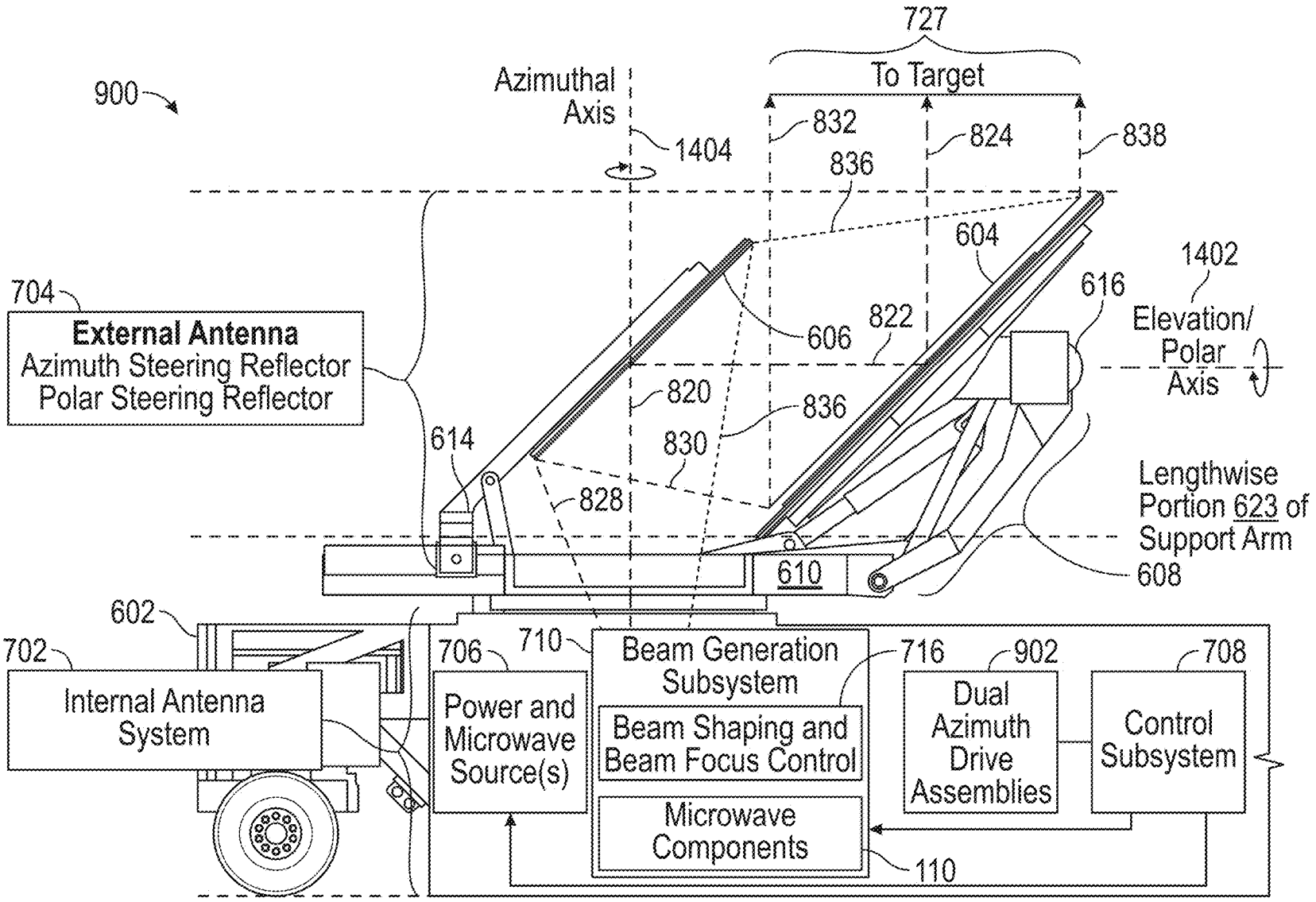
FIG. 9 is a simplified side cross-sectional view of the tactical HPM system of FIG. 3, showing simplified block diagram views of a portion of the electronic assemblies inside the trailer enclosure, including the internal antenna system and external antenna system, and depicting an exemplary reflection pattern of the HPM beam, in accordance with one embodiment.

In certain embodiments, one or more components of the elevation/polar mechanical control subsystem 742 are operably coupled to the azimuth turret 612. For example, in certain embodiments, the elevation/polar support arm 608 is operably coupled to the azimuth beam steering turret mechanism 610 including azimuth turret 612 (e.g., as shown in FIGS. 3 and 4, as well as FIG. 8 and FIGS. 18B-18I) to help the elevation/polar reflector 604 maintain an appropriate orientation, during both stowing and deployment. In certain embodiments, the elevation/polar reflector 604 is operably coupled to the azimuth turret 612 via the polar reflector deployment mechanism and elevation/polar support arm 608, e.g., as shown in FIGS. 3 and 9 herein. Similarly, in certain embodiments, the azimuth reflector 606 is operably coupled to the azimuth turret 612 via the azimuth reflector deployment mechanism and azimuth support arm 614, as shown in FIGS. 3 and 9 herein.

The linear deployment actuator 642, in combination with the elevation steering head tilt actuator 617 (also referred to herein as elevation beam steering head tilt actuator 617), helps to deploy the elevation/polar reflector 604 (e.g., as shown in FIG. 4 as well as FIGS. 18B-18I, described further above) and helps to achieve stowed and deployed orientations of the elevation/polar reflector 604 at its end range of motion. The elevation beam steering drive 616 works to rotate elevation/polar reflector 604 to achieve mechanical beam pointing to any point in a full hemispheric sky dome. For example, in certain embodiments, the elevation steering head tilt actuator 617 rotates the elevation/polar reflector 604 and its drive about a different axis than is accomplished with the linear deployment actuator 642 to drive the elevation/polar reflector 604 into its final operating position and also its final stow position. In certain embodiments, the elevation beam steering drive 616 is implemented using an elevation drive assembly having a direct drive motor (not shown in FIG. 8).

As will be understood, the direct drive motor is selected and configured based on the weight and mass distribution of the components it is moving and environmental loading such as wind-induced forces and moments.

Referring still to FIG. 8, the azimuth mechanical control subsystem 744 is responsive to one or more azimuth control signals (e.g., azimuth control 709A) (from the control subsystem 708) to control movement of the azimuth reflector 606. In certain embodiments, the one or more azimuth control signals (e.g., azimuth control 709A) may, if appropriate, include a command to cause the azimuth reflector 606 to move automatically to a stowed position (e.g., as shown in FIGS. 6, 18B herein). The azimuth mechanical control subsystem 744 includes an azimuth reflector deployment mechanism and azimuth support arm 614, a rotary deployment actuator 644, and the azimuth beam steering turret mechanism 610 (which is operably coupled to azimuth turret 612). In certain embodiments, the rotary deployment actuator 644 is implemented using a single degree of freedom canted rotary drive 611 that is in operable communication with dual azimuth drive assemblies 902 that, in certain embodiments, are disposed within the trailer enclosure 602. This arrangement provides a favorable bearing reaction load on the azimuth reflector 606, which provides superior rigidity of the azimuth reflector 606 in comparison with prior art hinge type mechanisms having a comparable range of motion. For example, in certain embodiments, the azimuth reflector 606 deployment utilizes a large diameter slewing bearing in a nontypical canted arrangement that provides superior deployed rigidity and low-profile stowing capability in a single degree of freedom mechanism. The motion of this large diameter slewing bearing in its nontypical canted arrangement is demonstrated in FIGS. 12A through 12F, discussed further herein, which show the motion of the azimuth reflector 606 that is accomplished via its single degree of freedom canted rotary drive 611. In certain embodiments, the dual azimuth drive assemblies 902 are responsive to an azimuth drive control 709D from the control subsystem 708.

In certain embodiments, the elevation/polar mechanical control subsystem and the azimuth mechanical control subsystem 744 are constructed and arranged for maximum rigidity in the deployed position of the elevation/polar reflector 604 and the azimuth reflector 606. In certain embodiments, the rotation of the elevation/polar reflector 604 and the azimuth reflector 606 is controlled via use of adjustable hard stops that set repeatable end points with no play. Thus, in certain embodiments, the design of some or all of the mechanisms of the elevation/polar mechanical control subsystem 742 and azimuth mechanical control subsystem 744 is configured to be stiffness driven to help ensure repeatable and consistent orientation between the elevation/polar reflector 604 and the azimuth reflector 606, which helps to ensure high aperture efficiency (e.g., 80-90%) of the rotating, beam-steering pair of reflectors (i.e., the elevation/polar reflector 604 and the azimuth reflector 606). In certain embodiments, one or more azimuth drive assemblies (e.g., dual azimuth drive assemblies 902) are provided within the trailer enclosure 602, alongside or as part of the internal antenna system 702, to drive the azimuth mechanical control subsystem 744. As those of skill in the art will appreciate, the dual azimuth drive assemblies 902 are operably connected to the azimuth mechanical control subsystem 744.

Referring still to FIG. 8, the external antenna system 704 receives incoming beams via an opening in the trailer enclosure 602 that houses the internal antenna system 702. For example, in the illustrated embodiment of FIG. 8, the beams travel through an environmental window 722 that is transparent to RF, and which can withstand the power contained within the beams. For example, in some embodiments, the environmental window 722 is made from materials similar to those used for radomes for microwave antennas, e.g., certain thermoplastics and/or plastics such as polyurethane, polyurethane foam, composite materials such as fiberglass, quartz, and aramid fibers held together with polyester, epoxy, and other resins, glass, and any material with a low dielectric constant and able to withstand the high power microwave signals.

The internal antenna system 702 of FIG. 8 includes a control subsystem 708 that is in operable communication with one or more power and microwave source(s) 706, the beam generation subsystem 710, dual azimuth drive assemblies 902, the elevation/polar mechanical control subsystem 742, and the azimuth mechanical control subsystem 733. In certain embodiments, the control subsystem 708 provides an azimuth control 709A to the azimuth mechanical control subsystem 744, an elevation/polar control 709B to the elevation/polar mechanical control subsystem 742, a beam generation control 709C to the beam generation subsystem 710, and an azimuth drive control 709D to the dual azimuth drive assemblies 902. The control subsystem 708, in certain embodiments, is implemented using one or more computer systems, e.g., like those shown and described in FIG. 27 herein (discussed further below). The one or more power and microwave source(s) 706, in certain embodiments, are implemented as described previously in connection with FIG. 7. In the embodiment of FIG. 8, the one or more power and microwave sources(s) 706 are configured for routing and distribution to the beam generation subsystem 710 and its components (e.g., one or more microwave components 110 as well as a beam shaping and beam focus control subsystem 716).

As will be understood by those of skill in the art, the spacing between the reflectors and/or the shapes of the reflectors are determined by the RF characteristics required in a given application and will have different three-dimensional (3-D) curvatures depending on the specific design. The beam 723 that is output through the environmental window 722 then reaches the external antenna system 704, where the beam 723 first reaches the azimuthal reflector 606 (which, along with the elevation/polar reflector 604, acts as a steering reflector on the received beam 723). As shown in FIGS. 9 and 12A-14I (discussed previously above), in certain embodiments, the azimuth reflector 606 and the elevation/polar reflector 604 are each rotating, simultaneously, in respective ways, while maintaining required orientations. In addition, as shown in FIGS. 9 and 12A-14I, in certain embodiments, one of the azimuth reflector 606 and the elevation/polar reflector 604 can be rotating (e.g., about its respective axis) while the other reflector may or may not be rotating about its respective axis. As shown in FIG. 11, the azimuth reflector 606 is configured to rotate on a first rotational axis, shown as azimuth rotation axis 1404 in FIG. 9. The elevation/polar reflector 604 is configured to rotate on a second rotational axis, the polar/elevation rotation axis 1402, where, in certain embodiments the polar/elevation rotation axis 1402 is orthogonal to the azimuth rotation axis 1404 (although this is not required). In certain embodiments, it has been found that two reflectors (e.g., the elevation/polar reflector 604 and the azimuth reflector 606), rotating on orthogonal axes, is the simplest configuration that is physically possible to achieve full-skydome coverage. For example, in certain embodiments, the beam 727 to target is configured to rapidly scan the entire skydome with minimal beam degradation in any direction.

As previously discussed, FIG. 14B-FIG. 14H illustrate, the azimuth turret rotates about its azimuth rotational axis 1404, e.g., the Y axis, when the external antenna system 704 steers the final beam (and both elevation/polar reflector 604 and azimuth reflector 606) in azimuth to the target 760. The azimuth reflector 606 is raised and lowered during rotation, until it reaches the deployment operational position and does not see RF energy until it is in the deployed configuration (e.g., the configuration shown in FIG. 14D). Similarly, the elevation/polar reflector is raised and rotates about its azimuth rotational axis 1404. These rotations can best be illustrated in these figures by comparing the relative positions of the elevation/polar reflector 604 and azimuth reflector 606 in FIG. 12J with the positions of these same reflectors in FIG. 12K, using reference rotation point A 1805, in both figures. Assume in these examples that, in an x-y coordinate system, the y-axis runs vertically, flat against the page, and an x axis runs horizontally, flat against the page, such that rotation around the x-axis and y-axis both partially would appear to rotate out of the page and back in (e.g., as shown for the axis in FIG. 9). Comparing FIG. 12J and FIG. 12K, the azimuth reflector 606 has moved approximately 60 degrees counterclockwise along the azimuth rotational axis 1404, which corresponds approximately to a y-axis in the images, in a direction that rotated towards the reader. It also can be seen, by comparing reference rotation point A 1805, that the elevation/polar reflector 604 rotated along an x-axis, in a counterclockwise direction "out" of the page, toward the reader, from FIG. 12J to FIG. 12K. FIGS. 13A-13H, discussed previously herein, more particularly discuss the motion of the elevation/polar reflector 604. FIGS. 14A-14I, discussed previously herein, more particularly discuss azimuthal rotation.

Another advantage of the above-described rotations of the azimuth reflector 606 and the elevation/polar reflector 604 is that the beam 727 of the elevation/polar output (i.e., the beam to target 760) achieves axisymmetry of both power density and phase, which assures invariant equivalent isotropic radiated power (EIRP) in all beam directions. This is also explained further in connection with FIG. 12, discussed further herein.

Figure 10:
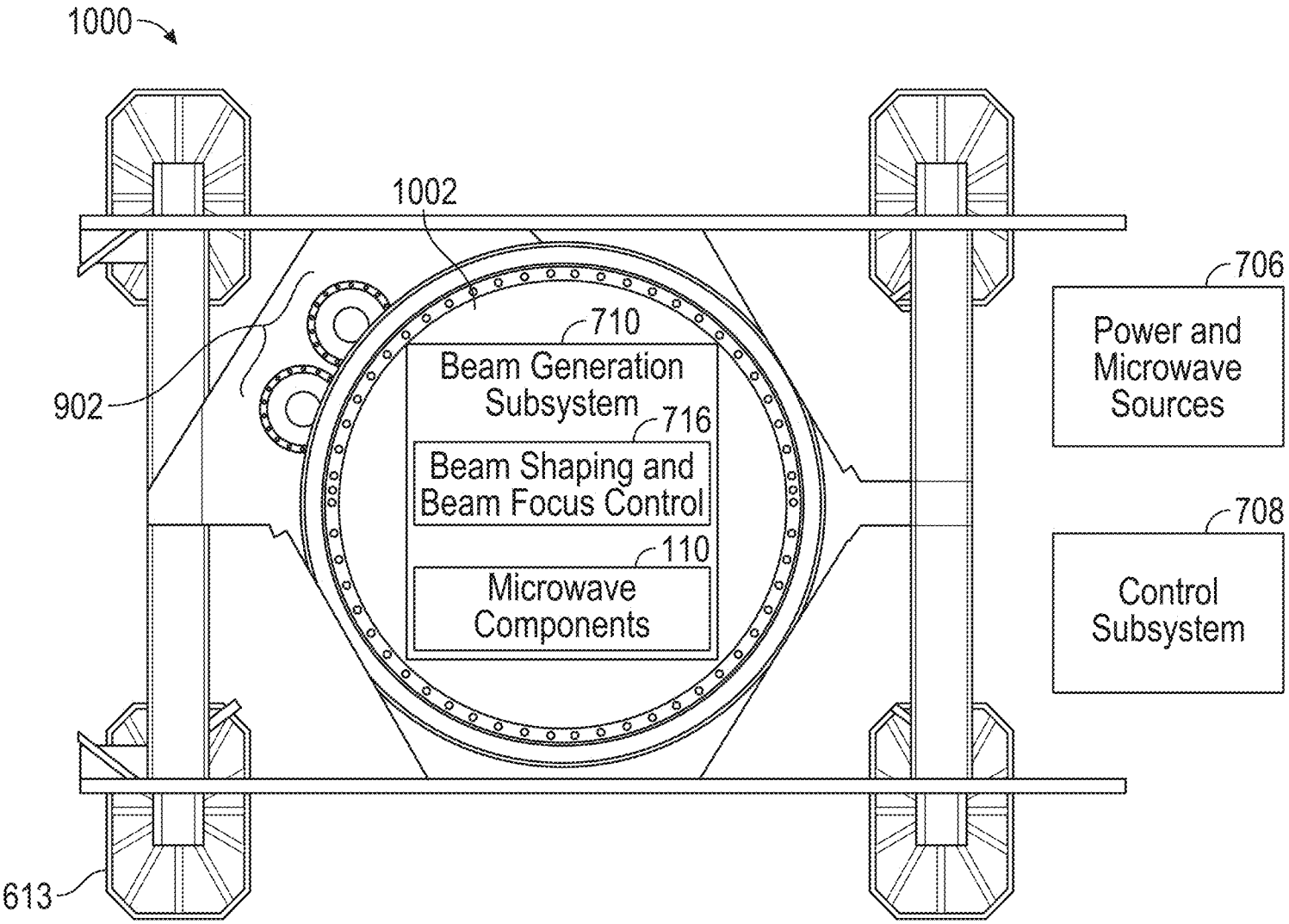
FIG. 10 is a simplified top-down view of a portion of the electronic assemblies inside the shelter of FIG. 9, in accordance with one embodiment.

Reference is now made briefly to FIGS. 9-11, which show an exemplary embodiment of aspects of the system of FIGS. 3, 7 and 8, in accordance with one embodiment. For example, FIG. 9 is a simplified side cross-sectional view 900 of the tactical HPM system of FIG. 3 and of FIGS. 7 and 8, showing simplified block diagram views of a portion of the electronic assemblies inside the trailer enclosure 602, including the internal antenna system 702 and external antenna system 704, and depicting an exemplary reflection pattern of the HPM beam 850, in accordance with one embodiment. FIG. 9 also shows a simplified side cross-sectional view 900 of the layout of an exemplary system implementation of the system of FIGS. 7 and 8. As FIG. 9 shows, the internal antenna system 702 (as previously discussed in connection with FIG. 8) is housed within the trailer enclosure 602. The components shown in FIG. 9 are similarly numbered to and correspond to the same elements as shown in FIGS. 3, 7, and 8, so the description is not repeated here. FIG. 9 helps to illustrate more fully the movement of the beam from the internal antenna system 702 to the external antenna system 704. As FIG. 9 shows, having the internal antenna structure integral to the trailer enclosure 602 helps to minimize redundant structures and reduce system size and weight.

For example, referring to FIG. 9, the beam generation subsystem 710 is an axisymmetric beam having high aperture efficiency and a uniform power density distribution with required characteristics needed to reach a target, based on target information 755 and is configured to be reflected onto the azimuth reflector 606, then to the elevation/polar reflector 604, then to the target via beam 727 at three locations, as shown in FIG. 9. Three beam paths, designated by a dotted line (path sections 834, 836, and 838), a short dashed line (beam path sections 828, 830, and 832) and a long dashed line (beam path sections 820, 822, and 824) are illustrative examples of the path of the beam as it passes from the output of the internal antenna system 702 to the external antenna system 704 and its shaped reflector stage/subsystem (formed by the azimuth reflector 606 and the elevation/polar reflector 604), to be output as beam 727 to the target.

Advantageously, the layout of the components inside the internal antenna system 702 shares volume within the trailer enclosure 602 with other mechanical structures and is selected to make use of the space and meet the aforementioned height requirements.

FIG. 10 is a simplified top down view 1000 of a portion of the electronic assemblies inside the shelter of FIG. 9, showing locations of the beam generation subsystem 710 related to an opening 1002 of the environmental window 722 and also relative to the dual azimuth drive assemblies 902, which, in this example embodiment, occupy one corner of the assembly. In certain embodiments, these dual azimuth drive assemblies 902 may be in operable communication with the azimuth mechanical control subsystem 744.

In certain embodiments, as discussed further herein, the new approach to shaped reflector design discussed herein, as well as the improved stiffness/rigidity of the supports for the reflectors, can help enable aperture efficiencies of 80-90% to be achieved with rotating, beam-steering reflectors. In addition to allowing reflector rotation with a non-Gaussian beam, the design of the shaped-reflector design stage/subsystem enhances control of spillover radiation in the external antenna system 704 around the elevation/polar reflector 604 by more precisely limiting the beam. The result is a mobile HPM antenna design with stowable beam-steering reflectors that puts 30-40% higher power density on target with lower spillover radiation than was previously possible.

Figure 15A:
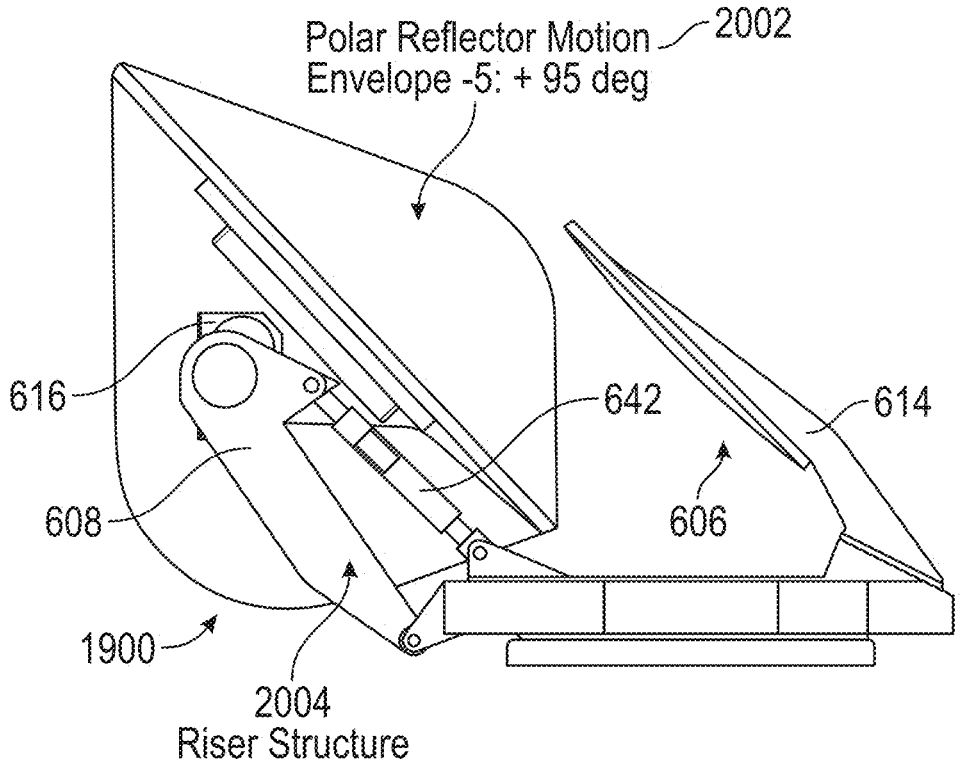
FIG. 15A is a side view of an elevation/polar reflector motion envelope for the elevation reflector of the tactical HPM system of FIG. 3, in accordance with one embodiment.
Figure 15B:
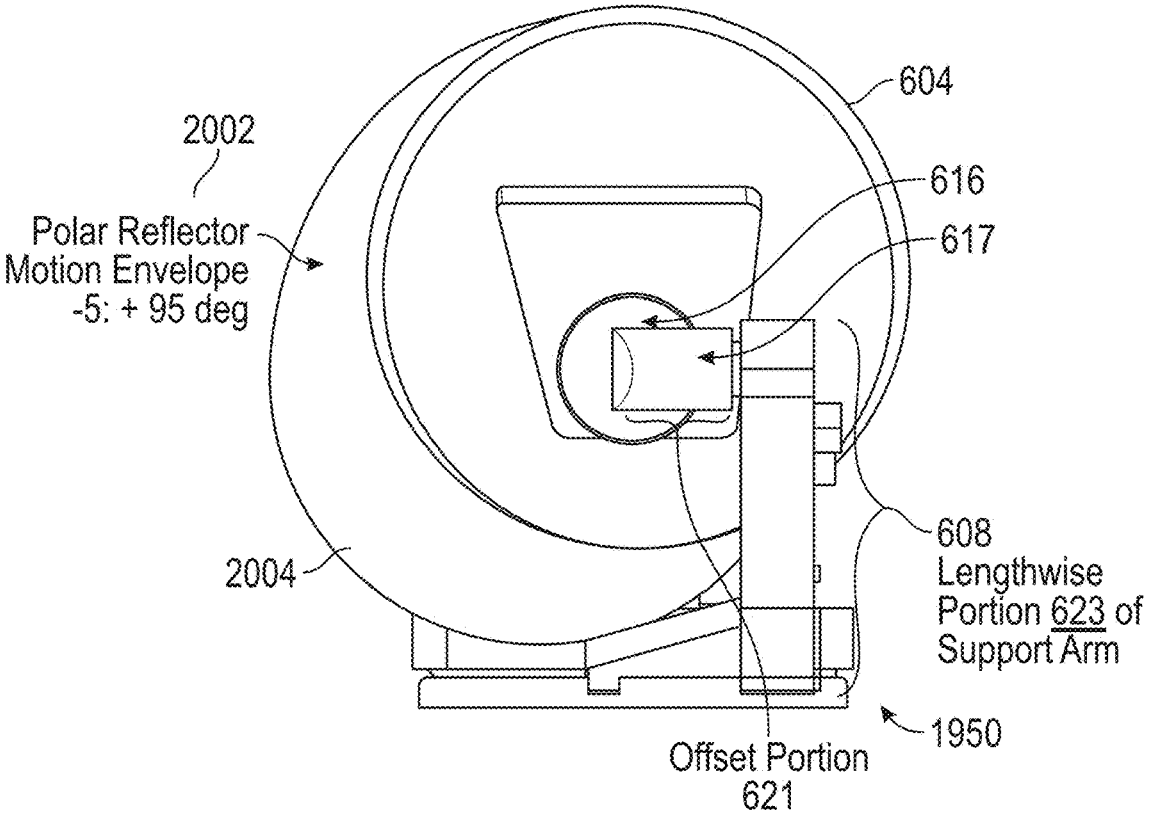
FIG. 15B is a first rear view of the elevation/polar reflector motion envelope for the elevation/polar reflector of the tactical HPM system of FIG. 3, in accordance with one embodiment.
Figure 15C:
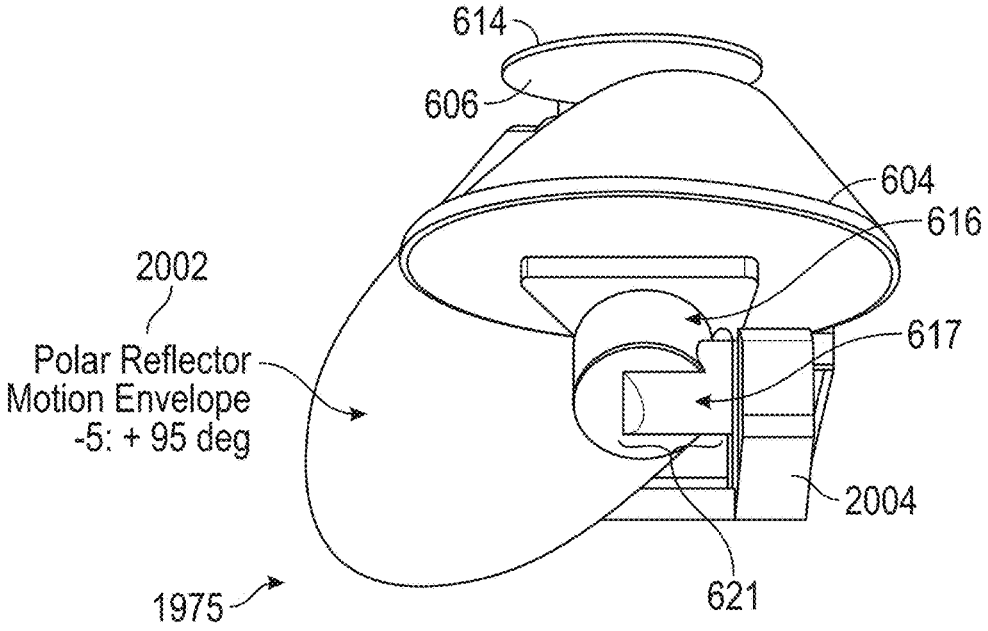
FIG. 15C is an auxiliary view of the elevation/polar reflector motion envelope for the elevation/polar reflector of the tactical HPM system of FIG. 3, in accordance with one embodiment.

FIG. 15A is a side view 1900 of an elevation/polar reflector motion envelope for the elevation/polar reflector 604 of the tactical HPM system 600 of FIG. 3, in accordance with one embodiment, FIG. 15B is a rear view 1950 of the elevation/polar reflector motion envelope for the elevation/polar reflector 604 of the tactical HPM system 600 of FIG. 3, in accordance with one embodiment, and FIG. 15C is an auxiliary view 1975 of the elevation/polar reflection motion envelope for the elevation/polar reflector 604 of the tactical HPM system 600 of FIG. 3, in accordance with one embodiment. FIGS. 15A-15C help to illustrate more particularly certain components that help to move the elevation/polar reflector 604, during its operation, deployment, and/or stowing, such as the elevation/polar support arm 608 and the elevation beam steering drive, 616, as well as the linear deployment actuator 642. FIGS. 15B-15C also show the unique offset portion 621 of the elevation/polar support arm 608, wherein the offset portion 621 provides several advantageous operational aspects to the support arm. The offset portion 621, allows clearance of the elevation/polar reflector 604 at extreme look angles, The offset portion 621 also reduces stowed height of the elevation/polar reflector 604 is stowed (e.g., as shown in FIG. 6 and especially in FIG. 14A), because the offset portion 621 is configured to be beside the elevation/polar reflector 604 when folded to be stowed, not underneath the elevation/polar reflector 604.

As FIG. 15A, FIG. 15B, and FIG. 15C show, the elevation/polar reflector 604 has motion envelope 2004 of −5° to +95°, which limits the polar/elevation motion to one side. Limiting elevation to one side (i.e., the −5° to 95°) provides full hemisphere coverage, in certain embodiments. Limiting the motion of the elevation/polar reflector 604 allows a tilt joint in the elevation/polar mechanical control subsystem (e.g., the elevation steering head tilt actuator 617) to move toward the azimuth axis (see FIG. 11), which increases space for stowing the elevation/polar reflector 604. In addition, limiting elevation to one side also allows for sufficient structure of the pedestal. If, instead the motion of the elevation/polar reflector 604 were allowed to be 0° to 180°, then the movement of the elevation/polar reflector 604 would cut through most of the elevation/polar support arm structure 609. Thus, the −5° to +95° range of motion for the elevation/polar reflector 604 provides the best structural support while minimizing stowed height.

Figure 16:
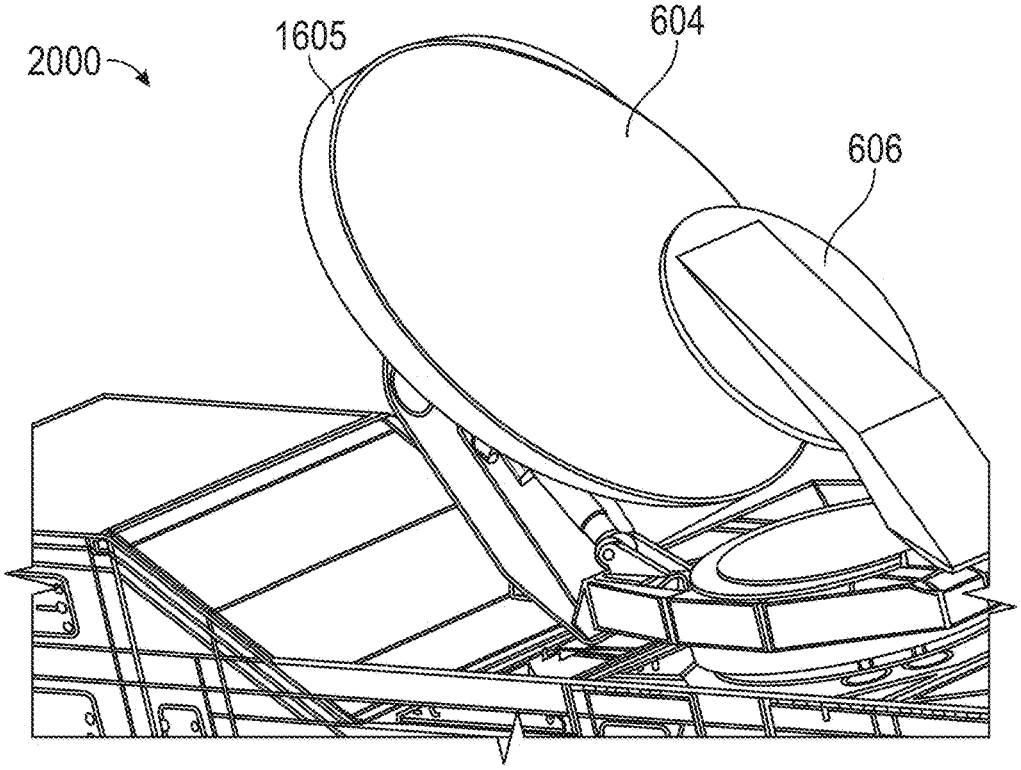
FIG. 16 is an exemplary illustration of a first motion envelope of the elevation/polar reflector of the tactical HPM system of FIG. 3, in accordance with one embodiment.
Figure 17:
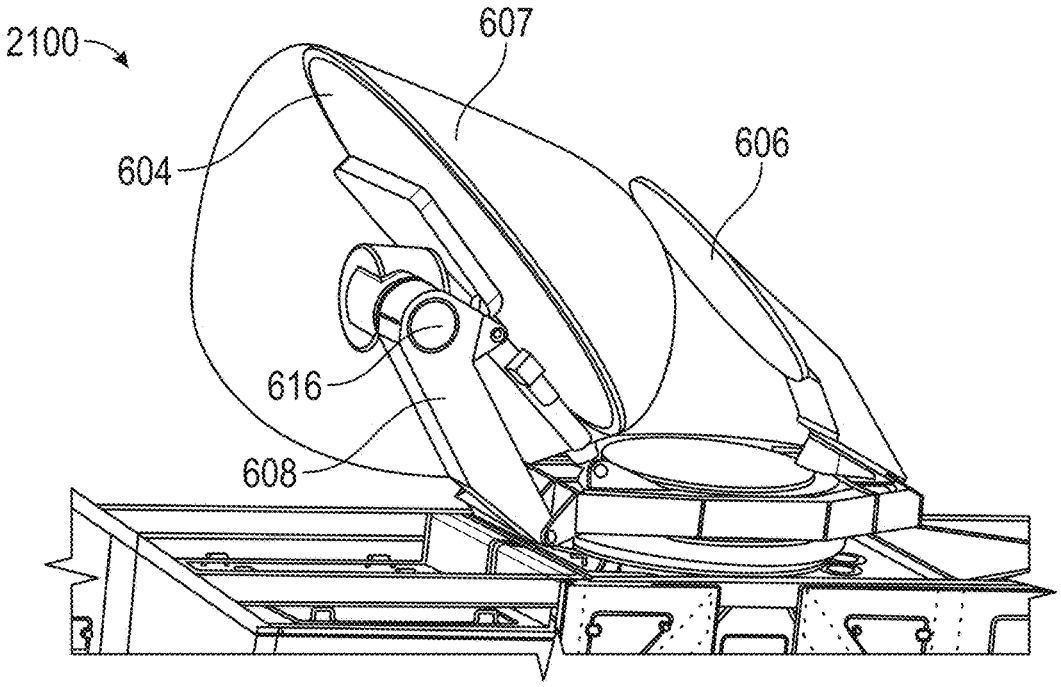
FIG. 17 is an exemplary illustration of a second motion envelope of the elevation/polar reflector of the tactical HPM system of FIG. 3, in accordance with one embodiment.

FIG. 16 is an exemplary illustration 2000 of a first motion envelope 1605 of the elevation/polar reflector 604 of the tactical HPM system 600 of FIG. 3, in accordance with one embodiment. The first motion envelope 1605, which is a small envelope, as FIG. 16 illustrates, shows the area covered by the elevation/polar reflector 604 when it rotates −5 degrees. FIG. 17 is an exemplary illustration 2100 of a second motion envelope 607 of the elevation/polar reflector 604 of the tactical HPM system 600 of FIG. 3, in accordance with one embodiment. The second motion envelope 607 shows the area covered by the elevation/polar reflector 604 when it rotates +95 degrees.

Figure 18:
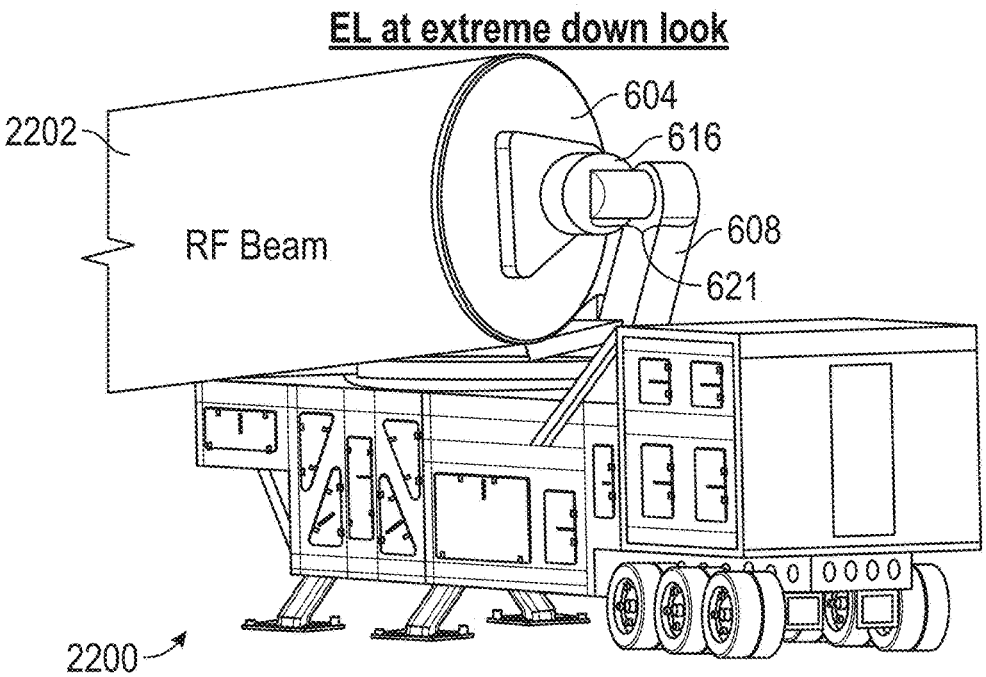
FIG. 18 is an exemplary illustration of the tactical HPM system of FIG. 3 showing the path of an RF beam from the elevation/polar reflector at an extreme down look position, in accordance with one embodiment.

FIG. 18 is an exemplary illustration 2200 of the tactical HPM system of FIG. 3 showing the path of an RF beam 2202 from the elevation/polar reflector 604 at an extreme down look position, in accordance with one embodiment. FIG. 18 (as well as FIG. 15B and FIG. 15C) also illustrates how the elevation/polar support arm 608 and elevation beam steering drive 616 position the elevation/polar reflector 604 at a position that is offset from the support arm (see offset portion 621). This offset portion 621 of the elevation/polar support arm 608 allows clearance of the elevation/polar reflector at extreme looking angles, like the extreme down look of FIG. 18. This offset portion 621 (which is also depicted in FIG. 15B and FIG. 15C) helps to allow the elevation/polar reflector 604 to have enough space to rotate through, without having to run into other equipment, which is a challenge because the elevation/polar reflector 604 often is a rather large reflector, which needs space for movement. In addition, the offset portion 621 of the elevation/polar support arm 608 also provides unique and important advantages in at least some embodiments, because the offset portion 621 of the elevation/polar support arm 608 allows efficient stowing of the elevation beam steering head tilt actuator 617, where the elevation beam steering head tilt actuator 617 is stowed beside the elevation/polar support arm 608 (e.g., as shown in FIG. 14A), rather than on top of it, reducing overall stowed envelope.

Figure 19:
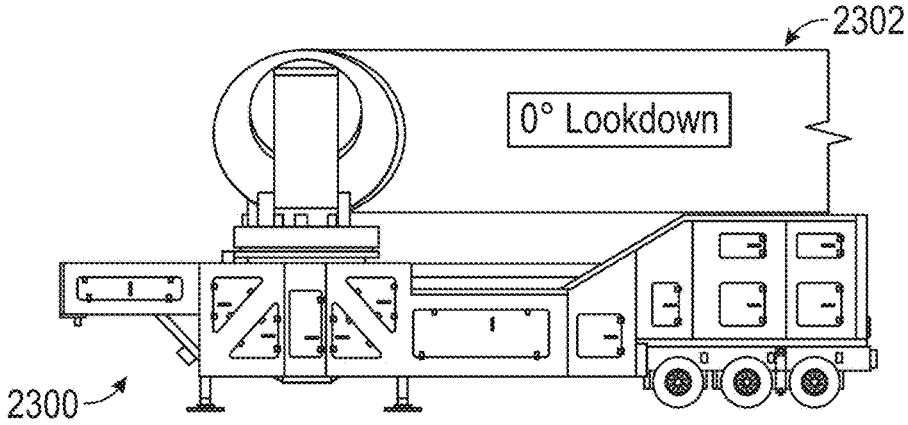
FIG. 19 is a first illustration showing a first RF beam envelope of the polar/elevation reflector of the tactical HPM system of FIG. 3 when the elevation/polar reflector is configured for 0-degree lookdown, in accordance with one embodiment.
Figure 20:
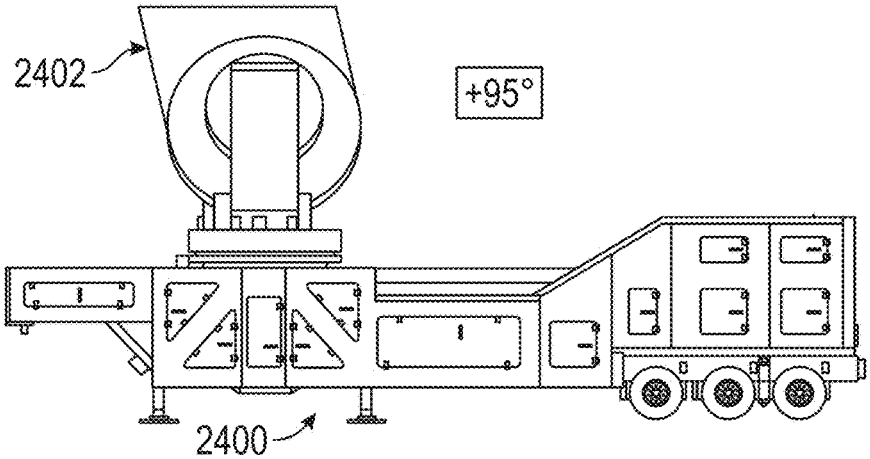
FIG. 20 is a second illustration showing a second RF beam envelope of the polar/elevation reflector of the tactical HPM system of FIG. 3 when the elevation/polar reflector is configured for 95 degree beam elevation angle from horizon, in accordance with one embodiment.

FIG. 19 is a first illustration 2300 showing a first RF beam envelope 2302 of the elevation/polar reflector 604 of the tactical HPM system 600 of FIG. 3 when the elevation/polar reflector 604 is configured for 0 degree lookdown, in accordance with one embodiment. FIG. 20 is a second illustration 2400 showing a second RF beam envelope 2402 of the elevation/polar reflector 604 of the tactical HPM system 600 of FIG. 3 when the elevation/polar reflector 604 is configured for 95 degree beam elevation angle from horizon, in accordance with one embodiment.

As FIGS. 3-20 demonstrate and describe, at least some embodiments of an HPM system, including HPM antenna pedestal, as described herein, are configured to minimize stowed volume to allow a very large antenna system (e.g., the shaped reflector stage/subsystem 704 of FIG. 3) to fit inside a cargo vehicle, such as a military C-17 aircraft, for aircraft transport, and ready transportability to where the HPM system is needed. As shown at least in FIGS. 3, 6, and 14A, at least some embodiments provide a stowed configuration that nests its large external reflectors (e.g., the elevation/polar reflector 604 and the azimuth reflector 606, as well as the reflectors contained within the internal antenna system) into the trailer enclosure 602 for efficient size reduction that supports air, road and sea transport. As FIGS. 14A-14*h* illustrate, the tactical HPM system 600 of FIG. 3 is readily deployable and provides rapid "shoot and move" capability which has not been demonstrated in any existing HPM system. The low-profile stowed volume is achieved through the implementation of several novel mechanisms.

As noted above in FIGS. 14*a*-20, full elevation beam steering coverage (−5° to +95°) with a large 16'×10' polar main reflector is achieved by the unique offset portion 621 of the elevation/polar support arm 608 and by the deployment mechanisms for the elevation/polar reflector 604 (e.g., the elevation/polar mechanical control subsystem 742) and for the azimuth reflector (e.g., the azimuth mechanical control subsystem 744). In at least some embodiments herein, as noted above, the deployment of the azimuth reflector 606 utilizes a large diameter slewing bearing in a nontypical canted arrangement that provides superior deployed rigidity and low-profile stowing capability in a single degree of freedom mechanism. Further, the stage/subsystem of shaped reflector optics, as discussed above especially in connection with FIGS. 7-9 and FIGS. 11-13, maximizes antenna efficiency of the tactical HPM system 600 while minimizing RF energy spillover.

Those of skill in the art will appreciate that some or all of the functions and operations described herein may be automatically controlled as part of one or more computer-implemented methods, with or without user interaction. For example, FIG. 21 is a flowchart of a process 2500 usable with the tactical HPM system of FIG. 3, which may be implemented using a computer system, such as that described further herein in connection with FIG. 22.

Figure 21:
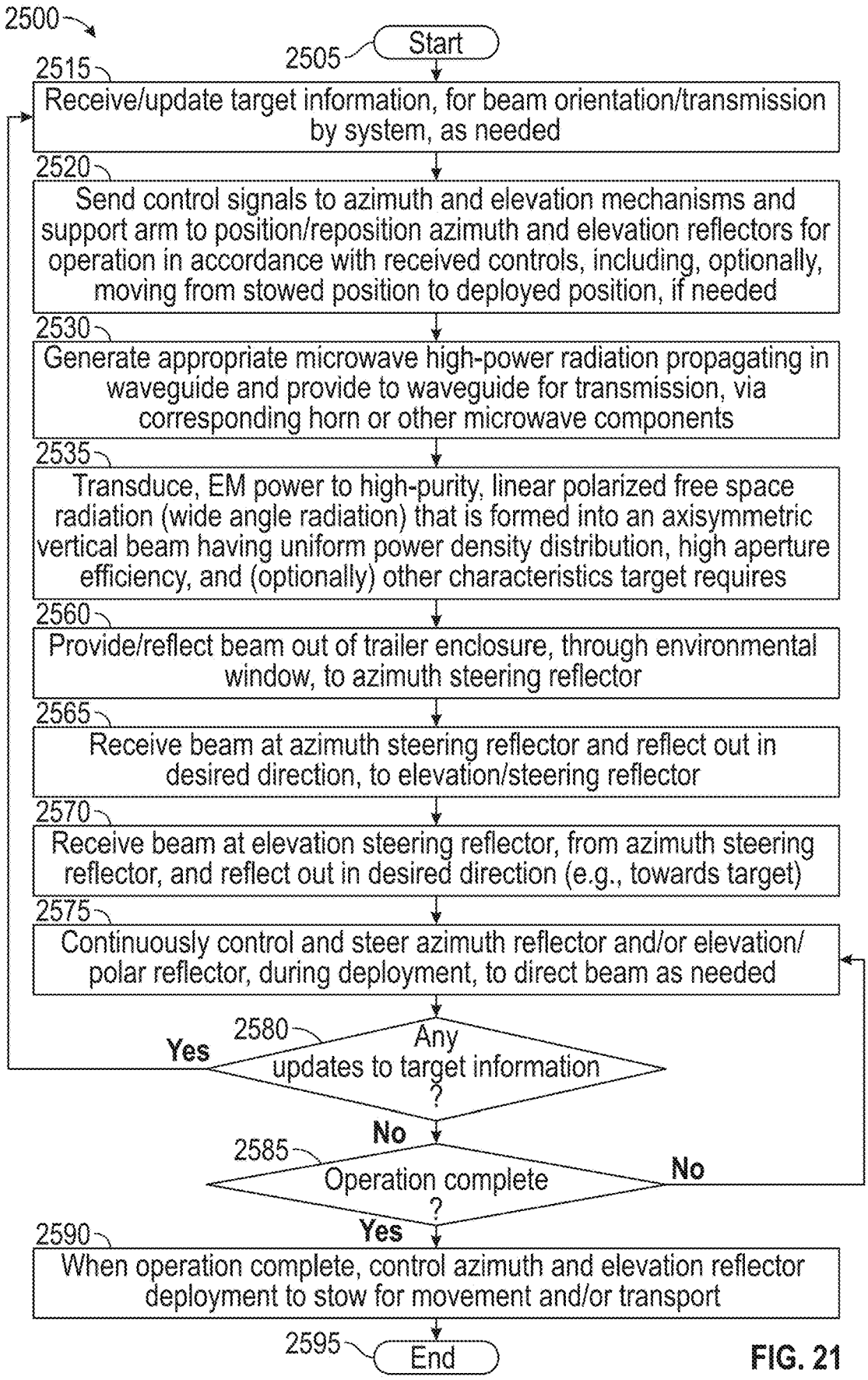
FIG. 21 is a flowchart of a process usable with the tactical HPM system of FIG. 3.

Referring first to FIG. 21, as well as the system of FIG. 3 and the simplified functional block diagrams of the HPM system 700 of FIG. 7 and the system 800 of FIG. 8, at the start (block 2505), the system receives target information 755 for beam orientation and/or orientation for transmission by the system (block 2515). Note that, during ongoing operation, this may correspond to updated target information and/or orientation (see below in connection with block 2580). Based on that received information, control signals 709 (e.g., one or more of the azimuth control 709A, elevation/polar control 709B, beam generation control 709C, and azimuth driver control 709D) are sent to corresponding component (e.g., the azimuth and elevation mechanisms (e.g., the elevation/polar mechanical control subsystem 742 and/or the azimuth mechanical control subsystem 744), the elevation/polar mechanical control subsystem 742, the beam generation subsystem 710, and the dual azimuth drive assemblies, 902, respectively) to position the azimuth reflector 606 and the elevation/polar reflector 604 to receive a beam for operation (block 2520). In accordance with the received target information, appropriate microwave high power radiation is generated for propagating in a waveguide and is provided to a waveguide (or other appropriate microwave component) for transmission, via a corresponding horn (e.g., in the beam generation subsystem 710) or other microwave components (block 2530), for propagation from the internal antenna system 702 to the external antenna system 704, as discussed herein.

Appropriate microwave high-power radiation propagating in waveguide is generated (e.g., at the power and microwave source(s) 706) and it is provided to a waveguide for transmission. The horn (or other appropriate component) transduces the EM power to high-purity, linear polarized free-space radiation (e.g., wide angle radiation) that is formed into an axisymmetric vertical beam having uniform power density distribution, high aperture efficiency, and (optionally), other characteristics a target requires (block 2535).

The beam is provided/reflected through environmental window 722, to the azimuth reflector 606 (block 2560). The beam is received at the azimuth reflector 606 and the azimuth reflector 606 (which serves as an azimuth steering reflector) reflects the beam out in a desired direction, to the elevation/polar reflector 604 (block 2565). The beam is received at the elevation/polar reflector 604 (which serves as an elevation steering reflector), from the azimuth reflector 606 (azimuth steering reflector), and reflected out in desired direction (e.g., towards target) (block 2570). During operation, in certain embodiments, the control subsystem 708 automatically and continuously controls and steers the azimuth reflector 606 and/or the elevation/polar reflector 604, during deployment, to direct the beam as needed (block 2575). For example, in certain embodiments, checks are made to determine whether any updates are received relating to target information and/or to orientation of the beam (block 2580). If there are any updates (answer at block 2580 is "YES"), then processing moves back to block 2515. If there are no updates, then a check is made to determine if operation is complete (block 2585). If the answer at block 2585 is "NO," then processing moves to block 2575. If the answer at block 2585 is "YES," then processing moves to block 2590.

In block 2509, the tactical HPM system 600 controls the azimuth reflector and orientation reflector deployment, so that these reflectors are put into a position to be stowed for movement and/or transport (block 2590). Then processing ends (block 2595).

Figure 22:
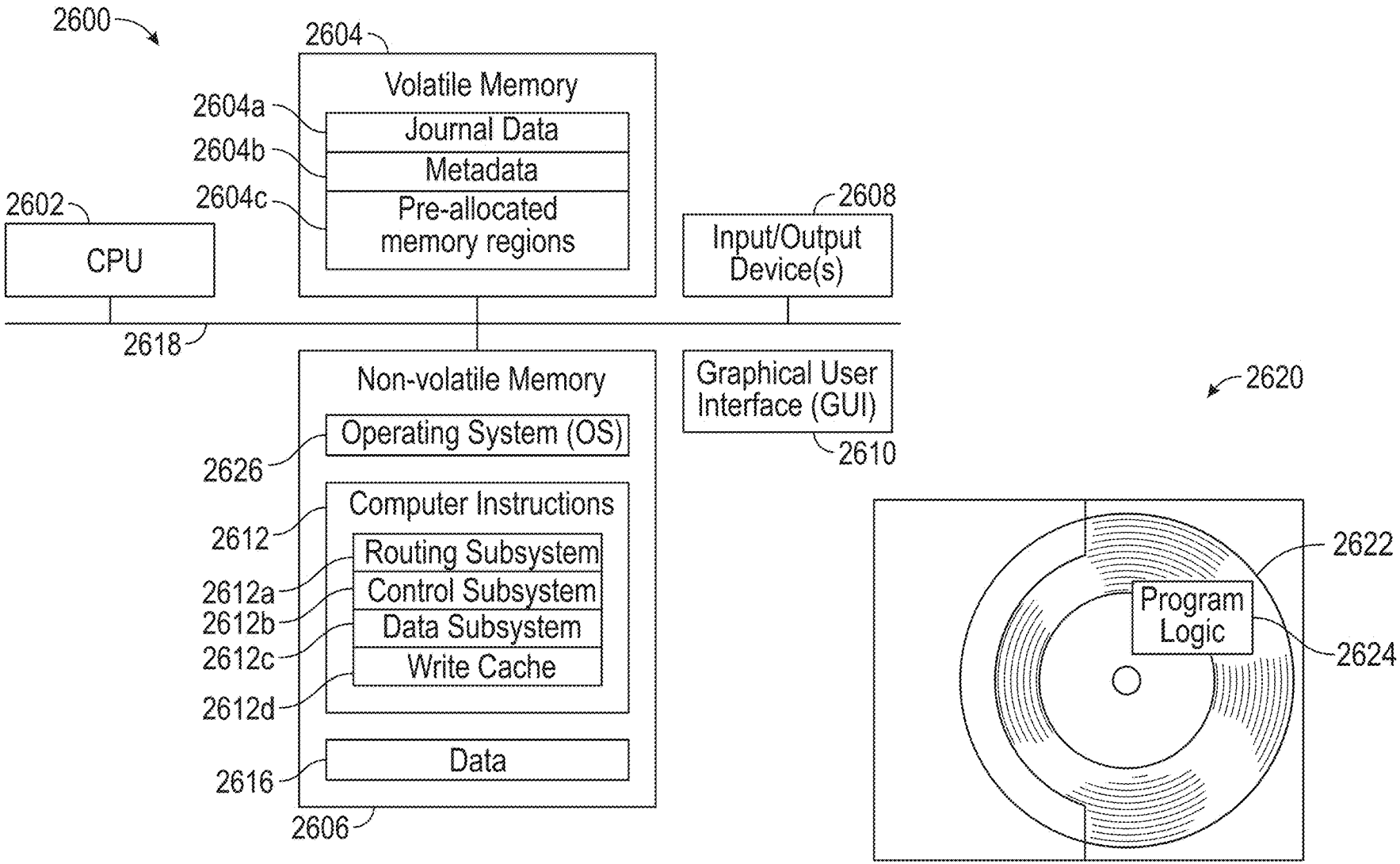
FIG. 22 is a block diagram of an exemplary computer system usable with at least some of the systems, apparatuses, methods and/or operations of FIGS. 3-25, in accordance with one embodiment.

FIG. 22 is a block diagram of an exemplary computer system usable with at least some of the systems, apparatuses, methods and/or operations of FIGS. 3-25, in accordance with one embodiment. As will be understood, at least some portions of the tactical HPM system 600 of FIG. 3 and the corresponding systems, HPM system 700 of FIG. 7 and/or the system 800 of FIG. 8 herein, along with other computations and controls described explicitly and implicitly herein, in certain embodiments, may be accomplished using one or more processors and/or computer systems. FIG. 22 is a block diagram of an exemplary computer system 2600 usable with at least some of the systems, apparatuses, and methods of FIGS. 2-15, in accordance with one embodiment. For example, in some embodiments, the computer system 2600 of FIG. 22 can be usable to accomplish some or all of the processing associated with the transmit channel processing block 446 or the receive channel processing block 456 of FIG. 4, as will be appreciated. The computer system 2600 also can be used to implement all or part of any of the methods, equations, and/or calculations described herein.

As shown in FIG. 22, computer 2600 may include processor/CPU 2602, volatile memory 2604 (e.g., RAM), non-volatile memory 2606 (e.g., one or more hard disk drives (HDDs), one or more solid state drives (SSDs) such as a flash drive, one or more hybrid magnetic and solid state drives, and/or one or more virtual storage volumes, such as a cloud storage, or a combination of physical storage volumes and virtual storage volumes), graphical user interface (GUI) 2610 (e.g., a touchscreen, a display, and so forth) and input and/or output (I/O) device 2608 (e.g., a mouse, a keyboard, etc.). Volatile memory 2604 stores, e.g., journal data 2604*a*, metadata 2604*b*, and pre-allocated memory regions 2604*c*. The non-volatile memory, 2606 can include, in some embodiments, an operating system 2614, and computer instructions 2612, and data 2616. In certain embodiments, the computer instructions 2612 are configured to provide several subsystems, including a routing subsystem 2612A, a control subsystem 2612*b*, a data subsystem 2612*c*, and a write cache 2612*d*. In certain embodiments, the computer instructions 2612 are executed by the processor/CPU 2602 out of volatile memory 2604 to implement and/or perform at least a portion of the systems and processes shown in FIGS. 1-15. Program code also may be applied to data entered using an input device or GUI 2610 or received from output I/O device 2608.

The systems, architectures, and processes of FIGS. 1-26 are not limited to use with the hardware and software described and illustrated herein and may find applicability in any computing or processing environment and with any type of machine or set of machines that may be capable of running a computer program and/or of implementing a radar system (including, in some embodiments, software defined radar). The processes described herein may be implemented in hardware, software, or a combination of the two. The logic for carrying out the methods discussed herein may be embodied as part of the system described in FIG. 22. The processes and systems described herein are not limited to the specific embodiments described, nor are they specifically limited to the specific processing order shown. Rather, any of the blocks of the processes may be re-ordered, combined, or removed, performed in parallel or in serial, as necessary, to achieve the results set forth herein.

Processor/CPU 2602, or any processor used to implement the embodiments included herein, may be implemented by one or more programmable processors executing one or more computer programs to perform the functions of the system. As used herein, the term "processor" describes an electronic circuit that performs a function, an operation, or a sequence of operations. The function, operation, or sequence of operations may be hard coded into the electronic circuit or soft coded by way of instructions held in a memory device. A "processor" may perform the function, operation, or sequence of operations using digital values or using analog signals. In some embodiments, the "processor" can be embodied in one or more application specific integrated circuits (ASICs). In some embodiments, the "processor" may be embodied in one or more microprocessors with associated program memory. In some embodiments, the "processor" may be embodied in one or more discrete electronic circuits. The "processor" may be analog, digital, or mixed-signal. In some embodiments, the "processor" may be one or more physical processors or one or more "virtual" (e.g., remotely located or "cloud") processors.

Various functions of circuit or system elements may also be implemented as processing blocks in a software program. Such software may be employed in, for example, one or more digital signal processors, microcontrollers, or general-purpose computers. Described embodiments may be implemented in hardware, a combination of hardware and software, software, or software in execution by one or more physical or virtual processors.

Some embodiments may be implemented in the form of methods and apparatuses for practicing those methods. Described embodiments may also be implemented in the form of program code, for example, stored in a storage medium, loaded into and/or executed by a machine, or transmitted over some transmission medium or carrier, such as over electrical wiring or cabling, through fiber optics, or via electromagnetic radiation. A non-transitory machine-readable medium may include but is not limited to tangible media, such as magnetic recording media including hard drives, floppy diskettes, and magnetic tape media, optical recording media including compact discs (CDs) and digital versatile discs (DVDs), solid state memory such as flash memory, hybrid magnetic and solid-state memory, non-volatile memory, volatile memory, and so forth, but does not include a transitory signal per se. When embodied in a non-transitory machine-readable medium and the program code is loaded into and executed by a machine, such as a computer, the machine becomes an apparatus for practicing the method.

When implemented on one or more processing devices, the program code segments combine with the processor to provide a unique device that operates analogously to specific logic circuits. Such processing devices may include, for example, a general-purpose microprocessor, a digital signal processor (DSP), a reduced instruction set computer (RISC), a complex instruction set computer (CISC), an application specific integrated circuit (ASIC), a field programmable gate array (FPGA), a programmable logic array (PLA), a microcontroller, an embedded controller, a multi-core processor, and/or others, including combinations of one or more of the above. Described embodiments may also be implemented in the form of a bitstream or other sequence of signal values electrically or optically transmitted through a medium, stored magnetic-field variations in a magnetic recording medium, etc., generated using a method and/or an apparatus as recited in the claims.

For example, when the program code is loaded into and executed by a machine, such as the computer of FIG. 22, the machine becomes an apparatus for practicing one or more of the described embodiments. When implemented on one or more general-purpose processors, the program code combines with such a processor to provide a unique apparatus that operates analogously to specific logic circuits. As such a general-purpose digital machine can be transformed into a special purpose digital machine. FIG. 22 shows Program Logic 2624 embodied on a computer-readable medium 2620 as shown, and wherein the Logic is encoded in computer-executable code configured for carrying out the reservation service process of this invention and thereby forming a Computer Program Product 2622. The logic may be the same logic on memory loaded on processor. The program logic may also be embodied in software modules, as modules, or as hardware modules. A processor may be a virtual processor or a physical processor. Logic may be distributed across several processors or virtual processors to execute the logic.

In some embodiments, a storage medium may be a physical or logical device. In some embodiments, a storage medium may consist of physical or logical devices. In some embodiments, a storage medium may be mapped across multiple physical and/or logical devices. In some embodiments, storage medium may exist in a virtualized environment. In some embodiments, a processor may be a virtual or physical embodiment. In some embodiments, a logic may be executed across one or more physical or virtual processors.

It is also envisioned that any or all of the embodiments described herein and/or illustrated in FIGS. 1-26 herein could be combined with and/or adapted to work with the technologies described in one or more of the following commonly assigned U.S. patent applications and patents, including but not limited to:

- U.S. Pat. No. 11,233,306 entitled, "Duo-quad wideband waveguide combiner/mode-converter transforming two rectangular waveguides in the TE10 rectangular mode to a single circular waveguide output in the TE01 mode," issued on Jan. 25, 2022;
- U.S. Pat. No. 11,245,172, entitled, "Wideband waveguide combiner/mode-converter transforming N rectangular waveguides in the TE10 rectangular mode to a single circular waveguide output in the TE01 mode," issued on Feb. 8, 2022;
- U.S. Pat. No. 7,443,573, entitled, "Spatially-fed high-power amplifier with shaped reflectors," issued on Oct. 28, 2008; and
- U.S. Pat. No. 6,243,047, entitled "Single Mirror Dual Axis Beam Waveguide Antenna System," issued on Jun. 5, 2001.

The above-listed, aforementioned commonly assigned patents and patent publications are hereby incorporated by reference. It should be understood, however, that the disclosed embodiments are not limited to use with the above-listed exemplary systems. The embodiments described herein have numerous applications and are not limited to the exemplary applications described herein. It should be appreciated that such references and examples are made in an effort to promote clarity in the description of the concepts disclosed herein. Such references are not intended as, and should not be construed as, limiting the use or application of the concepts, systems, arrangements, and techniques described herein to use solely with these or any other systems.

For purposes of illustrating the present embodiments, the disclosed embodiments are described as embodied in a specific configuration and using special logical arrangements, but one skilled in the art will appreciate that the device is not limited to the specific configuration but rather only by the claims included with this specification. In addition, it is expected that during the life of a patent maturing from this application, many relevant technologies will be developed, and the scopes of the corresponding terms are intended to include all such new technologies a priori.

In this disclosure, the terms "comprises," "comprising", "includes", "including", "having" and their conjugates at least mean "including but not limited to". As used herein, the singular form "a," "an" and "the" includes plural references unless the context clearly dictates otherwise. Various elements, which are described in the context of a single embodiment, may also be provided separately or in any suitable subcombination. It will be further understood that various changes in the details, materials, and arrangements of the parts that have been described and illustrated herein may be made by those skilled in the art without departing from the scope of the following claims.

Throughout the present disclosure, absent a clear indication to the contrary from the context, it should be understood individual elements as described may be singular or plural in number. For example, the terms "circuit" and "circuitry" and "module" may include either a single component or a plurality of components, which are either active and/or passive and are connected or otherwise coupled together to provide the described function. Within the drawings, like or related elements have like or related alpha, numeric or alphanumeric designators. Further, while the disclosed embodiments have been discussed in the context of implementations using discrete components, including some components that include one or more integrated circuit chips), the functions of any component or circuit may alternatively be implemented using one or more appropriately programmed processors, depending upon the signal frequencies or data rates to be processed and/or the functions being accomplished. Similarly, in addition, in the Figures of this application, the total number of elements or components shown is not intended to be limiting; those skilled in the art can recognize that the number of a particular component or type of element can, in some instances, be selected to accommodate the particular user needs.

In describing and illustrating the embodiments herein, in the text and in the figures, specific terminology (e.g., language, phrases, product brands names, etc.) may be used for the sake of clarity. These names are provided by way of example only and are not limiting. The embodiments described herein are not limited to the specific terminology so selected, and each specific term at least includes all grammatical, literal, scientific, technical, and functional equivalents, as well as anything else that operates in a similar manner to accomplish a similar purpose. Furthermore, in the illustrations, Figures, and text, specific names may be given to specific features, elements, circuits, modules, tables, software modules, systems, etc. Such terminology used herein, however, is for the purpose of description and not limitation.

Although the embodiments included herein have been described and pictured in an advantageous form with a certain degree of particularity, it is understood that the present disclosure has been made only by way of example, and that numerous changes in the details of construction and combination and arrangement of parts may be made without departing from the spirit and scope of the described embodiments. Having described and illustrated at least some the principles of the technology with reference to specific implementations, it will be recognized that the technology and embodiments described herein can be implemented in many other, different, forms, and in many different environments. The technology and embodiments disclosed herein can be used in combination with other technologies. In addition, all publications and references cited herein are expressly incorporated herein by reference in their entirety. Individual elements of different embodiments described herein may be combined to form other embodiments not specifically set forth above. Various elements, which are described in the context of a single embodiment, may also be provided separately or in any suitable sub-combination. It should also be appreciated that other embodiments not specifically described herein are also within the scope of the following claims.

What is claimed is:

1. An antenna system, comprising:

a reflector subsystem configured to receive an input beam and to reflect the input beam to produce an output beam towards at least one target, the reflector subsystem comprising an elevation reflector having a first range of motion and configured for steering the input beam in elevation and an azimuth reflector having a second range of motion and configured for steering the input beam in azimuth, wherein the output beam is steered in elevation and azimuth towards the target;

a rotatable support structure operably coupled to the azimuth reflector and to the elevation reflector and configured to rotate the elevation reflector and the azimuth reflector simultaneously;

a first support member comprising a lengthwise portion coupled to the rotatable support structure and an offset portion coupled to the elevation reflector, the offset portion configured to offset the elevation reflector from the lengthwise portion; and a second support member having a first end coupled to the rotatable support structure and a second end coupled to the azimuth reflector; and wherein, during a beam steering of the output beam, the offset portion is configured to enable clearance of the elevation reflector during beam steering of the output beam to extreme ends of the first range of motion of the elevation reflector.

2. The antenna system of claim 1, wherein the input beam comprises an axisymmetric beam having uniform power density distribution.

3. The antenna system of claim 1, wherein the first range of motion comprises a range of angles of approximately −5° to +95°.

4. The antenna system of claim 1 wherein the elevation reflector is configured to have a deployed position and a stowed position and wherein, in the stowed position, the offset portion of the first support member is configured to position an elevation reflector steering drive next to the lengthwise portion of the first support member, wherein, in the stowed position, a positioning of the elevation reflector is configured to minimize a stowed height of the elevation reflector.

5. The antenna system of claim 1, further comprising a linear actuator configured to raise the elevation reflector to a deployed position and to lower the elevation reflector to a stowed position.

6. The antenna system of claim 1, further comprising an elevation beam steering drive operably coupled to the elevation reflector and to the rotatable support structure, the elevation beam steering drive configured to rotate the elevation reflector about an elevation rotational axis when the elevation reflector is in a deployed position.

7. The antenna system of claim 1, wherein the antenna system further comprises a single degree of freedom canted rotary drive operably coupled to the second support member and configured to rotate the second support member along a first end of the second support member, to position the azimuth reflector coupled to the second end into a stowed position and into a deployed position, wherein the stowed position of the azimuth reflector is configured to minimize a stowed height of the azimuth reflector.

8. The antenna system of claim 7, further comprising an elevation beam steering drive operably coupled to the elevation reflector and to the rotatable support structure, wherein:

the elevation beam steering drive is configured to rotate the elevation reflector about an elevation rotational axis when the elevation reflector is in its deployed position, wherein, when the azimuth reflector is in its deployed position;

the rotatable support structure is configured to rotate the azimuth reflector about an azimuth rotational axis; and when the elevation reflector and the azimuth reflector are both deployed and the input beam is received, the elevation beam steering drive and the rotatable support structure are configured to cooperate to enable the antenna system to direct its output beam to any point in a full hemispherical sky dome.

9. The antenna system of claim 8, wherein:

the input beam comprises a high power microwave signal;

the elevation reflector is configured to have a first deployed position and a first stowed position;

in the first stowed position of the elevation reflector, the offset portion of the first support member is configured to position the elevation reflector next to the lengthwise portion of the first support member; and in the first stowed position of the elevation reflector, a positioning of the elevation reflector is configured to minimize a stowed height of the elevation reflector.

10. The antenna system of claim 5, further comprising an elevation steering head tilt actuator operably coupled to the elevation reflector and to the rotatable support structure, the elevation steering head tilt actuator configured to cooperate with the linear actuator to produce motion of the elevation reflector that is configured to stow the elevation reflector in a horizontal position.

11. The antenna system of claim 1, wherein the input beam comprises a high power microwave (HPM) signal and wherein the output beam that is steered towards the target is configured to direct HPM energy towards the at least one target as part of a directed energy weapon (DEW) system.

12. The antenna system of claim 1 wherein the antenna system is in operable communication with a control subsystem that is configured to receive information about the at least one target and that is configured to automatically control, based on the information about the at least one target; at least one of:

a characteristic of the input beam;

a position of the rotatable support structure;

a position of the elevation reflector; and a position of the azimuth reflector.

13. The antenna system of claim 1, wherein the input beam comprises a high power microwave (HPM) input beam, wherein the antenna system is sized for operation with the HPM input beam, and wherein the rotatable support structure is operably coupled to a movable structure, wherein the movable structure is configured with a recessed region sized to receive the elevation reflector and the first support member when the elevation reflector and the first support member are in a first stowed position.

14. The antenna system of claim 13, wherein:

the antenna system has a first height when the elevation reflector is in the first stowed position and the azimuth reflector is in a second stowed position;

the movable structure has a second height; and the combination of the first height and the second height corresponds to an overall height that is sized to fit within a C-17 aircraft.

15. The antenna system of claim 14, wherein the movable structure comprises a beam generation subsystem configured to generate the HPM input beam for the antenna system.

16. A method of directing a high power microwave (HPM) beam to a target, the method comprising:

configuring a reflector subsystem to receive a high power microwave (HPM) input beam and to reflect the HPM input beam to produce an HPM output beam towards at least one target, the reflector subsystem comprising an elevation reflector having a first range of motion and configured for steering the input beam in elevation and an azimuth reflector having a second range of motion and configured for steering the input beam in azimuth, wherein the HPM output beam is steered in elevation and azimuth towards the target;

operably coupling a rotatable support structure to the azimuth reflector and to the elevation reflector;

configuring the rotatable support structure to rotate the elevation reflector and the azimuth reflector simultaneously;

coupling the elevation reflector to the rotatable support structure via a first support member comprising a lengthwise portion coupled to the rotatable support structure and an offset portion coupled to the elevation reflector, the offset portion configured to offset the elevation reflector from the lengthwise portion; and coupling a first end of a second support member to the rotatable support structure and a second end of the second support member to the azimuth reflector; and steering the HPM output beam towards the target, wherein, during the beam steering, the offset portion is configured to enable clearance of the elevation reflector during the beam steering of the HPM output beam to extreme ends of the first range of motion of the elevation reflector.

17. The method of claim 16, further comprising:

receiving information about the at least one target;

automatically controlling, based on the information about the at least one target, at least one of:

a characteristic of the input beam;

a position of the rotatable support structure;

a position of the elevation reflector; and a position of the azimuth reflector.

18. A method of stowing a reflector in a high power microwave (HPM) antenna system, the method comprising:

configuring a reflector subsystem to receive a high power microwave (HPM) input beam and to reflect the HPM input beam to produce an HPM output beam towards at least one target, the reflector subsystem comprising an elevation reflector having a first range of motion and configured for steering the input beam in elevation and an azimuth reflector having a second range of motion and configured for steering the input beam in azimuth, wherein the HPM output beam is steered in elevation and azimuth towards the target;

operably coupling a rotatable support structure to the azimuth reflector and to the elevation reflector;

configuring the rotatable support structure to rotate the elevation reflector and the azimuth reflector simultaneously;

coupling the elevation reflector to the rotatable support structure via a first support member comprising a lengthwise portion coupled to the rotatable support structure and an offset portion coupled to the elevation reflector, the offset portion configured to offset the elevation reflector from the lengthwise portion;

coupling a first end of a second support member to the rotatable support structure and a second end of the second support member to the azimuth reflector; and configuring the elevation reflector to have a first deployed position and a first stowed position and wherein, in the first stowed position, the offset portion of the first support member is configured to position the elevation reflector next to the lengthwise portion of the first support member, wherein a positioning of the elevation reflector, in the first stowed position, is configured to minimize a stowed height of the elevation reflector.

19. The method of claim 18, further comprising operably coupling a single degree of freedom canted rotary drive operably to the second support member, the single degree of freedom canted rotary drive configured to rotate the second support member along a first end of the second support member to position the azimuth reflector coupled to the second end into a second stowed position and into a second deployed position, wherein the second stowed position of the azimuth reflector is configured to minimize a stowed height of the azimuth reflector.

20. The method of claim 19, further comprising:

operably coupling the rotatable support structure to a movable structure, wherein the movable structure is configured with a recessed region sized to receive the elevation reflector and the first support member when the elevation reflector and the first support member are in the first stowed position.

* * * * *